US010463153B2

(12) United States Patent
Peterson et al.

(10) Patent No.: US 10,463,153 B2
(45) Date of Patent: Nov. 5, 2019

(54) SEATING ARRANGEMENT

(71) Applicant: Steelcase Inc., Grand Rapids, MI (US)

(72) Inventors: Gordon J. Peterson, Rockford, MI (US); Robert J. Battey, Middleville, MI (US); Nickolaus William Charles Deevers, Holland, MI (US)

(73) Assignee: Steelcase Inc., Grand Rapids ( * ) Notice: Subject to any disclaimer, the term of this patent is extended or adjusted under 35 U.S.C. 154(b) by 133 days.

(21) Appl. No.: 15/605,760

(22) Filed: May 25, 2017

(65) Prior Publication Data

US 2017/0354256 A1 Dec. 14, 2017

Related U.S. Application Data

(60) Provisional application No. 62/447,169, filed on Jan. 17, 2017, provisional application No. 62/347,930, filed on Jun. 9, 2016.

(51) Int. Cl.

| | |
|---|---|
| ***A47C 3/025*** | (2006.01) |
| ***A47C 1/024*** | (2006.01) |
| ***A47C 1/032*** | (2006.01) |
| ***A47C 3/026*** | (2006.01) |
| *A47C 1/00* | (2006.01) |

(52) U.S. Cl.

CPC ..... *A47C 3/025* (2013.01); *A47C 1/024* (2013.01); *A47C 1/03255* (2013.01); *A47C 3/026* (2013.01); *A47C 1/00* (2013.01)

(58) Field of Classification Search

CPC ..... A47C 1/00; A47C 1/024; A47C 1/03255; A47C 3/025; A47C 3/026

See application file for complete search history.

(56) References Cited

U.S. PATENT DOCUMENTS

| | | | |
|---|---|---|---|
| 1,222,175 | A | 4/1917 | Bobrick |
| 2,052,811 | A | 9/1936 | Suekoff |
| 2,620,861 | A | 12/1952 | Oothoudt |
| 3,117,775 | A | 1/1964 | Hamilton |
| 4,155,592 | A | 5/1979 | Tsuda et al. |
| 4,281,875 | A | 8/1981 | Manzoni |
| 4,328,943 | A | 5/1982 | Eldon, III |

(Continued)

FOREIGN PATENT DOCUMENTS

| | | |
|---|---|---|
| EP | 2622991 A1 | 8/2013 |
| EP | 2622991 B1 | 11/2014 |

(Continued)

*Primary Examiner* — James M Ference

(74) *Attorney, Agent, or Firm* — Price Heneveld LLP

(57) ABSTRACT

A seating arrangement includes a back frame that includes a top portion, a bottom portion, and a pair of side portions that cooperate to define an opening, wherein at least one of the top portion, the bottom portion and the side portions include a longitudinally extending channel, a back shell having a forwardly facing support surface located within the opening and configured to support a seated user, and an attachment portion that extends about at least a portion of a periphery the support surface, and a cover member extending over the support surface, wherein the cover member is directly attached to the attachment portion of the back shell at an attachment location, and wherein the attachment location and the attachment portion of the back shell are located within the channel and concealed from view.

19 Claims, 44 Drawing Sheets

(56) References Cited

U.S. PATENT DOCUMENTS 4,544,324 A 10/1985 Hornung
4,564,235 A 1/1986 Hatsutta et al.
4,618,185 A 10/1986 Kaufman
4,630,865 A 12/1986 Ahs
4,818,019 A 4/1989 Mrotz, III
4,822,092 A 4/1989 Sweers
4,830,430 A 5/1989 Schaefer
4,836,597 A 6/1989 Izumida
4,892,355 A 1/1990 Fend
5,013,179 A 5/1991 Rothmund
5,141,385 A 8/1992 Tibbatts et al.
5,269,589 A 12/1993 Brothers et al.
5,478,134 A 12/1995 Bernard et al.
5,540,117 A 7/1996 Hansel et al.
5,700,060 A 12/1997 Bullard et al.
5,704,683 A 1/1998 Cooper et al.
5,711,575 A 1/1998 Hand et al.
5,902,011 A 5/1999 Hand et al.
5,934,753 A 8/1999 Lange
5,954,399 A 9/1999 Hong
6,079,782 A 6/2000 Berg et al.
6,079,785 A 6/2000 Peterson et al.
6,092,871 A 7/2000 Beaulieu
6,224,160 B1 5/2001 Takeuchi et al.
6,254,186 B1 7/2001 Falzon
6,375,269 B1 * 4/2002 Maeda ..... A47C 7/282 297/218.2
6,378,944 B1 * 4/2002 Weisser ..... A47C 7/282 160/369
6,394,546 B1 5/2002 Knoblock et al.
6,471,294 B1 10/2002 Dammermann et al.
6,523,904 B1 2/2003 Vanderminden
6,565,157 B2 5/2003 Barile, Jr. et al.
6,572,187 B2 6/2003 Laufer
6,575,530 B1 6/2003 Fischer et al.
6,588,842 B2 7/2003 Stumpf et al.
6,595,586 B2 7/2003 Brightbill et al.
6,619,745 B2 9/2003 Roberts et al.
6,626,497 B2 9/2003 Nagamitsu et al.
6,644,749 B2 11/2003 VanDeRiet et al.
6,688,690 B2 2/2004 Watson et al.
6,688,693 B2 2/2004 Christofferson et al.
6,817,667 B2 11/2004 Pennington et al.
6,820,933 B2 11/2004 Fereira Da Silva
6,837,546 B2 1/2005 VanDeRiet et al.
6,842,959 B2 1/2005 Coffield et al.
6,874,852 B2 4/2005 Footitt
6,880,215 B2 4/2005 Peterson
6,910,741 B2 6/2005 Footitt
6,942,300 B2 9/2005 Numa et al.
6,957,861 B1 10/2005 Chou et al.
6,983,997 B2 1/2006 Wilkerson et al.
6,991,291 B2 1/2006 Knoblock et al.
7,000,986 B2 2/2006 Cruz Fernandes de Pinho et al.
7,004,454 B2 2/2006 Petrone et al.
7,011,369 B2 3/2006 Massara et al.
7,063,384 B2 6/2006 Liu
7,066,550 B1 * 6/2006 Su ..... A47C 7/282 297/440.22
7,097,247 B2 8/2006 Battey et al.
7,100,990 B2 9/2006 Kimura et al.
7,159,293 B2 1/2007 Cotheld et al.
7,293,833 B2 11/2007 Takeuchi et al.
7,303,232 B1 12/2007 Chen
7,334,845 B2 2/2008 Peterson et al.
7,344,194 B2 3/2008 Maier et al.
7,347,495 B2 3/2008 Beyer et al.
7,360,836 B2 4/2008 Schwarzbich et al.
7,438,361 B1 * 10/2008 Huang ..... A47C 7/282 297/452.18
7,549,700 B2 6/2009 Blendea
7,568,763 B2 8/2009 Bedford et al.
7,568,765 B2 8/2009 Brauning
7,568,768 B1 8/2009 Tsai
7,604,298 B2 10/2009 Peterson et al.
D604,527 S 11/2009 Ooki et al.
7,618,096 B2 11/2009 Fujita et al.
7,647,714 B2 1/2010 Coffield et al.
7,654,617 B2 2/2010 Farnsworth
7,731,294 B2 6/2010 Yasuda et al.
7,748,783 B2 7/2010 Kinoshita et al.
7,794,021 B2 9/2010 Sahashi
7,841,667 B2 11/2010 Mossbeck
7,878,591 B2 2/2011 Walker et al.
7,922,247 B2 4/2011 Dickie
8,029,066 B2 10/2011 Su
8,109,576 B2 * 2/2012 Lin ..... A47C 31/02 297/452.13
8,128,175 B2 3/2012 Groelsma et al.
8,251,448 B2 8/2012 Machael et al.
8,267,478 B2 9/2012 Labuwy et al.
8,357,087 B2 1/2013 Fetzer
8,465,007 B2 6/2013 Cotheld et al.
8,544,392 B2 10/2013 Fields et al.
8,573,697 B1 11/2013 Su
8,585,345 B2 11/2013 Sikorski et al.
8,616,655 B2 * 12/2013 Jung ..... A47C 7/282 297/452.56
8,622,645 B2 1/2014 Hill
D703,988 S 5/2014 Smith et al.
D704,487 S 5/2014 Smith et al.
8,720,994 B2 5/2014 Gorgi
D706,547 S 6/2014 Smith et al.
8,931,849 B2 1/2015 Kusch et al.
8,991,932 B2 3/2015 Okuda et al.
8,998,339 B2 4/2015 Peterson et al.
9,033,421 B2 5/2015 Wilkinson et al.
9,155,393 B2 10/2015 Hurford et al.
9,199,565 B2 12/2015 McMillen et al.
9,204,728 B2 12/2015 Panozzo et al.
9,254,768 B2 2/2016 Hong
9,332,851 B2 5/2016 Machael et al.
2001/0002763 A1 6/2001 Roberts et al.
2002/0171277 A1 11/2002 Bock
2003/0001420 A1 * 1/2003 Koepke ..... A47C 1/03255 297/440.15
2004/0124689 A1 * 7/2004 Numa ..... A47C 7/282 297/452.56
2004/0245825 A1 * 12/2004 Battey ..... A47C 1/03255 297/284.4
2004/0245841 A1 * 12/2004 Peterson ..... A47C 7/28 297/452.63
2005/0073183 A1 4/2005 Hsiao
2005/0280299 A1 12/2005 Vogt et al.
2006/0040803 A1 2/2006 Perez
2007/0228799 A1 * 10/2007 Kinoshita ..... A47C 3/30 297/452.18
2007/0267911 A1 * 11/2007 Kinoshita ..... A47C 1/03255 297/452.18
2008/0001453 A1 1/2008 Rutman
2008/0079307 A1 * 4/2008 Su ..... A47C 7/282 297/452.56
2008/0106136 A1 5/2008 Heidmann et al.
2008/0157580 A1 * 7/2008 Lin ..... A47C 7/282 297/391
2008/0164744 A1 7/2008 Wang
2008/0296958 A1 * 12/2008 Peterson ..... A47C 7/40 297/452.18
2010/0078975 A1 4/2010 Kang
2011/0062758 A1 3/2011 Wiese
2011/0074202 A1 * 3/2011 Su ..... A47C 7/40 297/452.46
2012/0133183 A1 5/2012 Kim et al.
2012/0161482 A1 6/2012 Hayashi
2012/0161483 A1 6/2012 Hayashi
2012/0242130 A1 9/2012 Hung
2013/0069414 A1 3/2013 Ko
2013/0127219 A1 5/2013 Gerwig
2014/0054947 A1 2/2014 Su
2014/0077548 A1 * 3/2014 Peterson ..... A47C 1/024 297/284.4
2014/0084652 A1 3/2014 Norman et al.
2014/0287188 A1 9/2014 Naitou et al.

(56) References Cited

U.S. PATENT DOCUMENTS

| | | | | |
|---|---|---|---|---|
| 2015/0250319 | A1 | 9/2015 | Burwell et al. | |
| 2015/0265058 | A1 | 9/2015 | Igarashi et al. | |
| 2015/0296989 | A1 | 10/2015 | Machael et al. | |
| 2015/0320220 | A1 | 11/2015 | Eberlein et al. | |
| 2016/0059757 | A1 | 3/2016 | McMillen et al. | |
| 2016/0081477 | A1 | 3/2016 | Coffield | |
| 2016/0128483 | A1 | 5/2016 | Gorgi | |
| 2016/0135603 | A1 | 5/2016 | Chan et al. | |
| 2017/0354256 | A1* | 12/2017 | Peterson ..... | A47C 1/024 |

FOREIGN PATENT DOCUMENTS

| | | | |
|---|---|---|---|
| GB | 2487502 | A | 7/2012 |
| GB | 2487502 | B | 7/2012 |
| JP | 03662006 | B2 | 6/2005 |
| JP | 05386728 | B2 | 1/2014 |
| JP | 05563630 | B2 | 7/2014 |
| JP | 05567821 | B2 | 8/2014 |
| WO | 2003099071 | | 12/2003 |

* cited by examiner

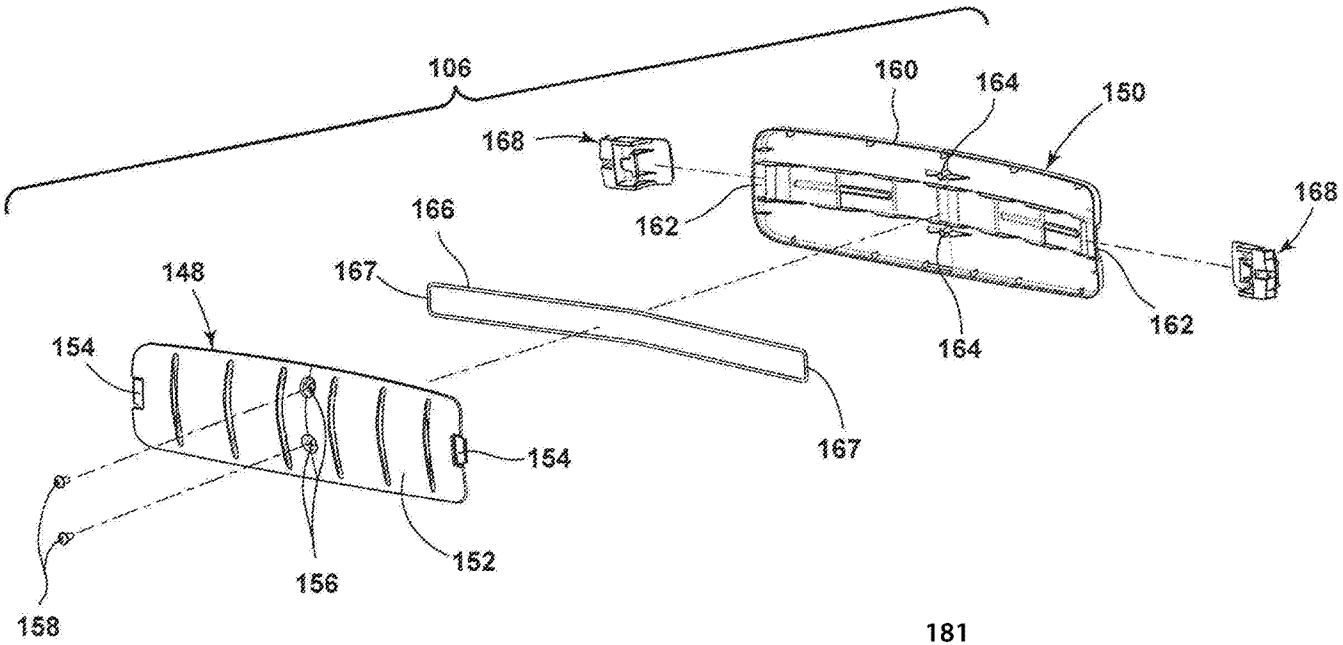
FIG. 11A
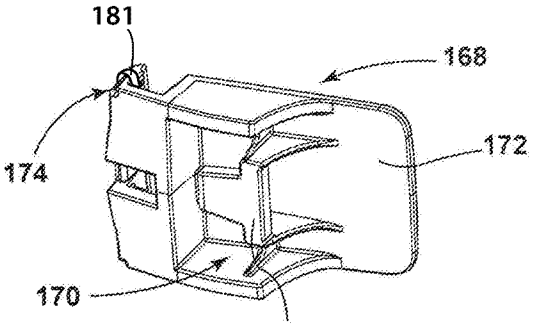
FIG. 11B1
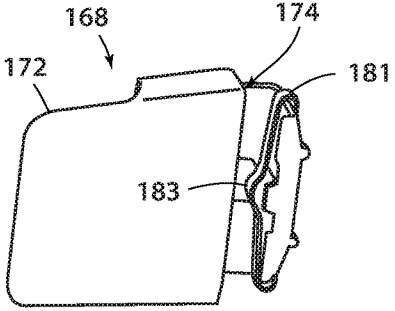
FIG. 11B2

SEATING ARRANGEMENT

TECHNICAL FIELD

Various embodiments relate to a seating arrangement that includes various combinations of linearly adjustable seat assemblies, reclinable back assemblies, flexible back support assemblies, control arrangements and vertically adjustable arm assemblies.

BRIEF SUMMARY

In one embodiment, a seating arrangement includes a seating assembly configured to support a seated user thereon, a back assembly movable between an upright position and a reclined position, wherein the back assembly is configured to support a user and extends upwardly from the seat assembly, and a control assembly. The control assembly includes a pair of spring members each having a first end operably coupled to the back assembly, and a second end, wherein the spring members are configured to bias the back assembly from the reclined position toward the upright position, and a cam member having a first cam surface and a second cam surface, wherein the first cam surface is radially offset from the second cam surface about the cam member such that the first cam surface contacts the second end of one of the pair of spring members when the back assembly is at a first position of recline, and the second cam surface contacts the second end of the other of the pair of spring members when the back assembly is at a second position of recline that is greater than the first position of recline, and wherein the first and second cam surfaces each include a laterally-extending abutment surface.

In another embodiment, a seating arrangement includes a seat assembly configured to support a seated user thereon, a back assembly movable between an upright position and a reclined position, wherein the back assembly is configured to support a user and extends upwardly from the seat assembly, and a control assembly. The control assembly includes a pair of spring members each having a first end operably coupled to the back assembly, and a second end, wherein the spring members are configured to bias the back assembly from the reclined position toward the upright position, and a cam member having a first cam surface and a second cam surface, wherein the first cam surface is radially offset from the second cam surface about the cam member such that the first cam surface contacts the second end of one of the pair of spring members when the back assembly is at a first position of recline, and the second cam surface contacts the second end of the other of the pair of spring members when the back assembly is at a second position of recline that is greater than the first position of recline, and wherein the cam member includes a plurality of walls between which the second end each of the pair of spring members tracks as the cam member is moved between a plurality of positions.

In yet another embodiment, a seating arrangement includes a seat assembly configured to support a seated user thereon, a back assembly movable between an upright position and a reclined position, wherein the back assembly is configured to support a user and extends upwardly from the seating assembly, and a control assembly. The control assembly includes a spring member configured to bias the back assembly from the reclined position toward the upright position, and an actuator member movable between a first position first position where the actuator member abuts a stop member thereby restricting the movement of the back assembly from the upright position toward the reclined position, a second position where the actuator member abuts the spring member such that the spring member biases the back assembly from the reclined position toward the upright position as the back assembly is moved from the upright position toward the reclined position, and a third position where the actuator member free from abutting the stop member and the spring member.

In still yet another embodiment, a seating arrangement includes a seat assembly configured to support a seated user thereon, a back assembly movable between an upright position and a reclined position, wherein the back assembly is configured to support a user and extends upwardly from the seating assembly, and a control assembly. The control assembly includes a spring member configured to bias the back assembly from the reclined position toward the upright position, an actuator member movable between a biased position where the spring member biases the back assembly from the reclined position toward the upright position, and an unbiased position where the spring member does not bias the back assembly from the reclined position toward the upright position as the back assembly is moved from the upright position toward the reclined position, and a cam arrangement that includes a first cam portion and a second cam portion connected to the actuator member, wherein the second cam portion is connected to the actuator member and is laterally movable from a first position to a second position corresponding to the biased position and the unbiased position of the actuator member, respectively.

In another embodiment, a seating arrangement includes a housing member, a seat assembly including a seat support member, wherein the seat assembly is configured to support a seated user, a first linkage member having a first end pivotably coupled with the housing member by a first pivot arrangement and a second end pivotably coupled with the seat assembly by a second pivot arrangement, and a second linkage member having a first end pivotably coupled with the housing member by a third pivot arrangement and a second end pivotably coupled with the seat support member by a fourth pivot arrangement, wherein at least two of the first pivot arrangement, the second pivot arrangement, the third pivot arrangement and the fourth pivot arrangement includes a shaft disposed within a slot, and wherein the shaft is secured so as to prevent sliding of the shaft within the slot.

In yet another embodiment, a method for assembling a seating arrangement includes providing a housing member, providing a seat assembly including a seat support member wherein the seat assembly is configured to support a seated user, providing a first linkage member having first end and a second end, providing a second linkage member having a first end and a second end, coupling at least two of the first end of the first linkage member with the housing member, the second end of the first linkage member with the seat support member, the first end of the second linkage member with the housing member, and the second end of the second linkage member with the seat support member by inserting a shaft into a slot, aligning the housing member, the seat support member, the first linkage member and the second linkage member with respect to one another by at least one of the shafts within at least one of the slots, and fixing the shafts within the slots such that the shafts are prevented from sliding along the slots.

In still yet another embodiment, a seating arrangement includes a seat assembly configured to support a seated user thereon, a back assembly movable between an upright position and a reclined position, wherein the back assembly is configured to support a user and extends upwardly from the seat assembly, and a control assembly. The control assembly includes a fixed member, a spring configured to bias the back assembly from the reclined position toward the upright position, wherein the spring includes a first end operably coupled to the back assembly, and a second end, and a bias adjustment member positioned between the fixed member and the second end of the spring, wherein the bias adjustment member is configured to adjust an amount of bias force exerted by the spring upon the back assembly, and wherein the bias adjustment member is configured to act as a bearing member between the second end of the spring end the fixed member as the second end of the spring moves with respect to the fixed member.

In yet another embodiment, a seating arrangement includes a seat assembly configured to support a seated user thereon, a back assembly movable between an upright position and a reclined position, wherein the back assembly is configured to support a user and extends upwardly from the seat assembly, and a control assembly. The control assembly includes a fixed member, a spring configured to bias the back assembly from the reclined position toward the upright position, wherein the spring includes a first end operably coupled to the back assembly, and a second end, and a bias adjustment member positioned between the fixed member and the second end of the spring, wherein the bias adjustment member is configured to adjust an amount of bias force exerted by the spring upon the back assembly, wherein the bias adjustment member cannot be adjusted without at least partial disassembly of the seating arrangement.

In another embodiment, a seating arrangement includes a receiver, a column member including a first portion having a first longitudinal axis and a second portion having a second longitudinal axis that is angularly offset from the first longitudinal axis, wherein the first portion is telescopingly received within the receiver, an arm support coupled to the second portion of the column member and configured to support a portion of an arm of a seated user, and a locking arrangement. The locking arrangement includes an actuator portion configured to be accessible by a seated user, wherein the actuator portion is positioned along a length of the second portion of the column member, a lock portion movable between an unlocked position where the first portion of the column member is telescopingly adjustable within the receiver, and a locked position where the first portion of the column member is prevented from telescoping adjustment within the receiver, wherein the lock portion is positioned along a length of the first portion of the column member, and a connector portion extending between the actuator portion and the lock portion, wherein the connector portion communicates an input force from the actuator portion to the lock portion to move the lock portion between the locked position and the unlocked position, and wherein the actuator portion, the portion and the connector portion are a single, integral piece.

In still another embodiment, a seating arrangement includes a seat assembly configured to support a seated user, a back assembly configured to support the back of a seated user, where the back assembly includes a back frame that extends upwardly from the seat assembly, a receiver, and a column member telescopingly received within the receiver. The seating arrangement further includes an arm support coupled to the column member and configured to support a portion of an arm of a seated user, and a locking arrangement including a lock portion and a receiving portion, wherein the lock portion is movable between an unlocked position where the column member is telescopingly adjustable within the receiver, and a locked position where the locking portion engages the receiving portion thereby preventing the column member from telescoping adjustment within the receiver, and wherein the back frame, the receiver and the receiving portion are a single, integral piece.

In still yet another embodiment, a seating arrangement includes a seat assembly slidably movable between a forward most position and a rearward most position, the seat assembly including a seat support structure configured to support a seated user thereon, and at least one elongated slide bearing attached to the seat support structure and including a bearing surface and at least one stop member, wherein the bearing surface and the at least one stop member are a single, integral piece. The seating arrangement further includes at least one slide support member that slidably supports the slide bearing thereon between the forward most position and the rearward most position, wherein the at least one stop member is configured to prevent the seat assembly from being moved beyond at least one of the forward most position and the rearward most position.

In another embodiment, a seating arrangement includes a seat assembly slidably movable between a forward most position and a rearward most position, the seat assembly including a seat support structure configured to support a seated user thereon, wherein the seat support structure is flexibly resilient, and at least one elongated slide bearing attached to the seat support structure thereby structurally reinforcing the seat support structure from flexure, wherein the at least one slide bearing includes a bearing surface and at least one stop member. The seating arrangement further includes at least one slide support member that slidably supports the slide bearing thereon between the forward most position and the rearward most position, wherein the at least one stop member is configured to prevent the seat assembly from being moved beyond at least one of the forward most position and the rearward most position.

In yet another embodiment, a seating arrangement includes a seat assembly slidably movable between a forward most position and a rearward most position, the seat assembly including a seat support structure configured to support a seated user thereon, at least one elongated slide bearing attached to the seat support structure, wherein the at least one slide bearing includes a bearing surface and at least one stop member, and wherein the at least one stop member is configured to prevent the seat assembly from being moved beyond at least one of the forward most position and the rearward most position, and a release portion operably coupled to the at least one stop member and configured to move the at least one stop member from the first position to the second position, wherein the release portion is accessible from an exterior of the seating arrangement without use of a tool. The seating arrangement further including at least one slide support member that slidably supports the slide bearing thereon between the forward most position and the rearward most position.

In still another embodiment, a seating arrangement includes a seat assembly configured to support a seated user thereon, a control assembly supporting the seat assembly, a back assembly adapted to couple to the control assembly and extending upwardly from the seat assembly, and a quick-connection arrangement to connect the back assembly to the control assembly. The quick-connect arrangement includes a first relief and a first shaft arrangement, wherein one of the back assembly and the control assembly includes the first relief, and the other of the back assembly and the control assembly includes the first shaft arrangement received within the first relief, a second relief and a second shaft arrangement, wherein one of the back assembly and the control assembly includes the second relief, and the other of the back assembly and the control assembly includes the second shaft arrangement received within the second relief, and a locking arrangement that includes a primary locking member pivotable between a locked position, wherein the primary locking member abuts the second shaft arrangement, thereby preventing the second shaft arrangement from being removed from within the second relief, and an unlocked position, wherein the second shaft arrangement may be removed from within the second relief, thereby allowing the back assembly to be uncoupled from the control assembly.

In still yet another embodiment, a method for assembling a seating arrangement includes providing a seat assembly configured to support a seated user thereon, providing a control assembly supporting the seat assembly, providing a back assembly adapted to couple to the control assembly and extending upwardly from the seat assembly, and connecting the back assembly via a quick-connect arrangement. Connecting the back assembly includes providing a first relief and a first shaft arrangement, wherein one of the back assembly and the control assembly includes the first relief, and the other of the back assembly and the control assembly includes the first shaft arrangement received within the first relief, providing a second relief and a second shaft arrangement, wherein one of the back assembly and the control assembly includes the second relief, and the other of the back assembly and the control assembly includes the second shaft arrangement received within the second relief, providing a locking arrangement that includes a primary locking member pivotable between a locked position where the primary locking member abuts the second shaft arrangement, thereby preventing the second shaft arrangement from being removed from within the second relief, and an unlocked position, wherein the second shaft arrangement may be removed from within the second relief, thereby allowing the back assembly to be uncoupled from the control assembly, positioning the first shaft arrangement within the first relief, rotating the back assembly with respect to the control assembly until the second shaft arrangement is positioned within the second relief, and pivoting the primary locking member from the unlocked position to the locked position, thereby preventing the second shaft arrangement from being removed from within the second relief.

In another embodiment, a seating arrangement includes a seat assembly configured to support a seated user thereon, a control assembly supporting the seat assembly, a back assembly coupled to the control assembly and extending upwardly from the seat assembly, and a quick-connection arrangement. The quick-connection arrangement includes a relief and a shaft arrangement, wherein one of the back assembly and the control assembly includes the relief, and the other of the back assembly and the control assembly includes the shaft arrangement received within the relief, and a locking arrangement that includes a primary locking member movable between a locked position wherein the primary locking member abuts the shaft arrangement, thereby preventing the shaft arrangement from being removed from within the relief, and an unlocked position wherein the shaft arrangement may be removed from within the second relief, thereby allowing the back assembly to be uncoupled from the control assembly, and a secondary locking member operably coupled to the primary lock member and configured to prevent the primary locking member from moving from the locked position to the unlocked position.

In still another embodiment, a seating arrangement includes a receiver, a column member telescopingly received within the receiver, an arm support coupled to the second portion of the column member and configured to support a portion of an arm of a seated user, and a locking arrangement. The locking arrangement includes a first link having a first end pivotably coupled to the column member, a second end, and an actuator portion positioned along a length of the first link between the first end and the second end, and a second link having a first end pivotably coupled to the second end of the first link, and a second end operably coupled to a locking portion movable between an unlocked position where the column member is telescopingly adjustable within the receiver, and a locked position where the column member is prevented from telescoping adjustment within the receiver.

In yet another embodiment, a seating arrangement includes a substantially rigid back frame including a horizontally extending top portion, a horizontally extending bottom portion, and a pair of side portions extending vertically between the top portion and the bottom portion, wherein the top portion, the bottom portion and the side portions cooperated to define an opening, and wherein at least one of the top portion, the bottom portion and the side portions include a longitudinally extending channel, a flexibly resilient back shell having a forwardly facing support surface located within at least a portion of the opening and configured to support a seated user, and an attachment portion that extends about at least a portion of a periphery the support surface, and a cover member extending over at least a portion of the support surface, wherein the cover member is directly attached to the attachment portion of the back shell at an attachment location, and wherein the attachment location and the attachment portion of the back shell are located within the channel and concealed from view.

In still yet another embodiment, a seating arrangement includes a substantially rigid back frame including a horizontally extending top portion, a horizontally extending bottom portion, and a pair of side portions extending vertically between the top portion and the bottom portion, wherein the top portion, the bottom portion and the side portions of the back frame cooperated to define an opening, a flexibly resilient back shell having a forwardly facing support surface located within at least a portion of the opening and configured to support a seated user, and an attachment portion that extends about a majority of a periphery the support surface, and a cover member extending over at least a portion of the support surface, wherein the cover member is directly attached to the attachment portion of the back shell about a majority of the periphery of the support surface.

In another embodiment, a seating arrangement includes a seat assembly configured to support a seated user thereon in movable between a first vertical position and a second vertical position that is different than the first vertical position, and a control arrangement. The control arrangement includes a control input member graspable by a seated user and configured to be rotated in a first direction and in a second direction that is opposite from the first direction, a first arm having a first end coupled for rotation with the control input member and a second end, a second arm having a first contact surface, a second contact surface and an actuator portion, wherein the second end of the first arm is configured to contact the first contact surface of the second arm as the control input is rotated in the first direction thereby moving the actuator portion from a first position to a second position, and wherein the second end of the first arm is configured to contact the second contact surface of the second arm as the control input is rotated in the second direction thereby moving the actuator portion from the first position to the second position, and a pneumatic cylinder operable between an actuated state allowing vertical adjustment of the seat assembly between the first and second vertical positions, and an un-actuated state where the seat assembly is held at a given vertical position, and wherein the pneumatic cylinder is actuated from the on actuated state to the actuated state when the actuation portion of the second arm is moved from the first position to the second position.

In yet another embodiment, a seating arrangement includes a substantially rigid back frame member, and a flexible back shell member coupled to the back frame member and including a pair of vertical side portions and at least two strap portions extending laterally between the side portions, the at least two strap portions including a forwardly-facing surface configured to support a back of a seated user, the at least two strap portions including a lowermost strap portion, and the lowermost strap portion configured to deflect a first distance when a rearwardly-directed force is exerted on the lowermost strap portion by a seated user. The seating arrangement further includes a lumbar assembly supported from the back frame and configured to support the lumbar region of a back of a seated user, the lumbar assembly configured to deflect a second distance when the rearwardly-directed force is exerted on the lumbar assembly by a seated user, wherein the first distance and the second distance are substantially similar.

In still yet another embodiment, a seating arrangement includes back frame member, and a lumbar assembly vertically adjustable with respect to the back frame member, the lumbar assembly including a forwardly-facing support surface configured to support the back of seated user, the support surface including a first portion and a second portion located at a different vertical height than the first portion, wherein the second portion is movable between a first position where the second portion is located forward of the first portion and defines the forward-most surface of the support surface, and a second position where the second portion is substantially planar with the first portion.

In yet another embodiment, a method for testing the vertical movement of a lumbar assembly of a seating arrangement includes providing a seat assembly having an upper surface configured to support a seated user thereon, and providing a lumbar assembly vertically adjustable with respect to the back frame member, the lumbar assembly including a forwardly-facing support surface configured to support the back of seated user, the support surface including a first portion and a second portion located at a different vertical height than the first portion, wherein the second portion is movable between a first position where the second portion is located forward of the first portion and defines the forward-most surface of the support surface along a centerline of the seating arrangement, and a second position where the second portion is substantially planar with the first portion. The method further includes moving the lumbar assembly vertically with respect to the upper surface of the seat assembly to a first vertical position, locating the forward-most surface of the support surface along the centerline of the seating arrangement with the lumbar assembly located at the first vertical position, wherein the forward-most surface of the support surface is defined by the second portion while in the first position, moving the lumbar assembly vertically with respect to the upper surface of the seat assembly to a second vertical position, where the second vertical position is located at a greater vertical height than the first vertical position, and locating the forward-most surface of the support surface along the centerline of the seating arrangement with the lumbar assembly located at the second vertical position, wherein the forward-most surface of the support surface is defined by the second portion while in the first position.

In still another embodiment, a seating arrangement includes a control structure, and a seat assembly slidably supported on the control structure between a forward most position and a rearward most position. The seat assembly includes a first stop member configured to move between a first position where the first stop member prevents the seat assembly from being detached from the support structure and a second position where the first stop member does not prevent the seat assembly from being detached from the support structure, wherein the first stop member is configured to abut at least one of a first slide rail and a first slide bearing member when in the first position, a second stop member spaced from the first stop member and configured to move between a first position where the second stop member prevents the seat assembly from being detached from the support structure and a second position where the second stop member does not prevent the seat assembly from being detached from the support structure, wherein the second stop member is configured to abut at least one of a second slide rail and a second slide bearing member when in the first position, and a third stop member spaced from the first stop member and the second stop member and configured to move between a first position where the third stop member prevents the seat assembly from being detached from the support structure and a second position where the third stop member does not prevent the seat assembly from being detached from the support structure, wherein the third stop member is located laterally outward from the at least one of the first slide rail and the first slide bearing member and the at least one of the second slide rail and the second slide bearing member. The first stop member, the second stop member and the third stop member are configured such that the first stop member, the second stop member and the third stop member must be simultaneously moved to the second position to detached the seat support structure from the control structure.

In still another embodiment, a seating arrangement includes a control structure, a seat assembly slidably supported on the control structure between a forward most position and a rearward most position. The seat assembly includes a first stop member configured to move between a first position where the first stop member prevents the seat assembly from being detached from the support structure and a second position where the first stop member does not prevent the seat assembly from being detached from the support structure, a second stop member spaced from the first stop member and configured to move between a first position where the second stop member prevents the seat assembly from being detached from the support structure and a second position where the second stop member does not prevent the seat assembly from being detached from the support structure, and a third stop member spaced from the first stop member and the second stop member and configured to move between a first position where the third stop member prevents the seat assembly from being detached from the support structure and a second position where the third stop member does not prevent the seat assembly from being detached from the support structure. The first stop member, the second stop member and the third stop member are configured such that the first stop member, the second stop member and the third stop member must be simultaneously moved to the second position to detached the seat support structure from the control structure, wherein the seat support structure may be detached from the control structure by moving the seat support structure relative to the control structure in an entirely longitudinal direction.

In another embodiment, a seating arrangement includes a first supporting structure, a second supporting structure having a first forwardly-facing surface configured to support a seated user thereon, the supporting structure including at least one aperture extending therethrough, and a fastener member configured to fasten the first supporting structure to the second supporting structure, the faster member including a second forwardly-facing facing surface, the fastener member extending through the at least one aperture such that the second forwardly-facing surface of the fastener is substantially flush with the first forwardly-facing surface of the second supporting structure, the fastener member snap-engaging the second supporting structure.

These and other features, advantages, and objects of the present invention will be further understood and appreciated by those skilled in the art by reference to the following specification, claims, and appended drawings.

BRIEF DESCRIPTION OF THE DRAWINGS

FIG. 11A is an exploded perspective view of a lumbar support assembly;

FIG. 11B1 is a perspective view of a mounting member of the lumbar support assembly;

FIG. 11B2 is a second perspective view of the mounting member of the lumbar support assembly;

DETAILED DESCRIPTION OF THE PREFERRED EMBODIMENTS

Figure 2:
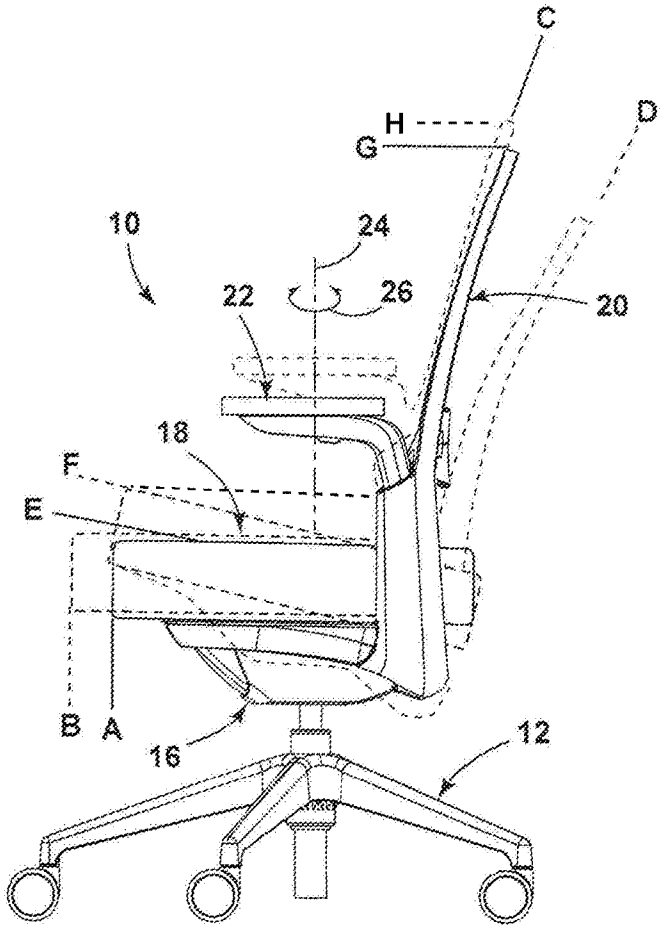
FIG. 2 is a side elevational view of the embodiment of the seating arrangement, wherein the seating arrangement is shown in a lowered position and a raised position, and in an upright position and a reclined position, and a seat assembly is shown in a retracted position and an extended position.
Figure 1:
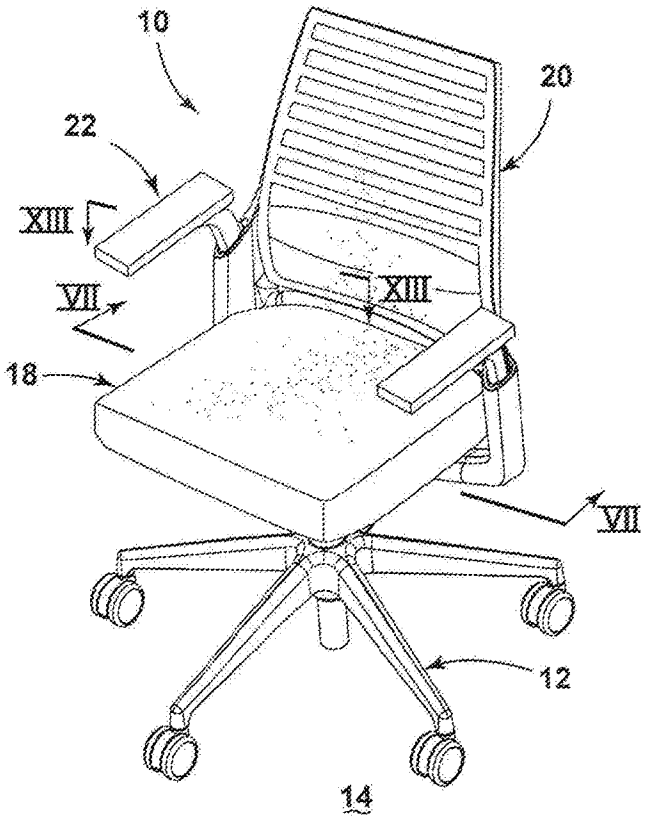
FIG. 1 is a perspective view of an embodiment of a seating arrangement.

For purposes of description herein, the terms "upper," "lower," "right," "left," "rear," "front," "vertical," "horizontal," and derivatives thereof shall relate to the invention as oriented in FIG. 1. However, it is to be understood that the embodiments as described herein may assume various alternative orientations and step sequences, except where expressly specified to the contrary. It is also to be understood that the specific devices and processes illustrated in the attached drawings, and described in the following specification are exemplary embodiments of concepts defined in the appended claims. Hence, specific dimensions and other physical characteristics relating to the embodiments disclosed herein are not to be considered as limiting, unless the claims expressly state otherwise. Various elements of the embodiments disclosed herein may be described as being operably coupled to one another, which includes elements either directly or indirectly coupled to one another. Further, the term "seating arrangement" as utilized herein encompasses numerous seating arrangements, including, but not limited to, office chairs, vehicle seating, home seating, stadium seating, theater seating, and the like The reference numeral 10 (FIG. 1) generally designates a seating arrangement embodying the present invention. In the illustrated example, the seating arrangement 10 includes an office chair assembly. The seating arrangement 10 includes a castered base assembly 12 abutting a supporting floor surface 14, a control or support assembly 16 supported by the castered base assembly 12, a seat assembly 18, a back assembly 20, and a pair of arm assemblies 22. The seating arrangement 10 (FIG. 2) is configured such that the seat assembly is movable between a fully rearward position A and a fully forward position B, the back assembly 20 is movable between a fully upright position C and a fully reclined position D while the seat is movable between a fully upright position E and a fully reclined position F, and the control assembly 16, the seat assembly 18, the back assembly 20 and the arm assemblies 22 are movable between a fully lowered position G and a fully raised position H, as described below. The control assembly 16, the seat assembly 18, the back assembly 20 and the arm assembly 22 are further rotatably supported above the base assembly 12 for pivoting about an axis 24 in the directions 26.

Figure 3:
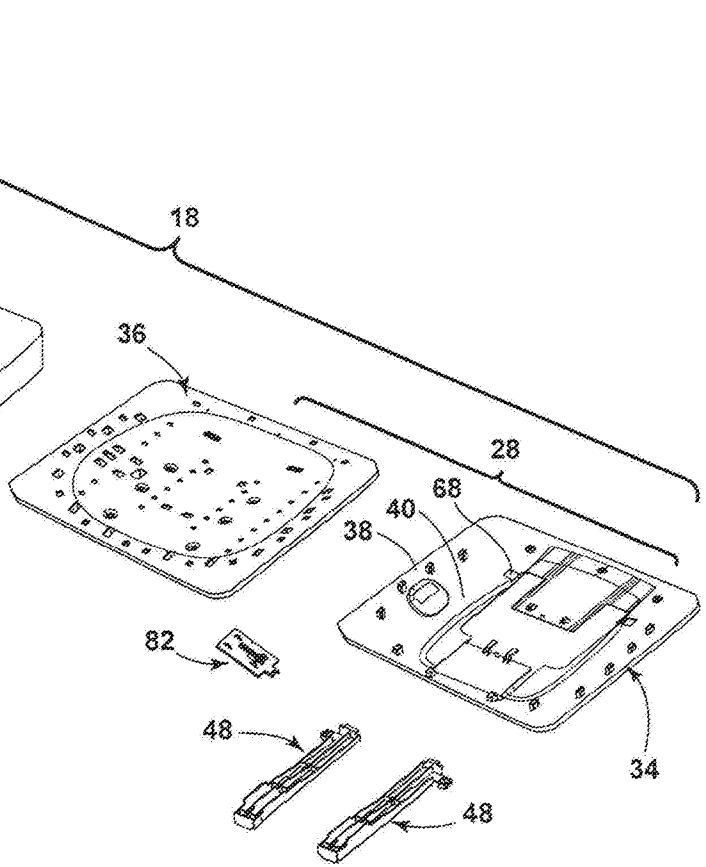
FIG. 3 is an exploded view of the seat assembly.
Figure 4:
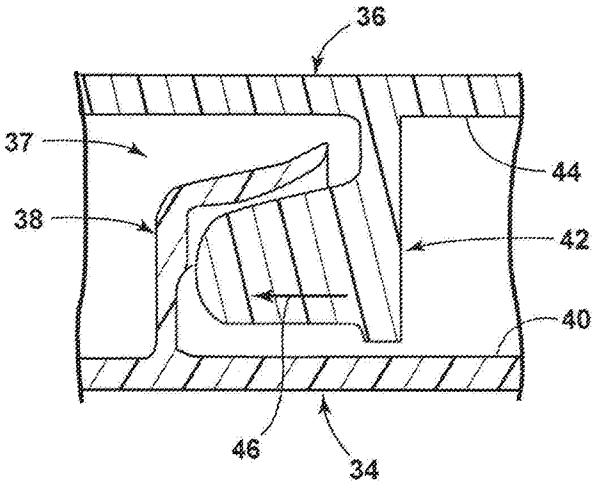
FIG. 4 is a cross-sectional view of a coupling arrangement between an upper shell member and a lower shell member of the seat assembly.

The seat assembly 18 (FIGS. 1 and 3) includes a shell assembly 28, a contoured, molded foam cushion member 30, and a fabric cover 32 covering the cushion member 30 and edges of the shell assembly 28. The shell assembly 28 includes a lower shell member 34 and an upper shell member 36. In the illustrated example, the lower shell member 34 and the upper shell member 36 are each constructed of a flexibly resilient plastic. The upper shell member 36 (FIGS. 3 and 4) is connected to the lower shell member 34 by a plurality of snap coupling arrangements 37 that include a plurality of first coupling portions 38 located about a periphery of and extending upwardly from an upper surface 40 of the lower shell member 34, and a plurality of second coupling portions 42 located about a periphery of and extending upwardly from a bottom surface 44 of the upper shell member 36. As illustrated, the first coupling portions may include a hook-like arrangement, while the second coupling portions 42 may include a tab arrangement, wherein the second coupling portions 42 are configured to be slidably received within the first coupling portions 38 in a direction 46. The upper shell member 36 is then further secured to the lower shell member 34 by a plurality of mechanical fasteners, such as screws (not shown) that prevents the second coupling portions 42 from disengaging the first coupling portions 38.

Figure 6:
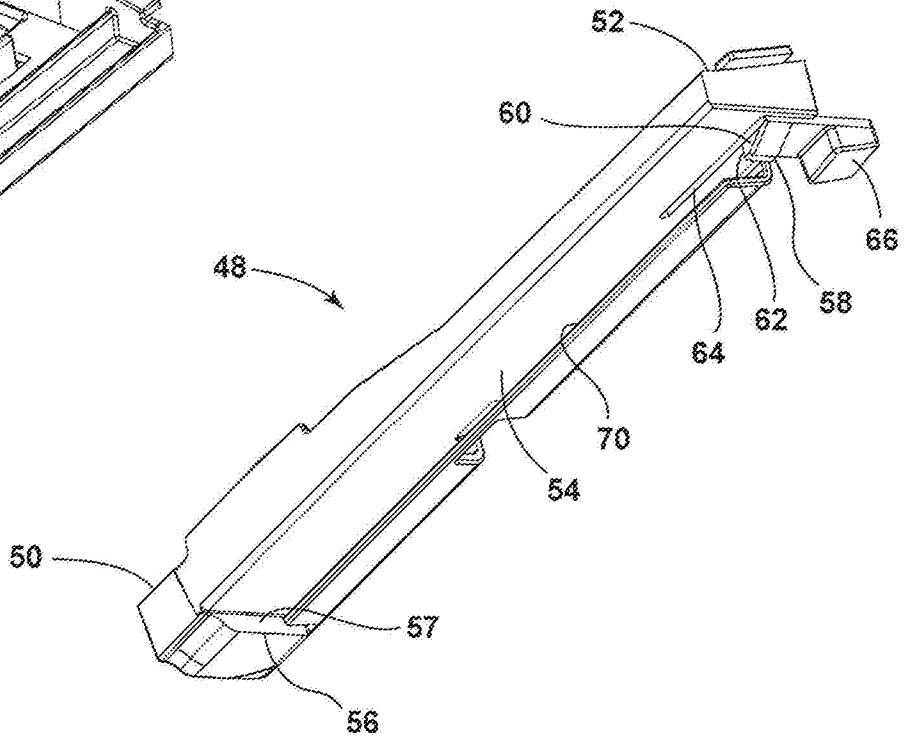
FIG. 6 is a bottom perspective view of the slide bearing member.
Figure 5:
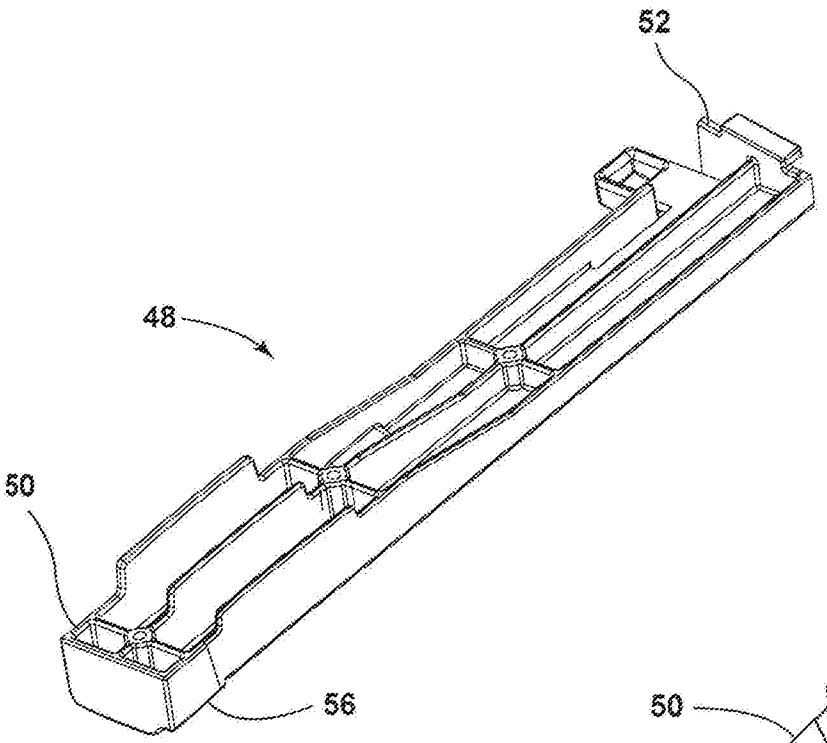
FIG. 5 is a top perspective view of a slide bearing member.

The seating assembly 18 further includes a pair of slide bearing members 48 (FIGS. 3, 5 and 6) configured to slidably support the seat assembly 18 on the control assembly 16. In the illustrated example, each elongate bearing member 48 includes a first end 50, a second end 52 and a downwardly-facing bearing surface 54 extending therebetween. Each bearing member 48 further includes a first stop member 56 located proximate the first end 50, and a second stop member 58 located proximate the second end 52. The first stop member 56 includes a downwardly extending abutment surface 57, while the second stop member 58 includes a downwardly-extending, flexibly resilient tab 60 having a vertically extending abutment surface 62. The tab 60 is located along a flexible arm 64 and is movable between a lowered or non-flexed position, wherein the abutment surface 62 extends below the bearing surface 54, and a raised or flexed position, wherein the abutment surface 62 is positioned above the bearing surface 54. Each bearing member 48 further includes an actuator portion 66 integrally formed with the arm 64 at a distal end, such that movement of the actuator portion 66 in a vertical direction also moves the abutment surface 62 between the lowered position and the raised position thereof. In assembly, the bearing members 48 are assembled with the lower shell member 34 of the shell assembly 28 such that the actuator portion 66 extends through a corresponding aperture 68 of the lower shell member 34, and such that the actuator portion 66 is accessible to a user from an exterior of the seat assembly 18. Each bearing member 48 further includes a longitudinally extending channel 70 that extends along an edge of the bearing surface 54, and is configured to slidably couple the seat assembly 18 to the control assembly 16, as described below.

Figure 7:
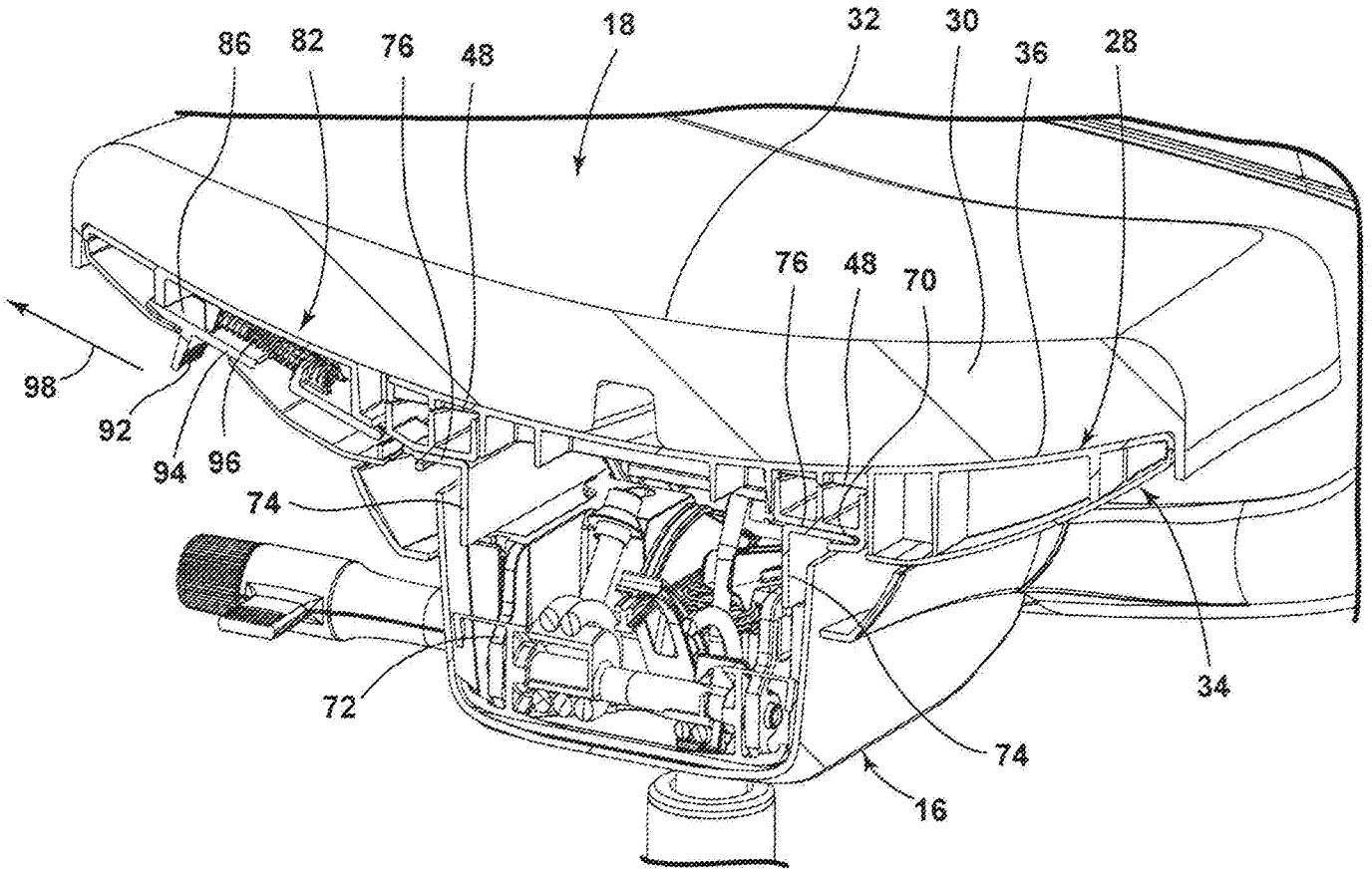
FIG. 7 is a cross-sectional view of the seat assembly taken along the line VII-VII, FIG. 1.
Figure 8:
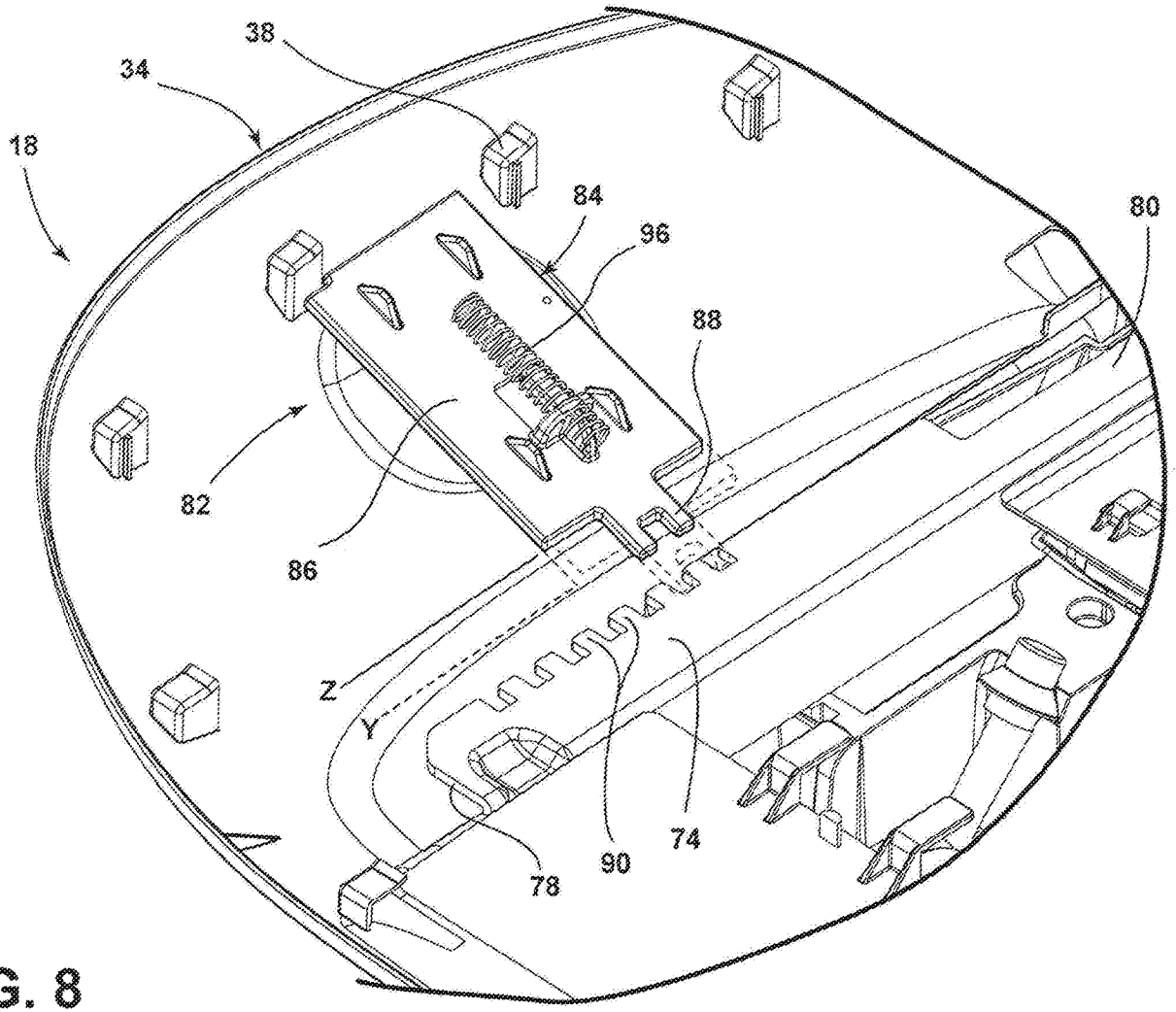
FIG. 8 is a perspective view of the seat assembly with a cover, a cushion member and the top shell member removed to expose an interior of the seat assembly.

As best illustrated in FIGS. 7 and 8, the control assembly 16 includes a housing member 72 that is fixed for movement with respect to ground, and a pair of elongated, L-shaped slide support rails 74 secured to the housing 72 via a plurality of mechanical fasteners such as screws (not shown). In the illustrated example, each slide support rail 74 includes an upwardly disposed bearing support surface 76 configured to slidably support the bearing surface 54 of one of the slide bearing members 48. In assembly, the seat assembly 18 is slidably coupled the control assembly 16 for longitudinal movement between the forward most position A (FIG. 2) and the rearward most position B by slidably inserting the slide support rails 74 into the channels 70 of the slide bearing members 48. As the slide bearing members 48 begin to couple with the slide support rails 74, the tab 60 abuts a forward edge 78 of the slide support rail 74 deflecting the tab 60 from the lowered position to the raised position thereof. The tab 60 then slides along the bearing support surface of the slide support rail as the seat assembly 18 is moved in a rearward direction with respect to the control assembly 16, until the tabs 60 reach a rearward edge 80 of the slide support rail 74 and the tabs 60 snap downwardly from the raised position to the lowered position thereof. In use, the rearward longitudinal travel of the seat assembly 18 with respect to the control assembly 16 is limited by abutment of the abutment surface 57 with the forward edge 78 of the slide support rail 74, while the forward longitudinal travel of the seat assembly 18 with respect to the control assembly 16 is limited by abutment of the abutment surface 62 of the tabs 60 with the rearward edge 80 of the slide support rail 74. The seat assembly 18 may be removed from attachment with the control assembly 16 by exerting an upwardly directed force on the actuator portion 66 of each of the slide bearing members 48 moving the abutment surfaces 62 from the lowered position to the raised position, thereby allowing the abutment surfaces 62 to clear the rearward edge 80 of the slide support rails 64 as the seat assembly 18 is moved from the rearward most position a toward the forward most position B. It is noted that the actuator portion 66 is accessible from an exterior of the seat assembly 16 and may be actuated without the use of a separate tool.

The seat assembly 18 and the control assembly 16 are further configured to allow the user to lock the seat assembly 18 at a predetermined positioned between the rearward most position A (FIG. 2) and the forward most position B. As shown in FIG. 8, the seat assembly 18 further includes a locking arrangement 82 that includes a locking member 84 slidably disposed within the shell assembly 28. In the illustrated example, the locking member 84 includes a planner body portion 86 sandwiched between the lower shell member 34 and the upper shell member 36 (FIG. 7), and slidable between an engaged position Y, and a disengaged position Z. A pair of teeth 88 extending laterally inward from the body portion 86 and are configured to selectively engage two of a plurality of recesses 90 spaced longitudinally along one of the slide support rails 74. A handle portion 92 extends downwardly from the body portion 86 and through an aperture 94 within the lower shell member 34. The handle portion 92 is configured to be easily grasped by a user so that the user can move the locking member 84 between the locked position Y and the unlocked position Z. A coil spring 96 biases the locking member 84 from the unlocked position Z toward the locked position Y. In operation, a user may grasp the handle portion 92 and moves the handle portion 92 in a direction 98 thereby overcoming the biasing force exerted on the locking portion 84 by the coil spring 96 and disengaging the pair of teeth 88 of the locking member 84 from the recesses 90 of the slide support rail 74, thereby allowing the seat assembly 18 to be longitudinally adjusted with respect to the control assembly 18 between the rearward most position A and the forward most position B. Once a selected position has been reached, the operator releases the force being exerted onto the handle portion 92, thereby allowing the spring 96 to bias the teeth 88 of the locking member 84 into engagement with the apertures 90 with which the teeth 88 are aligned, thereby preventing further sliding movement of the seat assembly 18 with respect to the control assembly 16. In an alternative embodiment, the seat assembly 18 may only be removed from attachment with the control assembly 16 by exerting an upwardly directed force on the actuator portion 66 of both of the slide bearings 48, while simultaneously moving the handle portion 92 of the locking arrangement 82 and disengaging the teeth 88 from the recesses 90 of the slide support rail 74. This configuration requires three separate inputs to the seat assembly 18 and control assembly 16 to detach the seat assembly 18 from the control assembly 16. It is noted that the actuator portion 66 and the handle portion 92 are sufficiently spaced from one another that it is difficult for a single operator to move all three portions without specific effort to do so.

The back assembly 20 (FIGS. 1 and 9) includes a substantially rigid back frame member 102, a flexibly resilient back shell member 104, a lumbar support assembly 106 slidably positioned between the back frame member 102 and the back shell member 104, and a fabric cover 108 covering the back shell member 104. It is noted that while the illustrated example includes the cover 108 covering the lumbar support assembly, the seating arrangement 10 may also include variously configured back shell members that are not covered by a cover arrangement, where the back shell member itself provides the forwardly-facing surface upon which the back of a seated user is supported, or may also include other layers of material such as comfort surfaces, molded foam inserts, and the like. In the illustrated example, the back frame member 102 comprises a metal such as aluminum, and includes a horizontally extending upper frame portion 110, a horizontally extending lower frame portion 112, a pair of side frame portions 114 extending vertically between the upper frame portion 110 and the lower frame portion 112. The back frame member 102 further includes a horizontally extending intermediate frame portion 118 extending between the side frame portions 114 and positioned between the upper frame portion 110 and the lower frame portion 112. The upper frame portion 110, the intermediate frame portion 118 and the side frame portions 114 cooperate with one another to form an open interior space 120 over which the back shell member 104 extends. The upper frame portion 110, the intermediate frame portion 118 and the side frame portions 114 are each provided with a U-shaped cross-sectional configuration, thereby providing a forwardly opening channel 122 extending about to the periphery of the interior space 120. The frame member 112 may further include a plurality of integral tab members 124 extending into the channel 112 and spaced about the periphery of the interior space 120.

The back shell member 104 (FIGS. 9 and 10) includes a horizontally extending upper shell portion 126, a horizontally extending bottom shell portion 128, and a pair of side shell portions 130 extending vertically between the upper shell portion 126 and the bottom shell portion 128. The back shell member 104 further includes a plurality of horizontally extending, flexibly resilient straps 132 extending between the side shell portions 130, and cooperating into define a plurality of slots 133 therebetween. In the present embodiment, the back shell member 104 is provided a forwardly-facing convex configuration along a centrally located longitudinally-extending axis, and a forwardly facing concave configuration along a centrally located laterally-extending axis. In the illustrated example, the straps 132 are concentrated toward an upper portion of the overall back shell member 104, wherein the lowermost strap 134 of the plurality of straps 132 and the bottom shell portion 128 cooperate to define an open interior space 136 within which the lumbar assembly 106 is positioned. However, other configurations for the back shell member 104 may also be provided, wherein the lumbar assembly 106 is absent and the straps 104 extend across the entire interior space 136 between the upper shell portion 126 and the lower shell portion 128. Other configurations of the straps 132 may also be utilized, including angled or curved configurations. Moreover, while the present embodiment of the back shell member 104 comprises an integrally molded, single-piece unit, other configurations may also be employed, including multi-piece configurations. The back shell member 104 further includes a tab member 138 that extends about the majority of the outer periphery of the back shell member 104 except for the corners 140 of the back shell member 104 located between bottom shell portion 128 and the side shell portions 130. The tab member 138 includes a plurality of apertures 142 extending there through and spaced along a length of the tab member 138 that extends along the side shell portions 130, and a plurality of apertures 144 extending therethrough and spaced along a length of the tab member 138 that extends along the top shell portion 126, where the apertures 142, 144 are utilized to couple the back shell member 104 to the back frame member 102, as described below.

Figure 11D:
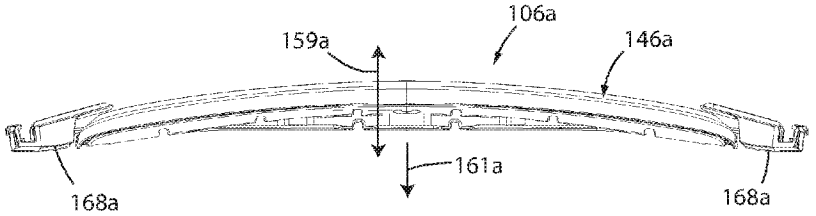
FIG. 11D is a top plan view of the alternative embodiment of the lumbar support assembly.

The lumbar assembly 106 (FIGS. 9 and 11A) includes a housing assembly 146 that includes a forward shell member 148 and a rearward shell member 150. In the embodiment as illustrated, the forward shell member 148 includes a forwardly-facing support surface 152 having forwardly-facing convex shape along the vertical extent thereof, and a laterally-extending, forwardly-facing, concave shape along the lateral length. The forward shell member 150 further includes a pair of attachment tabs 154 extending outwardly from ends thereof and recessed rearwardly from the support surface 152. The forward shell member 148 further includes a pair of centrally located apertures 156 configured to receive mechanical fasteners such as screws 158 therethrough. The rearward shell member 150 is provided an overall configuration similar to the forward shell member 158, and includes a peripherally-extending outer wall 160, a pair of apertures 162 located proximate the outward ends of the rearward shell member 150, and a pair of forwardly-extending mounting bosses 164 configured to threadably receive the screws 158 therein. The lumbar assembly 106 further includes a forwardly-concave shaped leaf spring member 166 and a pair of mounting members 168 coupled to ends 167 of the spring member 166. As best illustrated in FIG. 11B1, each mounting member 168 includes a slot 170 define about a boss 171 and within the which the ends 167 of the spring 166 are received, a tab 172 received within the corresponding aperture is 162 of the rearward shell member 150, and a hook arrangement 174 slidably received within the channel 122 of the side frame portions 114 of the back shell member 104, as described below.

Figure 13:
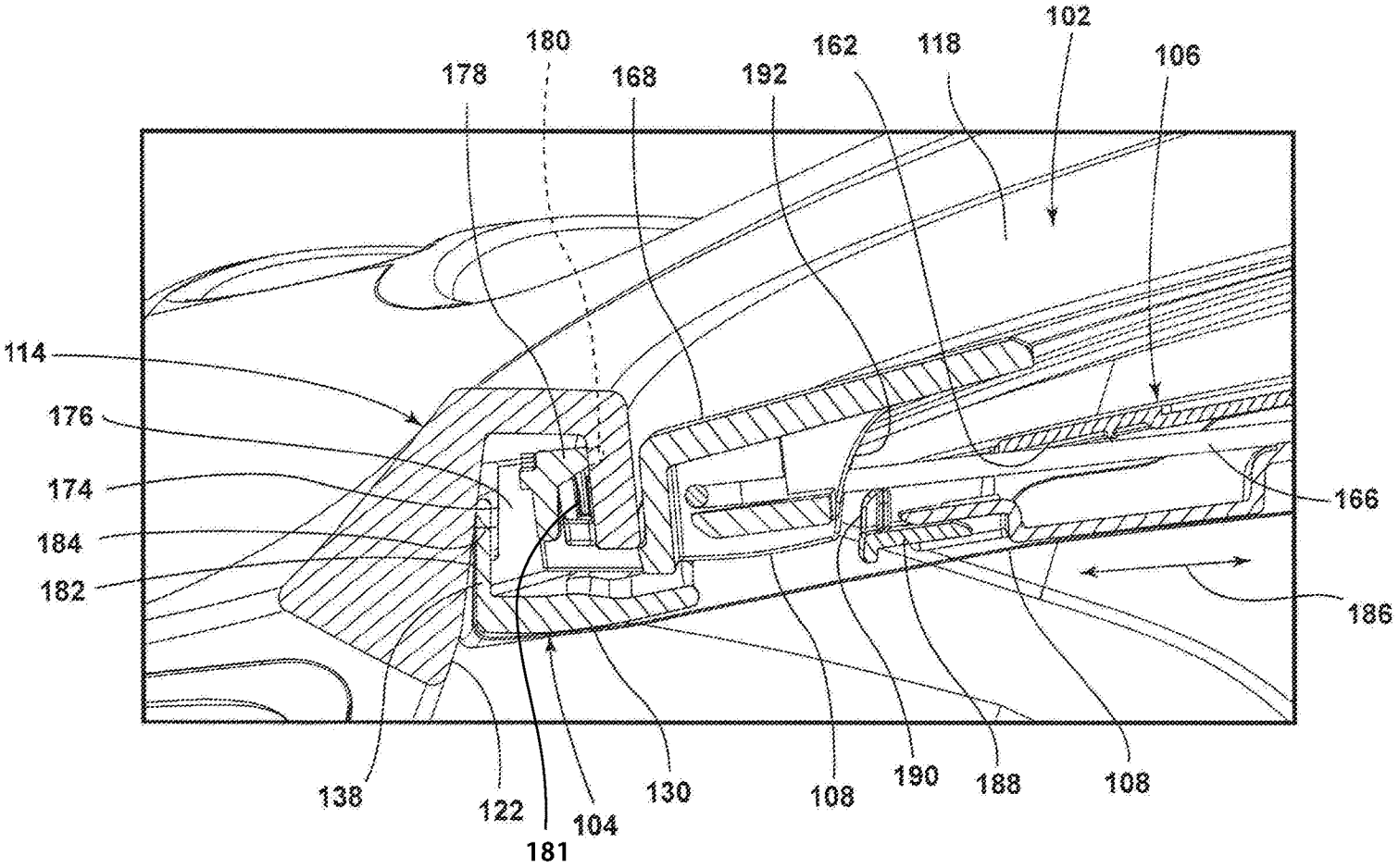
FIG. 13 is a cross-sectional view of a connection arrangement between the lumbar assembly, a back frame member and the back shell member taken along the line XIII-XIII, FIG. 1.

In assembly, the spring member 166 and the mounting members 168 are coupled with the rearward shell member 150 by inserting the ends 167 of the spring member 166 into corresponding apertures 162 of the rearward shell member 150 and position the ends 167 of the spring member 166 within the slots 170 of the mounting members 168. The forward shell member 148 is then coupled with the rearward shell member 150 by inserting the tabs 154 of the forward shell member 148 into the recesses 162 of the rearward shell member 150, and then inserting the screws 158 through the apertures 156 of the forward shell member 148 and threading the screws 158 into the mounting bosses 164 of the rearward shell member 150. The lumbar support assembly 106 (FIGS. 9 and 13) is then coupled to the back frame member 102 by inserting the hook arrangement 174 of each of the mounting members 168 into the channels 122 of the side frame portions 114. In the illustrated embodiment, each hook arrangement 174 includes a rearwardly-extending portion 176 received within the channel 122, and a laterally inward extending portion 178 received within an laterally inward extending undercut portion 180 of the channel 122. As the channel 122 and the undercut portion 180 thereof extends longitudinally along a length of the side frame portions 114, the lumbar support assembly 106 is vertically adjustable within the space 136 of the back shell member 104. A C-shaped spring member 181 (FIGS. 11B1 and 13) extends about the hook arrangement 174 and includes an inwardly-extending central engagement portion 183 configured to engage a select one of a plurality of reliefs 185 (FIG. 9) spaced along an interior surface of the channel 122, thereby holding the lumbar assembly 106 at a selected vertical portion.

Figure 12:
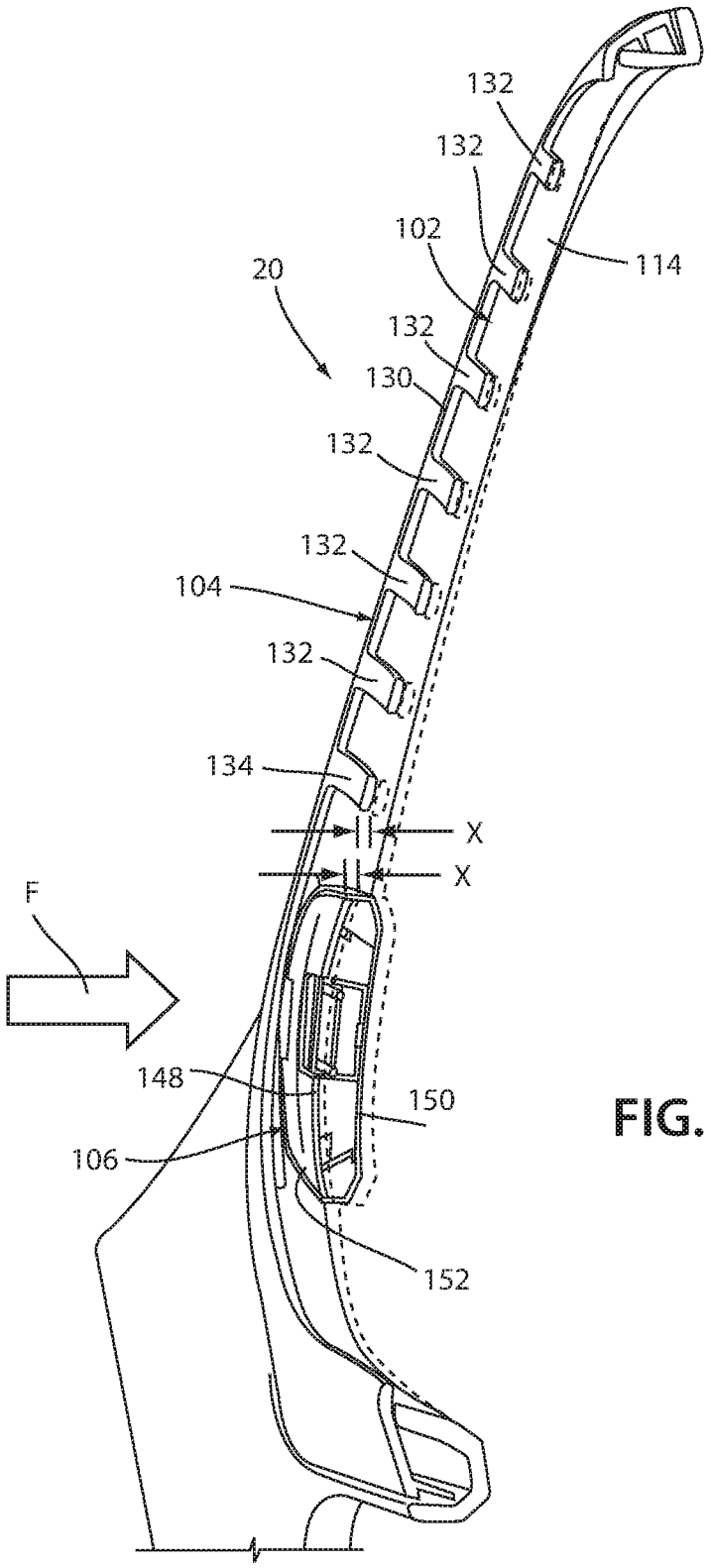
FIG. 12 is a cross-sectional side elevational view of the back assembly.

As best illustrated in FIG. 12, the lowermost strap portion 134 of the back shell member 104 and the lumbar assembly 106 rearwardly deflect or move a similar distance when a rearwardly directed force is exerted thereto, thereby improving the comfort to the seated user. Specifically, the lower strap portion 134 of the back shell member 104 and the lumbar assembly 106 are configured such that that lowermost strap portion 134 and the lumbar assembly 106 each deflect in a rearward direction an amount X when the same rearward directed force F is exerted on both the lowermost strap 134 and the lumbar assembly 106 by the back of a seated user. In this manner, a front surface 135 of the lowermost strap 134 and the forwardly-facing support surface 152 remain aligned with one another along the forwardly-facing convex configuration of the back shell member 104 as the back shell member 104 and the lumbar assembly flex, thereby maintaining a smooth, comfortable support surface for the seated user.

An outer periphery 182 (FIG. 13) of the cover 108 is directly sewn to the tab member 138 about a majority of the back shell member 104 by a plurality of stitches 184. In the present embodiment, the outer periphery 182 of the cover 108 is directly attached to the tab member 138 along the entire length of the tab member 138. As previously noted, the tab member 138 extends about the majority of the outer periphery of the back shell member 104, with the exceptions being at the corners 140. Other embodiments may include a tab member 138 that extends about the entire periphery of the back shell member 104 without interruptions therein, such that the outer periphery 182 of the cover 108 may be directly secured to the tab member 138 about the entire periphery of the back shell member 104. Further, while in the illustrated example the outer periphery 182 is directly coupled to the tab member 138 via stitching, other suitable fastening arrangements may also be utilized, including adhesion, sonic welding, in-molding, and the like.

The assembly of the back shell member 104 and the cover 108 are attached to the back frame member 102 by inserting the tab member 138 of the back shell member 104 and the outer periphery 182 of the cover 108 into the channel 122 of the back frame member 102, such that the tab member 138 of the back shell member 104 and the outer periphery 182 of the cover 108 is concealed from view within the channel 122 of the back frame member 102 subsequent to assembly. In the illustrated example, the hook arrangement 174 of the lumbar assembly 106, the tab member 138 of the back shell member 104 and the outer periphery 182 of the cover 180 are all received within the same channel 122, thereby reducing the overall packaging space for the related connections. In the illustrated example, the back shell member 104 is secured to the back frame member 102 by coupling the tab members 124 of the back frame member 102 with the associated apertures 142 of the back shell member 104, and by a plurality of mechanical fasteners 183, 185, as further described below.

The back frame member 102 further includes a plurality of integrally-formed abutment tabs 125 located within the U-shaped channel 122 of the back frame member 102 and spaced along the side frame portions 114. The tabs 125 extend into the channel 122 from an inner wall 127 of each of the side frame members 114 and are configured to abut the tab 138 of the back shell member 104, thereby limiting the inward deflection of the side shell portions 130 of the back shell member 104 in response to a rearwardly-directed force being exerted to the back shell member 104 by the back of a seated user.

In use, the housing assembly 146 of the lumbar support assembly 106 is configured to slide along the length of the spring member 166 in the directions 186, thereby allowing the support surface 152 of the housing assembly 146 to center with respect to a seated user's back when the user may not be centered with respect to the overall back assembly 20. In the illustrated example, each end 188 of the housing assembly 146 is provided with a rearwardly-facing convex curved abutment surface 190 configured to abut a corresponding forwardly facing concave curved abutment surface 192 of the corresponding mounting member 168. In operation, should the housing assembly 146 of the lumbar support assembly 106 slide into an off-center during rearward flexing of the sea shell member 104 and movement of the user within the chair, the abutment surface 190 of the housing assembly 146 abuts the abutment surface 146 of the mounting member 168 as rearward flex of the back shell member 104 is reduced, thereby forcing the housing assembly 146 of the lumbar support assembly 106 toward a centered position within the interior space 136.

Figure 11C:
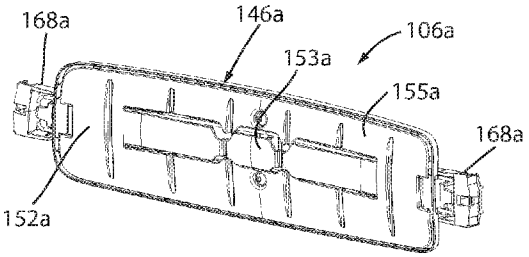
FIG. 11C is a perspective view of an alternative embodiment of the lumbar support assembly.
Figure 11E:
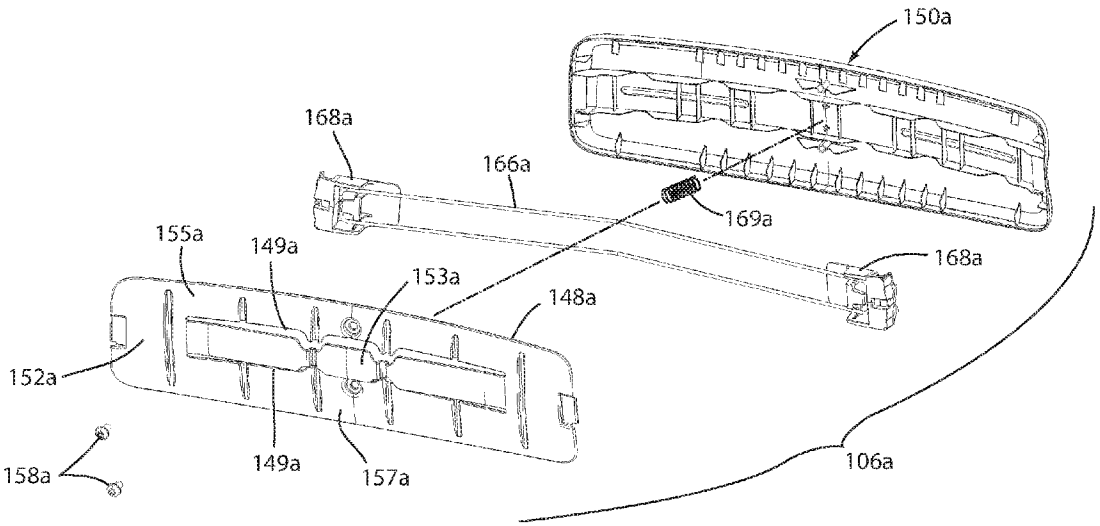
FIG. 11E is an exploded perspective view of the alternative embodiment of the lumbar support assembly.
Figure 11F:
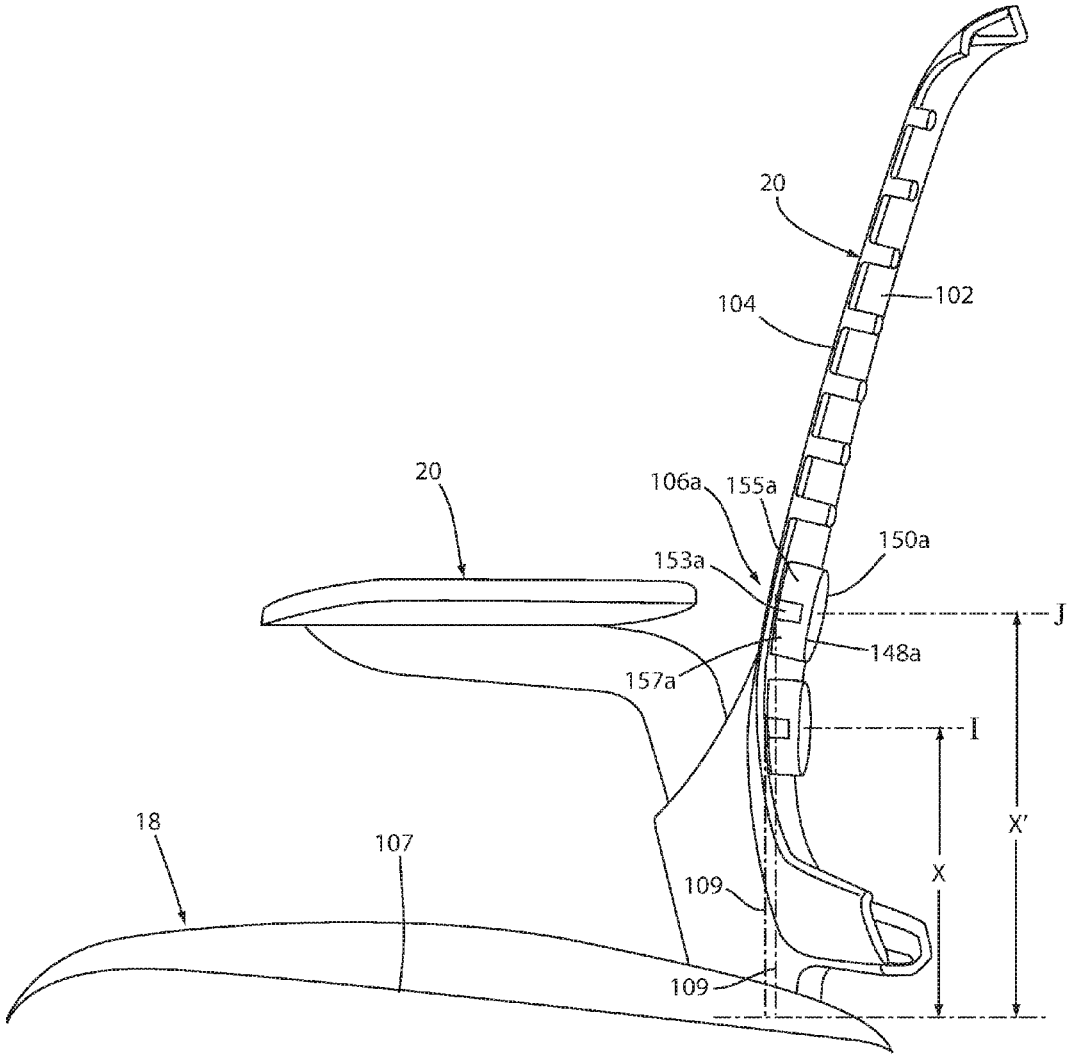
FIG. 11F is a cross-sectional side elevational view of the backrest assembly illustrating an S-point as defined by the lumbar support assembly.

The reference numeral 106*a* (FIGS. 11C-11E) generally designates another embodiment of the lumbar assembly. Since the lumbar assembly 106*a* is similar to the previously described lumbar assembly 106, similar parts appearing in FIGS. 11A and 11B and FIGS. 11C-11E, respectively, are represented by the same, corresponding reference numeral, except for the suffix "a" in the numerals of the latter. The lumbar assembly 106*a* (FIGS. 11C-11E) includes a housing assembly 146*a*, a pair of support handles 168*a*, a spring member 166*a* extending between the handles 168*a*, and a biasing member 167*a*. The housing assembly 146*a* includes a forward shell member 148*a* and a rearward shell member 150*a*. The spring member 166*a* is positioned between the forward shell member 148*a* and the rearward shell member 150*a*, and the shell members 148*a*, 150*a* are connected together via hardware such as screws 158*a*. The forward shell member 148*a* includes a forwardly-facing support surface 152*a*, and a laterally-extending flexible slat 153*a* positioned between an upper portion 155*a* and a lower portion 157*a* of the support surface 152*a* and partially spaced therefrom by gaps or slots 149*a*. The slat 153*a* is much more easily flexed in a fore-and-aft direction 159*a* than the overall housing assembly 146*a* and specifically the upper portion 155*a* and the lower portion 157*a* of the forward shell member 148*a*. The biasing member 169*a*, such as a coil spring, is positioned between the rearward shell member 150*a* and the slat 153*a* of the forward shell member 148*a*, thereby biasing the slat 153*a* in a forward direction 161*a*. The biasing force exerted by the biasing member 167*a* on the slat 153*a* is relatively small, such that the slat 153*a* is easily rearwardly displaced when contacted by the back of a seated user. The forward-positioned slat 153*a* defines the "S-point," or forward-most point of the back assembly 20 in the lumbar area at the fore-to-aft median plane or centerline of the back assembly 20, and provides a specific point from which the vertical adjustability of the lumbar assembly 106*a* with respect to an upper surface 107 (FIG. 11F) of the seat assembly 18. One method for determining the location of the S-point includes moving a vertical straight edge 109 horizontally rearward along the upper surface 107 of the seat assembly 18 until the straight edge touches the forward-most surface of the back assembly 20 located in the lumbar area at the centerline of the back assembly 20, which in the instant example, would be the forward surface of the slat 153*a* of the forward shell member 148*a*. Another method includes projecting a vertical laser beam from a "car" movable along a horizontal track until the beam illuminates the forward-most surface of the back assembly 20 located in the lumbar area at the centerline of the back assembly 20. It is noted that if the forward-most surface of the back assembly includes a series of equidistant points, then the S-point is determined as the midpoint of this surface located within the lumbar area of the back assembly. By way of example, two relative vertical positions of the S-point are illustrated in FIG. 11F, including a lowered position I located at a vertical distance X from the upper surface 107 of the seat assembly 18 and a raised position J located at a vertical distance X' from the upper surface 107 of the seat assembly 18. In use, a rearward pressure exerted on the slat 153*a* by the back of a seated user flexes the slat 153*a* in a rearward direction such that the slat 153*a* is substantially flush with the upper portion 155*a* and the lower portion 157*a* of the support surface 152*a*. The lumbar assembly 106*a* and the back assembly 20 may be configured such that the vertical travel of the S-point, as defined by the slat 153*a*, with respect to the upper surface 107 of the seat assembly 18 is preferably at least 50 mm, more preferably at least 80 mm, and most preferably at least 100 mm. Further the lumbar assembly 106*a* and the back assembly 20 may be configured such that the S-point, as defined by the slat 153*a*, is vertically adjustable with respect to the upper surface 107 of the seat assembly 18 a distance of preferably from equal to or less than about 170 mm to equal to or greater than about 250 mm, and more preferably from equal to or less than about 150 mm to equal to or greater than about 250 mm.

Figure 14A:
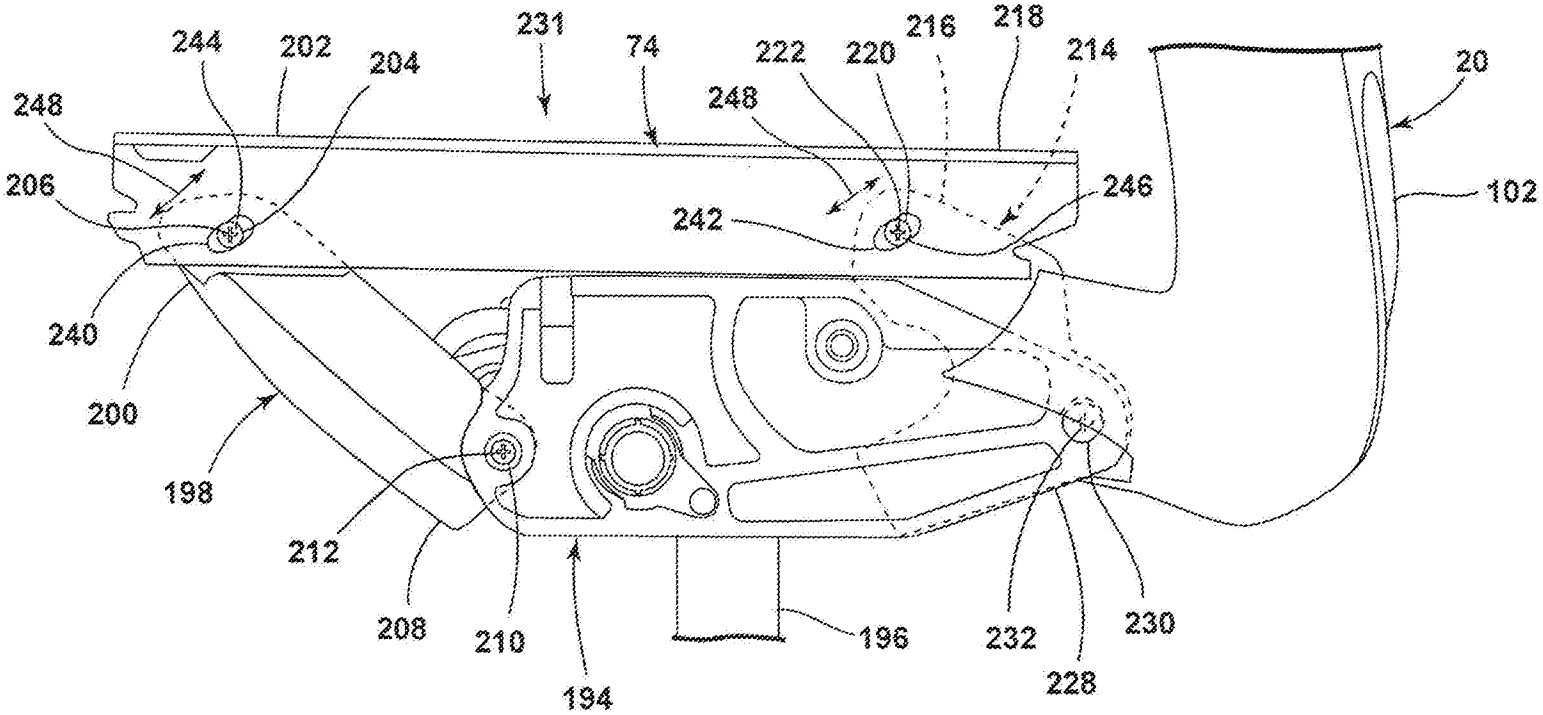
FIG. 14A is a side elevational view of a four-bar linkage arrangement of the seating arrangement shown in an upright position with interior components shown in dashed line.
Figure 14B:
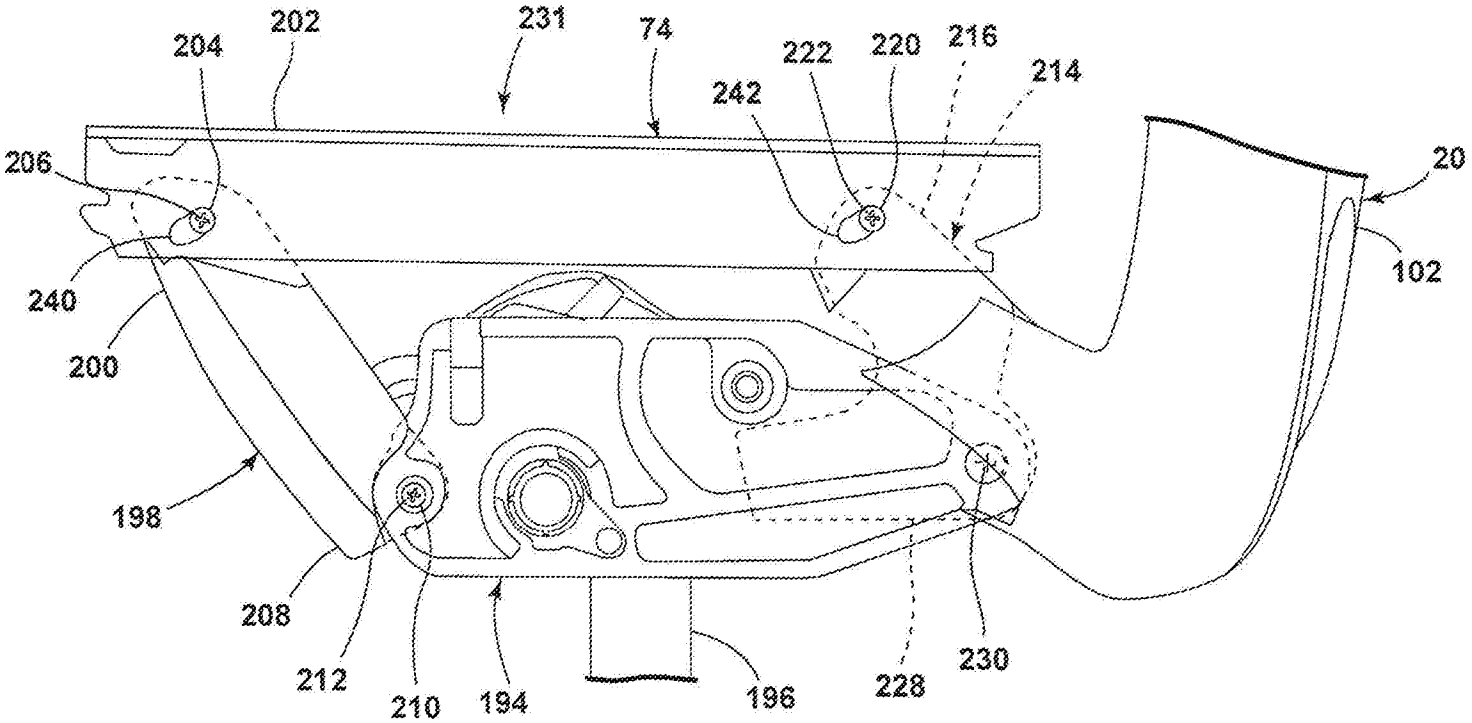
FIG. 14B is a side elevational view of the four-bar linkage arrangement of the seating assembly shown in a reclined position with interior components shown in dashed line.

The control assembly 16 (FIG. 14A) includes a housing member 194 operably coupled to a pedestal assembly 196 of the base assembly 12 (FIG. 1), the slide support rails 74, a forward link member 198 having a first end 200 pivotably coupled to a forward end 202 each of the slide support rails 74 by a shaft member 204 for movement about a pivot axis 206 and a second end 208 pivotably coupled to the housing member 194 by a shaft member 210 movement about a pivot axis 212, and a rearward link member 214 having a first end 216 pivotably coupled to a rearward end 218 of each of the slide support rails 74 by a shaft member 220 for movement about a pivot axis 222 and a second end 228 pivotably coupled to the housing member 194 by a shaft member 230 for movement about a pivot axis 232. The housing member 194, the slide support rails 74, the forward link member 198 and the rearward link member 230 cooperate to form a four-bar linkage assembly 231 that allows the back assembly 20 (FIGS. 2, 14A and 14B) to move between the upright position C and the reclined position D, and the seat assembly 18 to move between the upright position E and the reclined position F.

Each of the slide support rails 74 (FIG. 14*a*) are provided with a forwardly located elongated aperture 240 and a rearwardly located elongated aperture 242 configured to slidably receive the shaft member 204 and the shaft member 220 therein, respectively. In assembly, an end 244 of the shaft member 204 and an end 246 of the shaft member 220 are coupled to the forward link member 198 and the rearward link member 214 and slidably received within the elongated apertures 240, 242, respectively, such that each of the shaft members 204, 220 are adjustable along the length of the apertures 240, 242 in directions 248, respectively. Subsequent to pre-assembly of the shafts 204, 220 within the apertures 240, 242, the relative position of the components of the four-bar linkage assembly 231 may be adjusted relative to one another by sliding the ends 244, 246 of the shafts 204, 220 in the directions 248 to ensure proper alignment of the components relative to one another, to reduce "slop" within overall assembly due to stack-up tolerances, and/or to ensure proper orientation of the back assembly 20 and/or the seat assembly 18 when in the respective fully upright position thereof, and the like. The proper alignment may be determined by securing the four-bar linkage assembly 231 within a fixture, by pre-markings on one or more of the components of the four-bar linkage assembly 231, by adjusting the four-bar linkage assembly 231 until stop members within the system are reached, by visual alignment, or other methods suitable for assuring proper alignment. Subsequent to determining the proper alignment and positioning the four-bar linkage assembly 231 in a proper configuration, the ends 244, 246 of the shaft members 204, 220 are secured to the associated frame rail supports 74 via orbital riveting, welding, and the like.

Figure 15A:
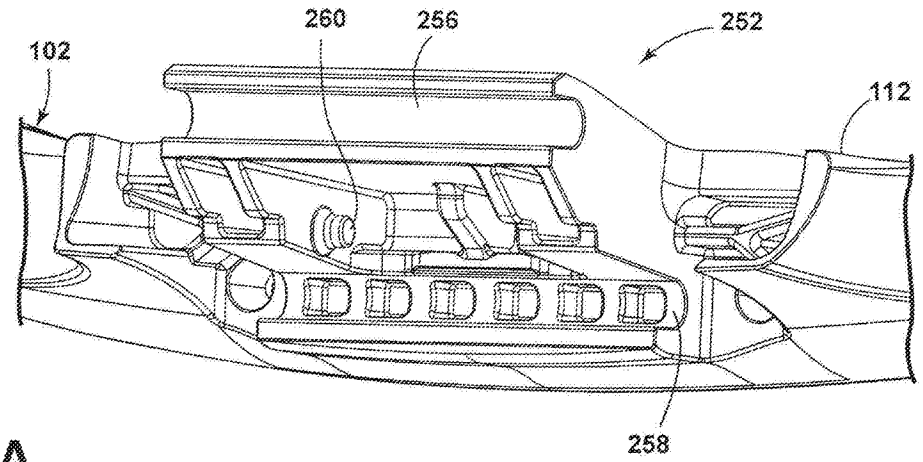
FIG. 15A is a perspective view of a quick connect arrangement taken of the area 15A, FIG. 9.
Figure 15B:
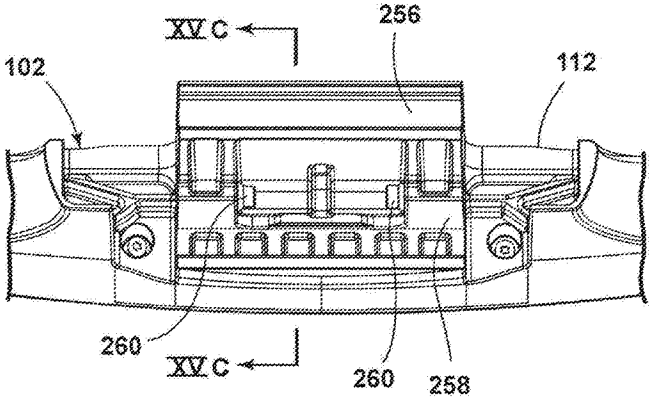
FIG. 15B is a front elevational view of the quick connection arrangement.
Figure 15C:
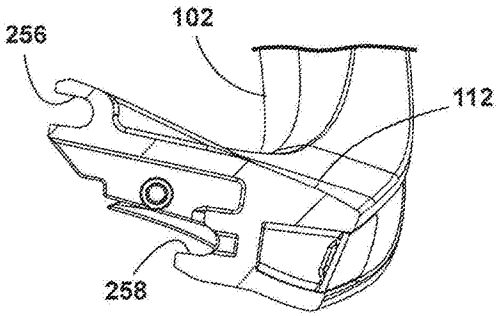
FIG. 15C is a side elevational cross-sectional view of the quick connect coupling arrangement taken along the line XVC-XVC, FIG. 15B.
Figure 16B:
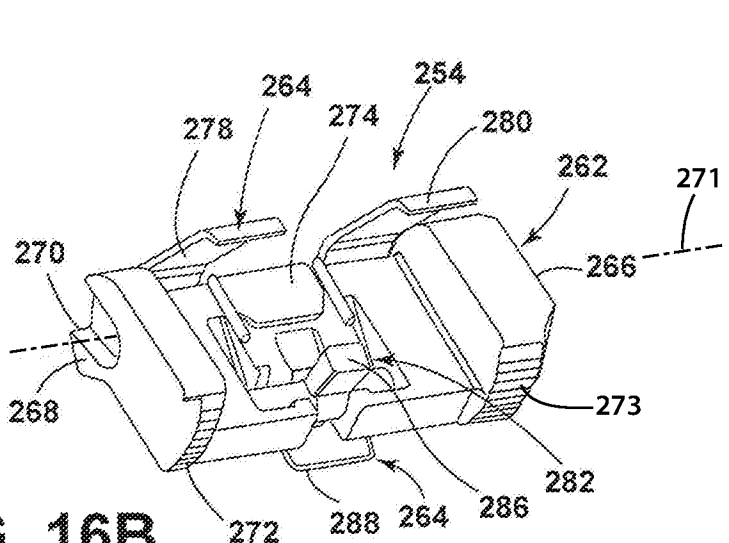
FIG. 16B is a rear perspective view of the locking arrangement.
Figure 16A:
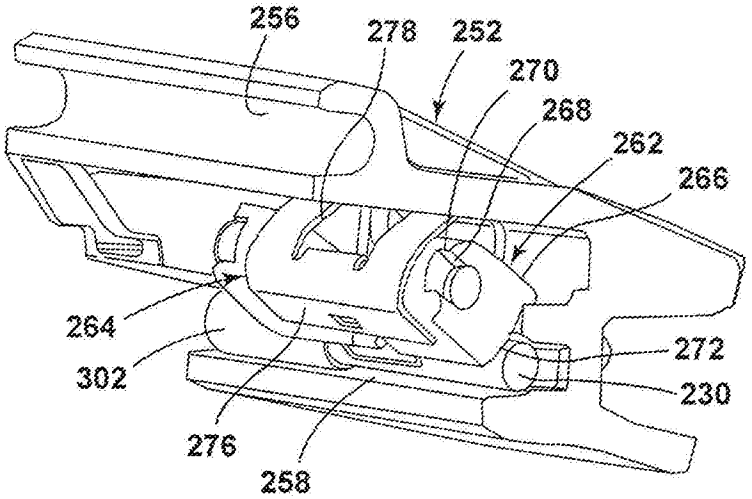
FIG. 16A is a front perspective view of a locking arrangement for the quick connect coupling arrangement.

The back assembly 20 is coupled to the control assembly 16 by a quick-connect arrangement 250 (FIG. 9), that includes a coupling portion 252 (FIGS. 15A-15C) integrally molded with the lower frame portion 112 of the back frame member 102, and a locking arrangement 254 (FIGS. 16A-16B). In the illustrated example, the coupling portion 252 extends forwardly from the lower frame portion 112 of the back frame member 102 and includes a laterally-extending, U-Shaped upper channel 256, a laterally-extending, U-shaped lower channel 258 offset below and rearwardly from the upper channel 256, and a pair of inwardly-extending pivot bosses 260. The locking arrangement 254 includes a primary locking arrangement 262 and a secondary locking arrangement 264. The primary locking arrangement 262 includes a locking portion 266 that includes a pair of outwardly and oppositely disposed recesses 268 each accessible via an end slot 270, and an abutment surface 272. The primary locking arrangement 262 further includes a leaf spring 264 having a clip portion 276 that clips to the primary locking portion 266, and a biasing portion 278, where the clip portion 276 and the biasing portion 278 each include a downwardly extending fingers 280 configured to engage the coupling portion 252 of the back frame member 162. The secondary locking arrangement 264 includes a secondary locking portion 282 that includes a release portion 284 and an abutment portion 286, and is pivotably coupled to the locking portion 266 of the primary locking arrangement 262. The secondary locking arrangement 264 further includes a spring member 288 that biases the release portion 284 and the abutment portion 286 as described below.

Figure 17:
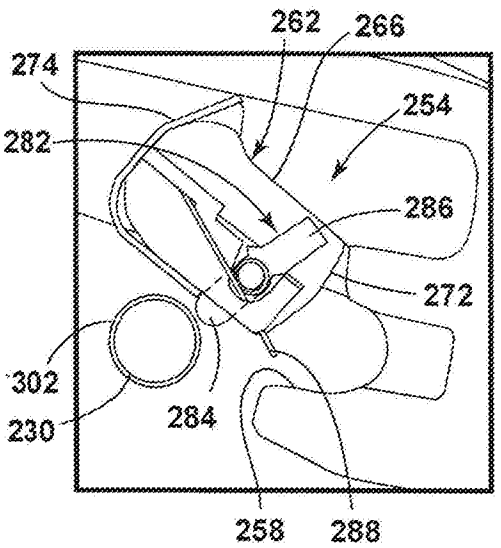
FIGS. 17-19 are cross-sectional side elevational views of the quick connect arrangement shown in various states of coupling the back assembly to a control assembly of the seating arrangement.
Figure 18:
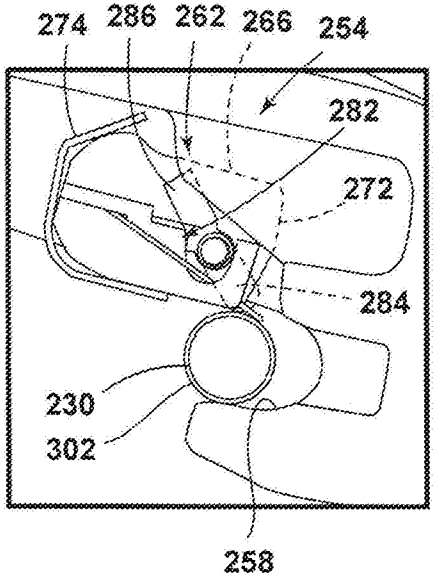
Figure 19:
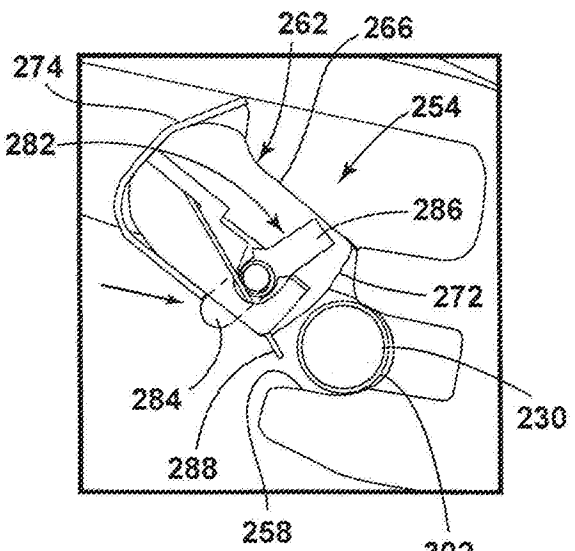

The back assembly 20 is assembled with the control assembly 16 by aligning the back assembly with the control assembly 16 such that the upper channel 256 of the coupling portion 252 is aligned with the shaft member 220 of the control assembly. The back assembly 20 is moved in a forward direction with respect to the control assembly until the shaft member 222 is at least partially received within the upper channel 256. The back assembly 20 is then moved forward in the forward direction and simultaneously rotated in a downward direction, thereby forcing the shaft member 230 into the lower channel 258 and the locking arrangement 254 moves to a locked position. As best illustrated in FIGS. 17-19, the shaft member 230 and/or one of a pair of bushing members 302 abut the release portion 284 of the secondary locking arrangement 264, thereby moving the release portion 284 and the abutment portion 286 from a locked position to an unlocked position and allowing the shaft member 232 pass into the lower channel 258. As the shaft member 230 passes into the recess 258, the locking portion 266 rotates downwardly until the abutment surface 272 of the locking portion 266 abuts the bushing members 302. Once the shaft member 230 is seated within the lower channel 258, the abutment portion 286 of the secondary locking portion 282 is biased by the spring member 288 from an unlocked position to the locked position where the abutment portion 286 abuts an interior wall of the channel 258. It is noted that the primary locking arrangement 262 cannot be moved from the locked position to the unlocked position unless abutment portion 286 of the secondary locking arrangement 264 is first moved from the locked position to the unlocked position thereof. The abutment portion 286 of the secondary locking portion 282 may be moved from the locked position to the unlocked position by exerting on the release portion 284 in a direction of 304, either by hand or with the assistance of a tool. Once the abutment portion 286 of the secondary locking portion 282 is moved from the locked position to the unlocked position thereof, the locking portion 266 of the primary locking arrangement 262 may be moved from the locked position to the unlocked position, thereby allowing removal of the back assembly 20 from the control assembly 16.

Figure 16C:
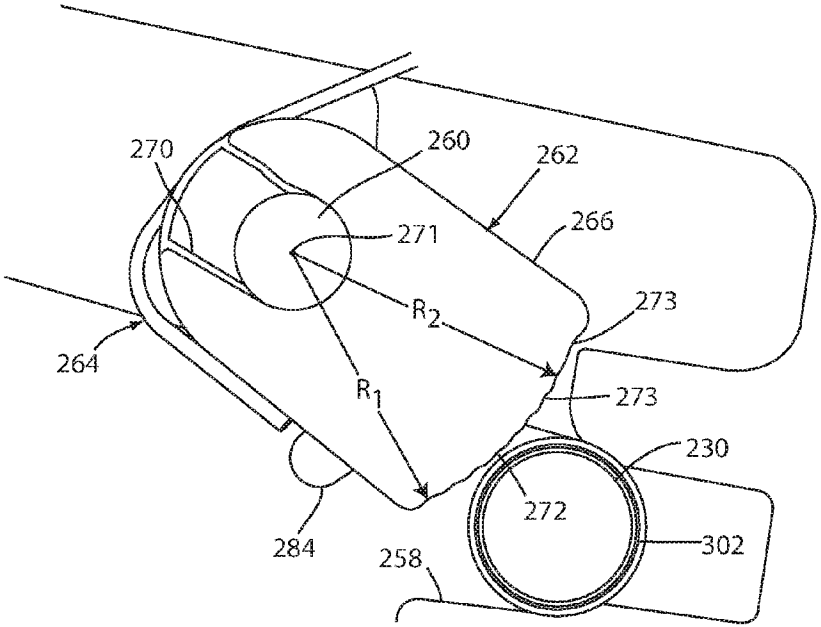
FIG. 16C is a side elevational view of the locking arrangement.
Figure 16D:
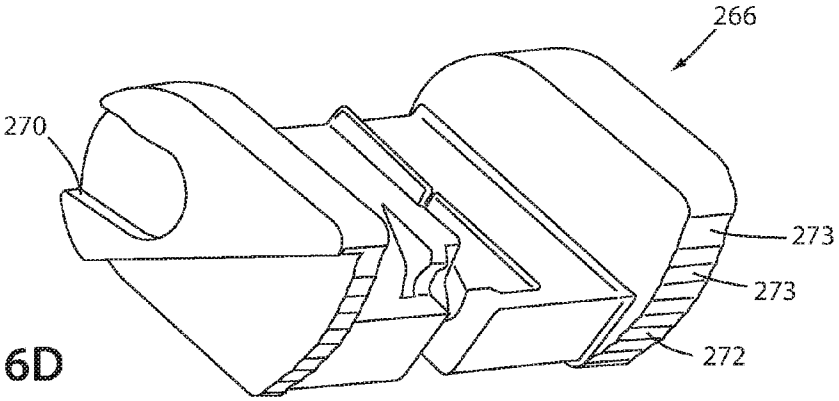
FIG. 16D is a perspective view of a primary locking portion of the locking arrangement.

In some instances, the distance between the pivot axis 271 and the bushing members 302 may change due to stack-up tolerances, and/or because or wear within the overall seating arrangement over time. Therefore, the abutment surface 272 may include a plurality of notches 273 (FIG. 16B) spaced along the length thereof. The distance from the pivot point 271 (FIGS. 16C and 16D) of the pivot bosses 260 to the trough of each of the notches 273 increases from the bottom of the primary locking portion 266 to the top thereof, i.e., $R_2$ is greater than $R_1$. As previously discussed, the primary locking portion 266 is rotated downwardly so as to abut the busing members 302, thereby preventing the shaft 260 from being removed from within the recess 258. The various distances $R_1$. $R_2$, etc. allow for this variation that may occur due to stack-up tolerance, wear of the components, and the like, by allowing the primary locking member 266 to continue to rotate downwardly and securely lock the shaft 230 and bushings 302 within the recess 258. As the distance increases, either due to stack-up tolerances and/or system settling/wear, the primary locking member 266 continues to optimize the locking abutment and take up any slack within the system.

Figure 20:
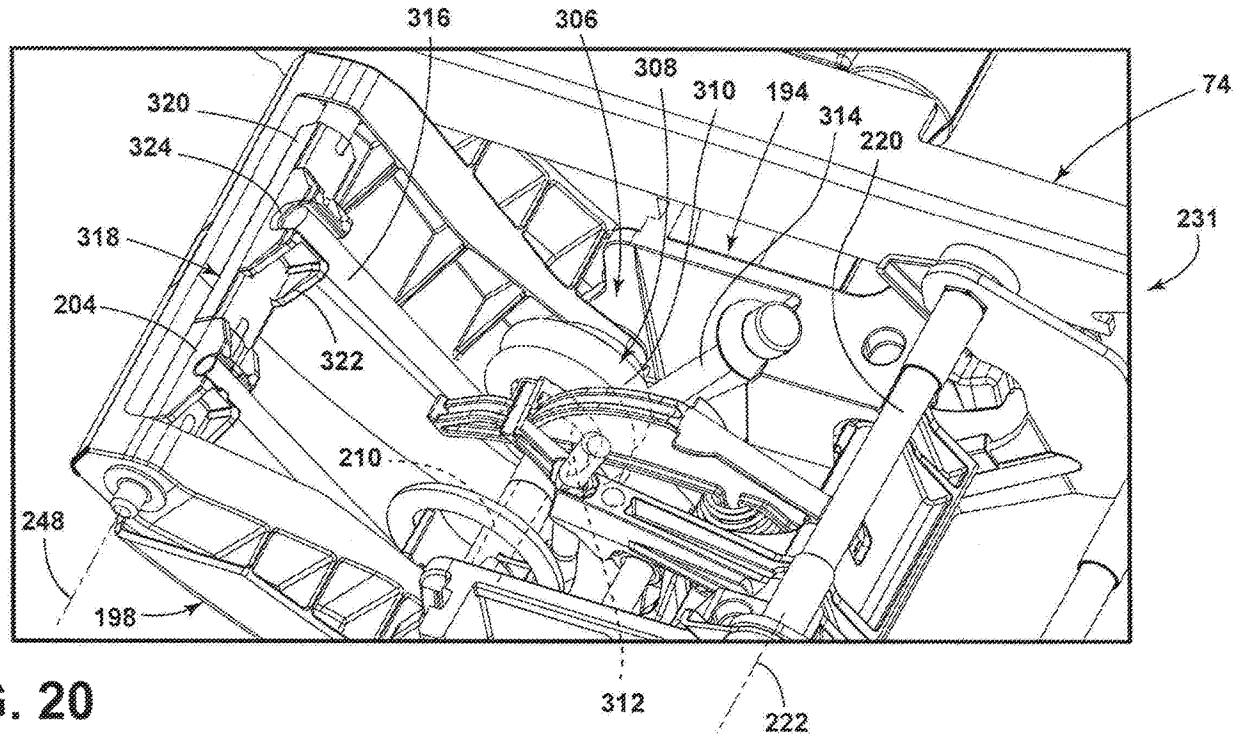
FIG. 20 is a top perspective view of a primary biasing arrangement.

Turning now to FIG. 20, a primary biasing arrangement 306 includes a coil spring 308 that is configured to bias the back assembly 20 from the reclined position D toward the upright position C. In the illustrated embodiment, the coil spring 308 includes a coiled body portion 310 coiled about a spacer 312 that is positioned about the axle member 210, a first end 314 biased against the housing member 194, and a second end 316 biased against the shaft member 204 via a spacer/bearing member. In the illustrated example, the spacer/bearing member 318 includes a body portion 320 extending at least partially about the shaft member 204, and a coupling portion 322 integrally formed with the body portion 320 and including a recess 324 within which the second end 316 of the coil spring 308 is received. The spacer/bearing member 318 is configured to hold the second end 316 of the spring 308 in place and functions as a bearing between the second end 316 of the spring 308 and the shaft member 204 as the back assembly is moved between the upright and reclined positions C, D.

Figure 21:
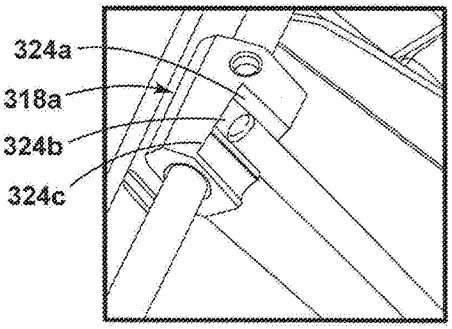
FIG. 21 is a top perspective view of an alternative configuration for the primary biasing arrangement.

In an alternative embodiment, the spacer/bearing member 318*a* (FIG. 21) is configured to so as to allow adjustment of the preset biased exerted by the coil spring onto the four-bar linkage arrangement 231. The spacer/bearing member 318*a* is similar to the spacer/bearing member 318, with the most notable exception being the inclusion of a plurality of recesses 324*a*, 324*b*, 324*c* in place of a single recess 324. It is noted that each of the recesses 324*a*, 324*b*, 324*b* very in depth with respect to one another such that the bottom of each of the recesses 324*a*, 324*b*, 324*c* is at a different distance from the axis 48 of the shaft member 244. The varying depth of each of the recesses 324*a*, 324*b*, 324*c* allows the amount of preset tension exerted on the back assembly 20 by the primary biasing arrangement 306 to be preset during manufacture of the chair, and combines the preset adjustment arrangement within a bearing member, thereby reducing the relative overall packaging volume. It is noted that the present arrangement prevents a casual user from adjusting or manipulating the back-biasing pretension within the system without significant disassembly of the overall seating arrangement 10.

Figure 22:
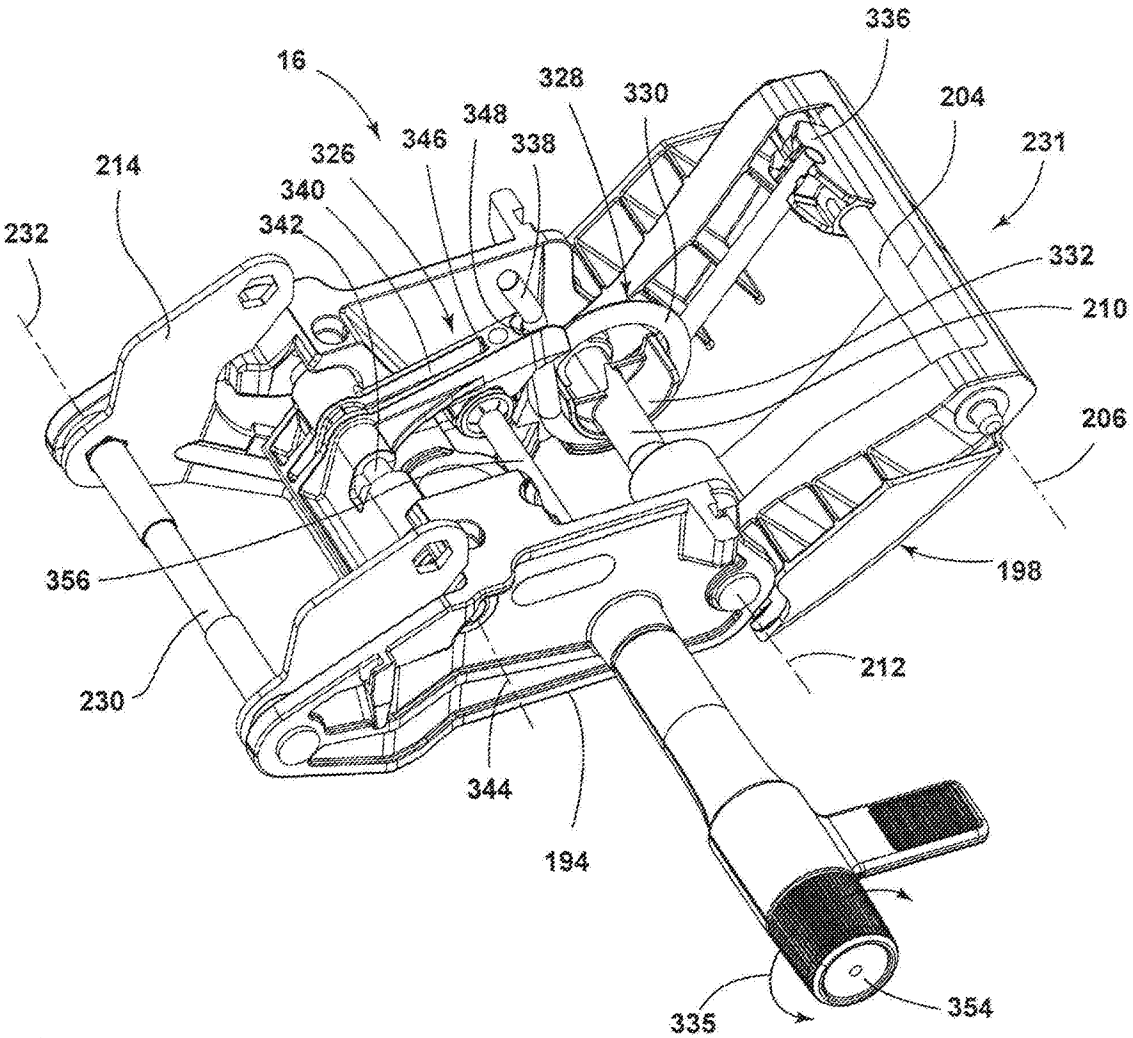
FIG. 22 is a top perspective view of an auxiliary biasing arrangement.

An auxiliary biasing arrangement 326 (FIG. 22) is configured to further bias the back assembly 20 from the reclined position D toward the upright position C, and is selectable between a neutral or non-boost position (FIG. 23A), a boost or biasing position (FIG. 23B) where the auxiliary biasing arrangement 326 provides an additional biasing force to the back assembly 20 from the reclined position D toward the upright position C, and a locked position (FIG. 23C) where the back assembly 20 is prevented from moving from the upright position C toward the reclined position D. The auxiliary biasing arrangement 326 includes a coil spring 328 includes a body portion 330 coiled about a positioning spacer 332 that is positioned about the axle member 210, a first end 334 biased against the axle member 204 via a spacer/bearing member 336 that is similar in configuration to the spacer/bearing member 318 as previously described, and a second end 338 extending oppositely from the first end 334. The auxiliary biasing arrangement 326 further includes an actuator arm 340 pivotably coupled along a length thereof to a pivot shaft 342 that is fixedly secured to the housing member 194, such that the actuator arm 340 pivots about a pivot axis 344. The actuator arm 340 further includes a first end 346 that includes a forwardly-opening channel 348 that receives the second end 338 of the spring 328, and a second end 350 that includes a stop surface 352.

Figure 23A:
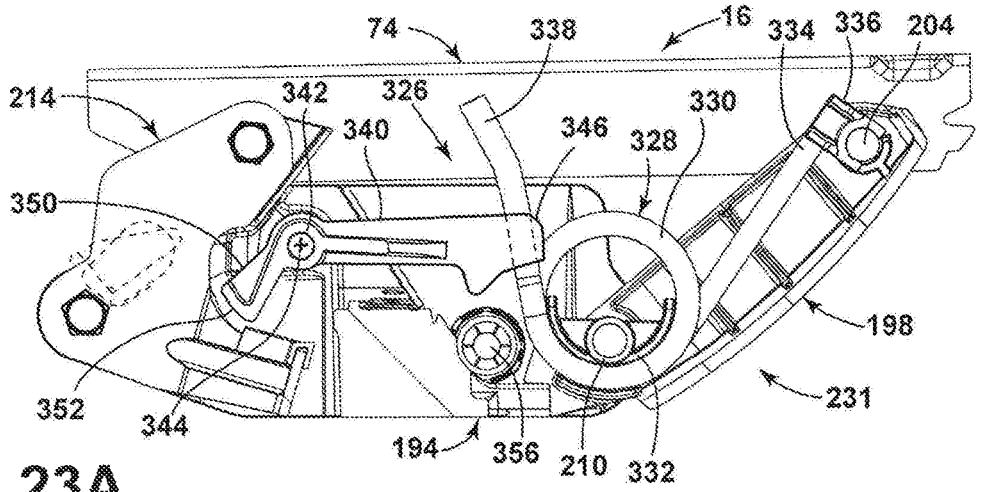
FIG. 23A is a cross-sectional side elevational view of the auxiliary biasing arrangement of FIG. 22 shown in a neutral position.
Figure 23B:
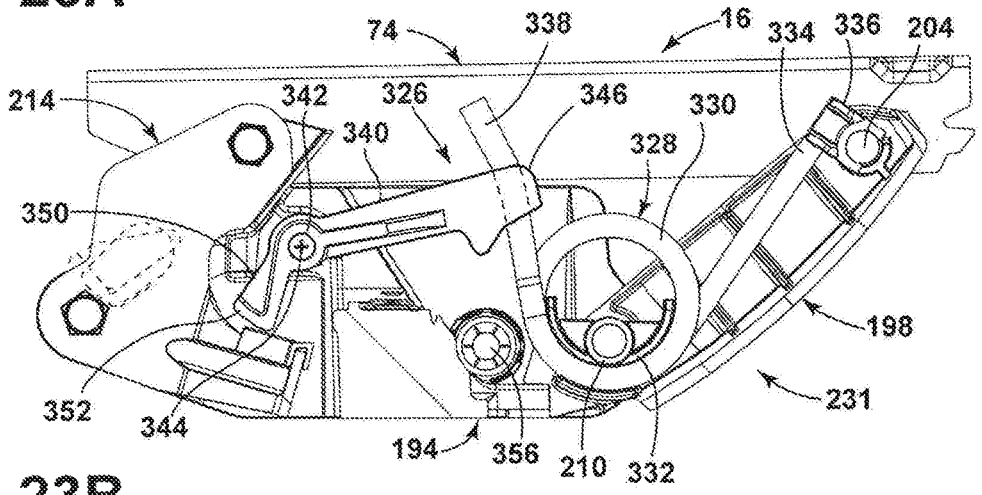
FIG. 23B is a cross-sectional side elevational view of the auxiliary biasing arrangement of FIG. 22 shown in a biasing position.
Figure 23C:
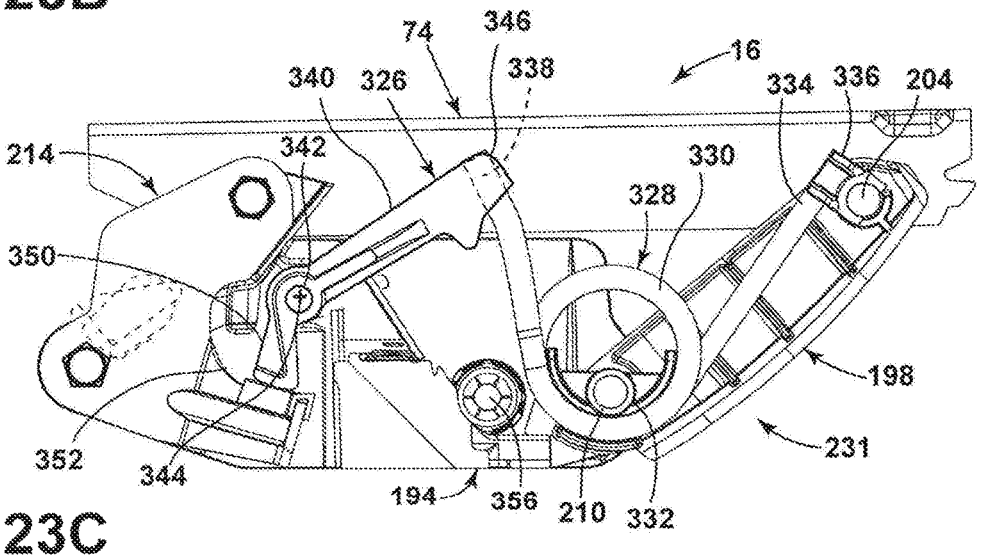
FIG. 23C is a cross-sectional side elevational view of the auxiliary biasing arrangement for FIG. 22 shown in a locked position.
Figure 24:
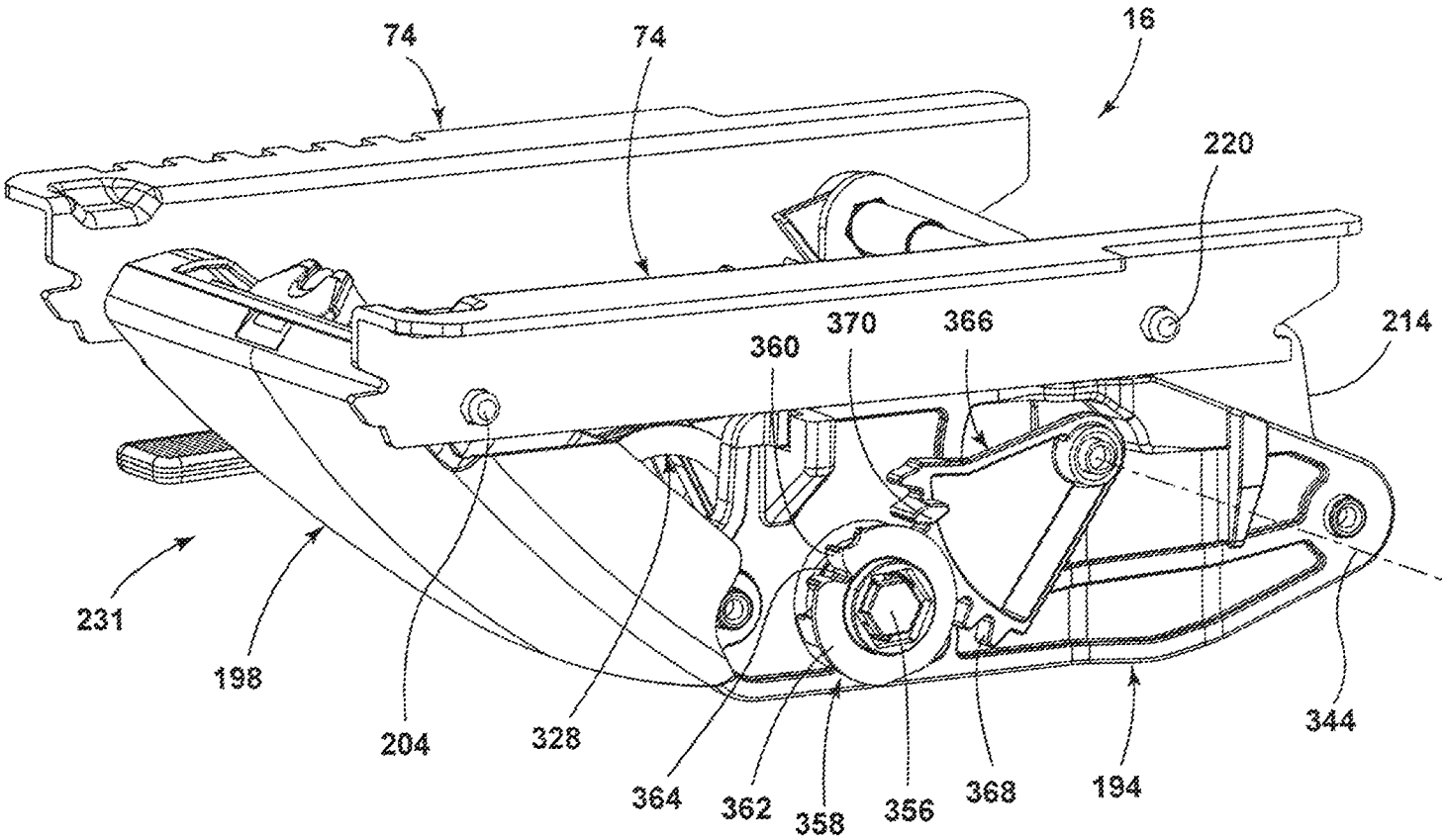
FIG. 24 is a perspective view of the control arrangement of FIG. 22 showing a drive gear and a driven gear thereof.

In operation, a control input knob 354 may be grasped and turned by a user to move the auxiliary biasing arrangement 326 between the neutral, biasing and locked positions. The input knob 354 is pivotably fixed to an end of an input shaft 356 that extends laterally across and is rotatably coupled to the housing member 194. A driving gear 358 (FIG. 24) is fixedly secured to an opposite end of the input shaft 356 from the input knob 354 and receives the input force exerted on the input knob 354 from the operator. The input gear 358 includes a plurality of teeth 360 spaced about an outer periphery thereof, an outer wall 362 extending about the periphery of the gear 358, and a recess 364 extending into the outer wall 362. An output gear 366 is fixed for rotation with an end of the member 300 pivot shaft 342, and includes a plurality of teeth 368 spaced about an edge thereof. The output gear 366 further includes an alignment tooth 370 interspaced with the teeth 368 and that extends laterally outward from an outer face of the output gear 366. In the illustrated example, the alignment to 370 is configured to be received within the relief 364 of the input gear 358, thereby ensuring proper alignment of the input gear 366 with the output gear 358. When in the neutral position as illustrated in FIG. 23A, the actuator arm 340 is positioned so that the actuator arm 340 does not engage the second end 338 of the spring 328, such that the spring 328 does not exert a biasing force on the four-bar linkage assembly 231 to bias the back assembly 20 from the reclined position D toward the upright position C. In order to provide an auxiliary biasing force to the back assembly 20 from the auxiliary biasing arrangement 326, the actuator arm 340 is moved to the auxiliary boost position as illustrated in FIG. 23B, such that the actuator arm 340 abuts the second end 338 of the spring 328 as the back assembly is moved from the upright position C toward the reclined position D, and the spring member exerts a force on the four-bar linkage assembly 231 thereby biasing the back assembly 20 from the reclined position D toward the upright position C. The actuator arm 340 may further be moved into a locking position as illustrated in FIG. 23C, such that the stop surface 352 of the second end 350 of the actuator arm 340 abuts a stop member 372 fixedly attached to the second link member 214, thereby preventing the back assembly 20 from moving from the upright position C toward the reclined position D.

Figure 25:
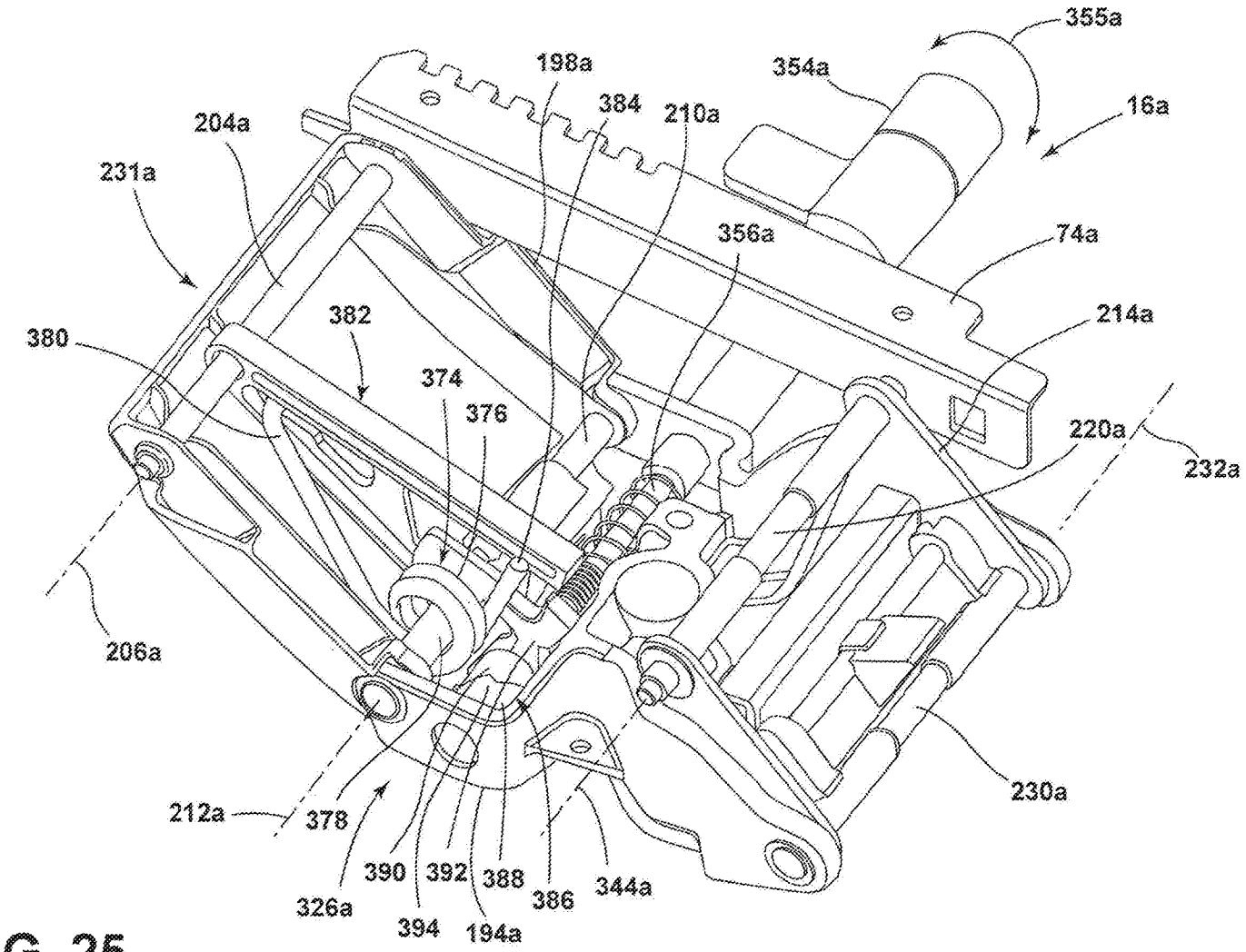
FIG. 25 is a top perspective view of an alternative embodiment of an auxiliary biasing arrangement.
Figure 26:
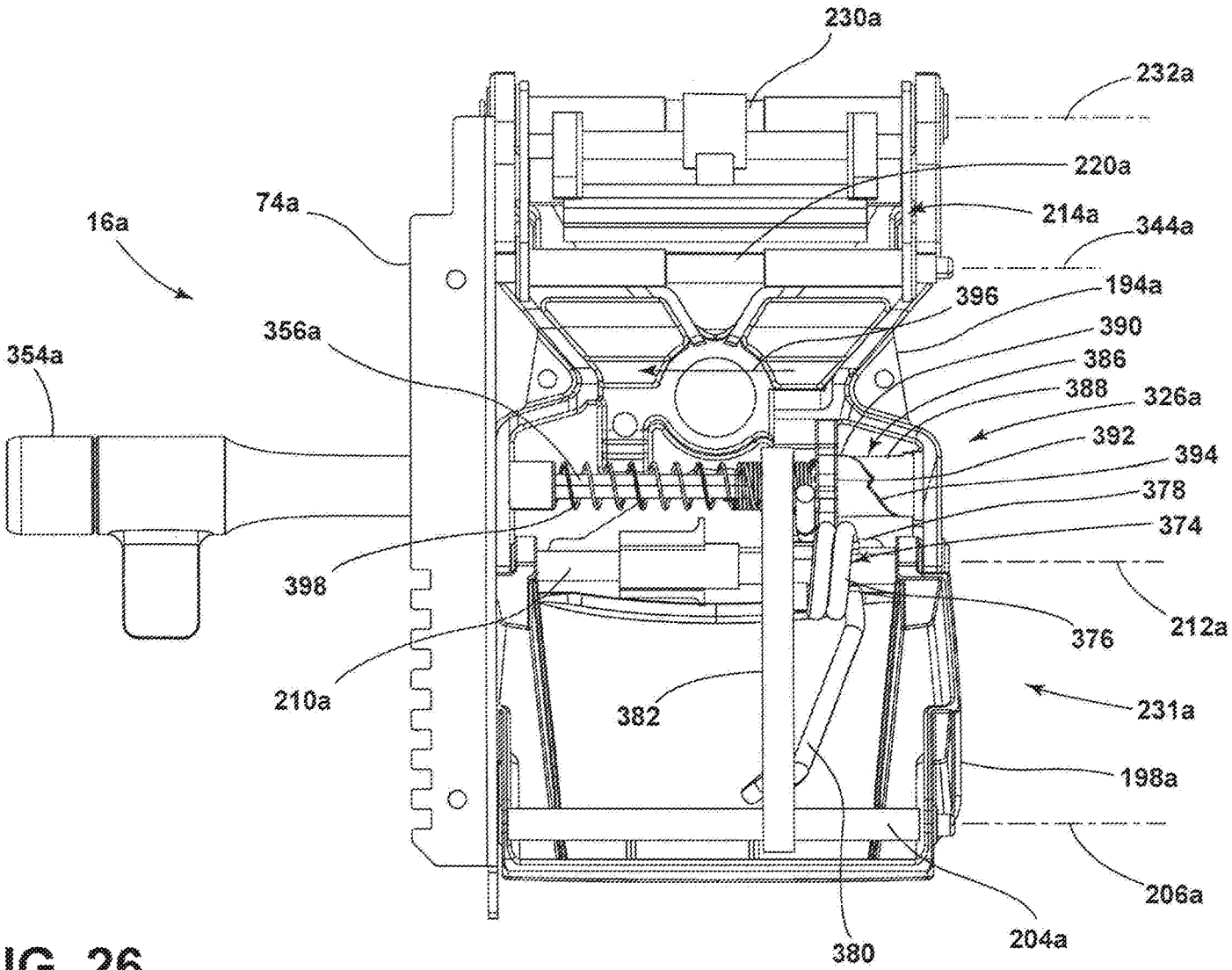
FIG. 26 is a top plan view of the auxiliary biasing arrangement of FIG. 25.

The reference 326*a* (FIGS. 25 and 26) generally designates another embodiment of the auxiliary biasing arrangement within a control assembly 16*a*. Since the auxiliary biasing arrangement 326*a* and the associated control assembly 16*a* are similar to the previously described auxiliary biasing arrangement 326 and control assembly 16, similar parts appearing in FIGS. 22-24 and FIGS. 25 and 26 respectively are represented by the same, corresponding reference numeral, except for the suffix "a" in the numerals of the latter. In the illustrated example, the auxiliary biasing arrangement 326*a* includes a coil spring 374 having body portion 376 coiled about a spacer member 378 that is positioned about the shaft member 210*a*, a first end 380 that engages a structural reinforcement member 382 having a first end pivotably coupled to the shaft member 210*a* and a second end pivotably coupled to the shaft member 204*a* so as to pivot with and structurally reinforce the forward link member 198*a*, and a second end 384. The auxiliary biasing arrangement 326*a* further includes an actuator arrangement 386 that includes a first cam member 388, a second cam member 390 and an actuator arm 392 that is fixed to the second cam member 390. Similar to as described above with respect to the auxiliary biasing arrangement 326, the auxiliary biasing arrangement 326*a* is adjustable between a neutral position, a biasing position and a locked position. An operator may adjust the auxiliary biasing arrangement 326*a* between the various positions by grasping and turning the input knob 354*a* in the directions 355*a*. The first cam member 388 is fixed for rotation with the housing member 194*a* while the second cam member 390 is fixed for rotation with the input shaft 356*a*, such that rotation of the input knob 354*a* and the input shaft 356*a* drives the cam surfaces 394 of the first cam member 388 and the second cam member 390 against one another driving of the second cam member 390 and the actuator arm 392 in a direction 396 against the bias of a biasing spring 398 that extends about and along the length of the input shaft 356*a*. In the present embodiment, the cam surfaces 394 of the first cam member 388 and the second cam member 390 are graduated so as to allow selective positioning of the first cam member 388 and second cam member 390 with respect to one another. In a first position as illustrated in FIG. 26, the actuator arm 392 is not aligned with the second end 384 of the spring 374 such that the second end 384 of the spring 374 is free to rotate as the back assembly 20 is moved from the upright position C to the reclined position D without the spring 374 exerting a biasing force on the back assembly 20. As the actuator arm 392 is laterally moved from the first position or neutral position to the second position or biasing position the actuator arm 392 aligns with the second end 384 of the spring 374, such that when the back assembly 20 is moved from the upright position C toward the reclined position D the actuator arm 392 abuts the second end 384 of the spring 374 and the housing member 194*a*, and such that the spring 374 is deflected and a biasing force is exerted on the four-bar linkage assembly 231*a*, thereby biasing the back assembly 20 from the reclined position D toward the upright position C. As the actuator arm 392 is laterally moved from the second position or biasing position to the third position or locking position the actuator arm 392 aligns with the structural reinforcement arm 382 and the housing member 194*a*, such that when a user attempts to move the back assembly 20 from the upright position C toward the reclined position D the actuator arm 392 abuts the structural reinforcement arm 382 and the housing member 194*a*, thereby preventing movement of the back assembly 20 from the upright position C toward the reclined position D and effectively locking the back assembly 20 in the upright position C.

Figure 27:
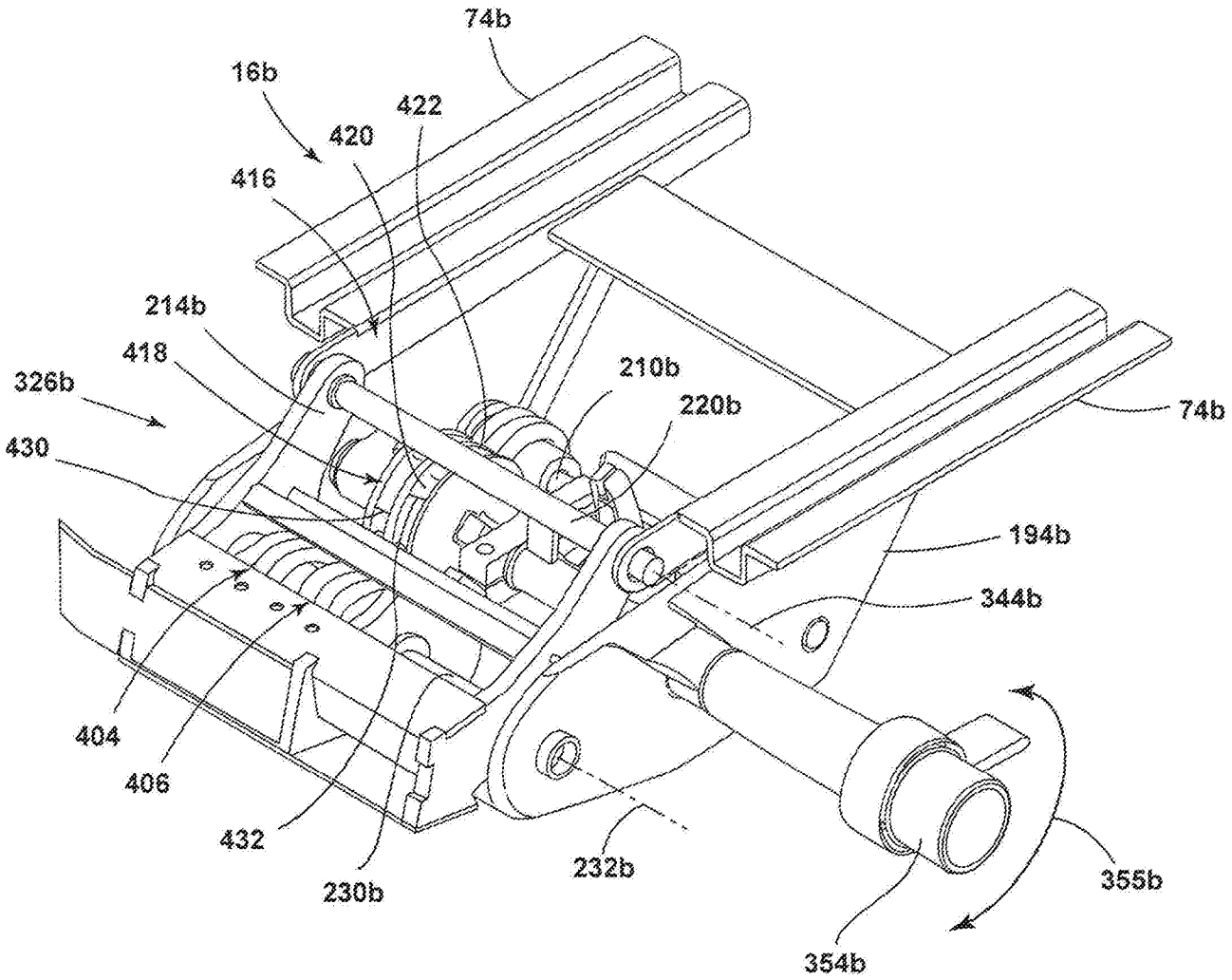
FIG. 27 is a perspective view of another alternative embodiment of the auxiliary biasing arrangement.

The reference 326*b* (FIGS. 27-29) generally designates another embodiment of the auxiliary biasing arrangement within a control assembly 16*b*. Since the auxiliary biasing arrangement 326*b* and the associated control assembly 16*b* are similar to the previously described auxiliary biasing arrangement 326*a* and the control assembly 16*a*, similar parts appearing in FIGS. 25 and 26, and FIGS. 27-29 respectively are represented by the same, corresponding reference numeral, except for the suffix "b" in the numerals of the latter. In the illustrated example, the control assembly 16*b* includes a housing member 194*b*, a pair of slide support rails 74*b*, and a rearward linkage member 214*b* having a first end 216*b* pivotably coupled to a rearward end 218*b* of the slide support rails 74*b* and a second end 228*b* pivotably coupled to the housing member 194*b* by a shaft member 230*b*. The forward ends 202*b* of the slide support rails 74*b* float with respect to the housing member 194*b*. A primary biasing arrangement 306*b* includes a coil spring 308*b*, having a first end biased against the housing member 194*b* and a second end 316*b* biased against the slide support rails 74*b* at a location 400, thereby biasing the slide support rails 74*b* in a direction 402 with respect to the housing member 194*b*.

Figure 28:
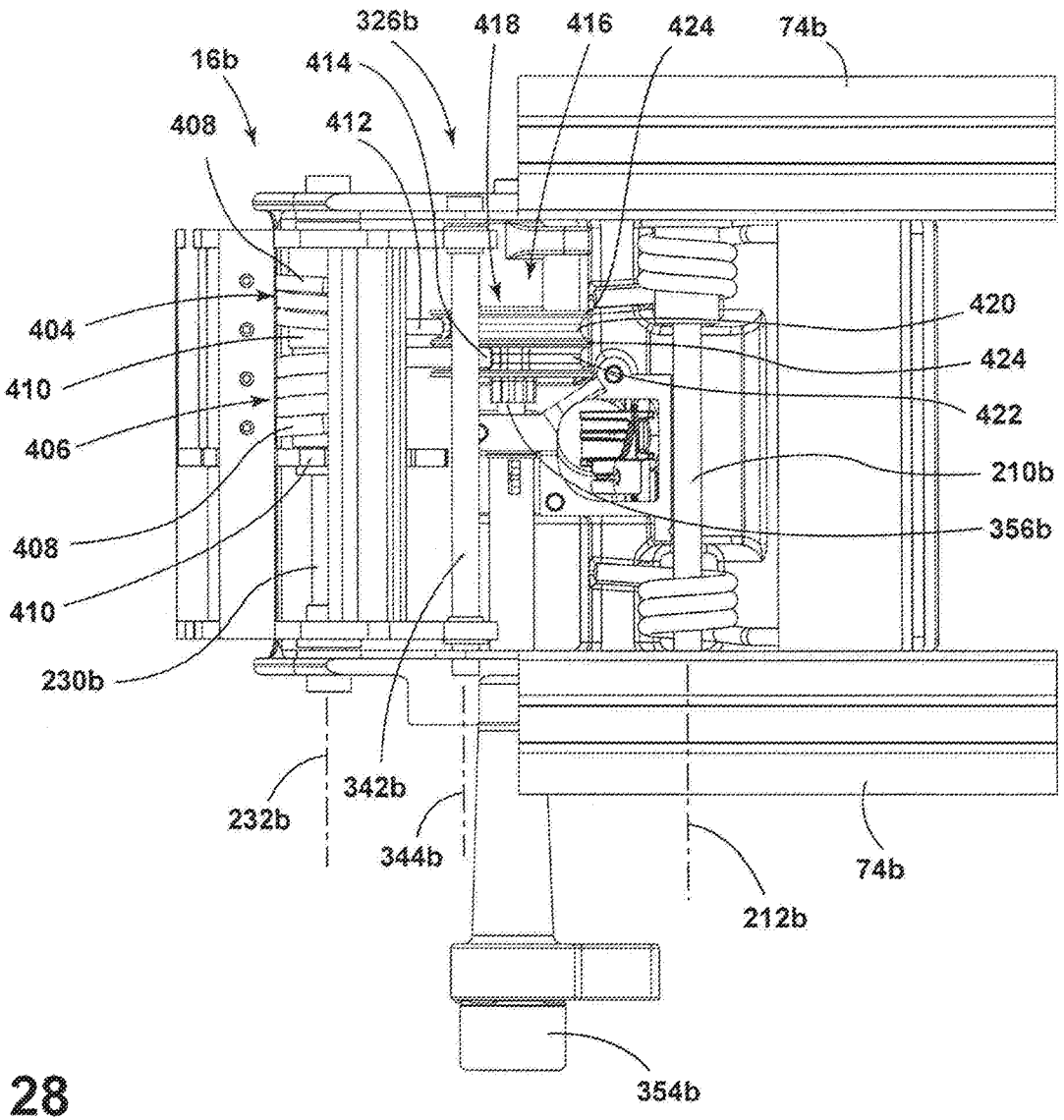
FIG. 28 is a top plan view of the auxiliary biasing arrangement of FIG. 27.
Figure 29:
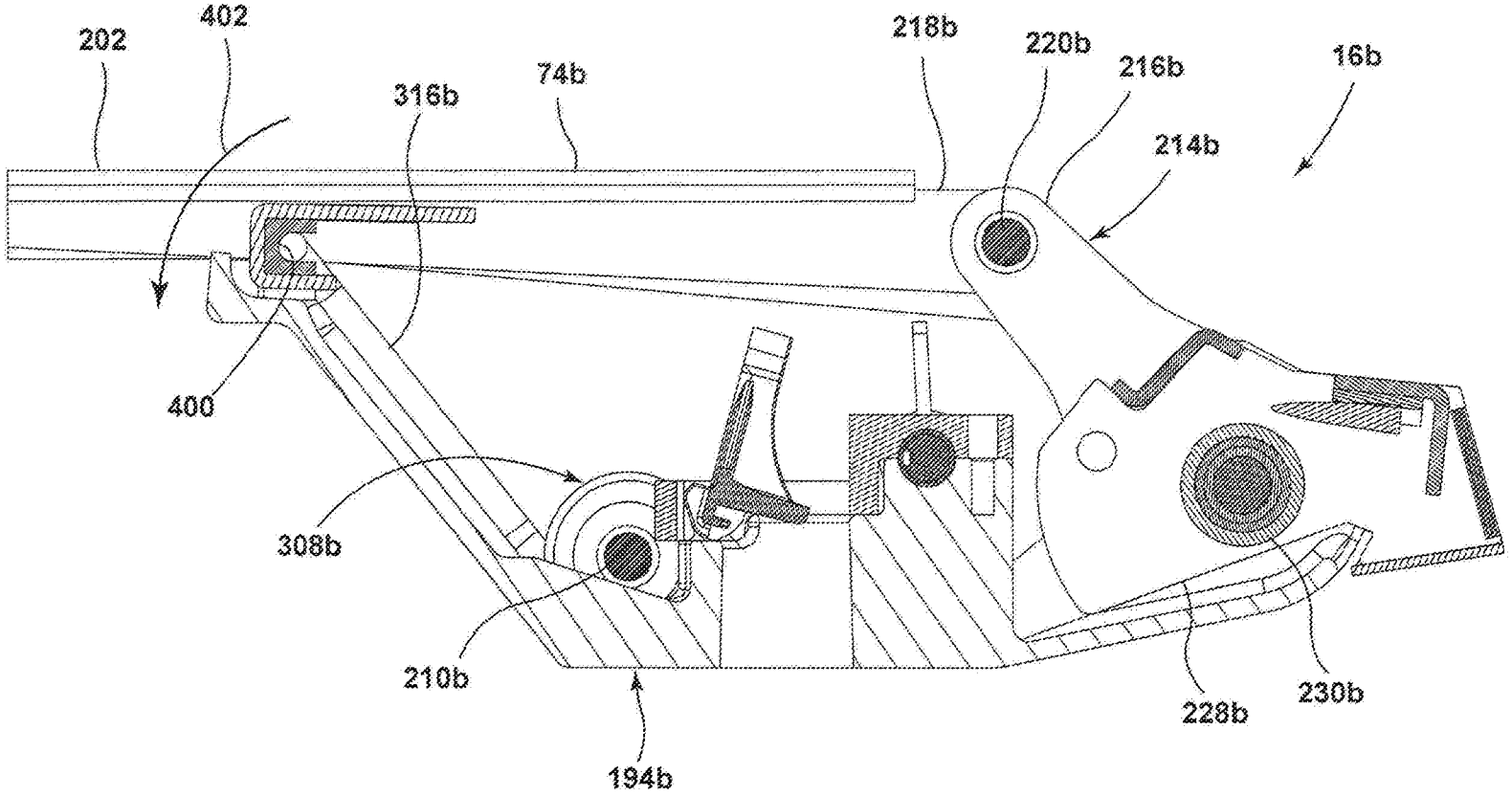
FIG. 29 is a cross-sectional side elevational view of a control assembly associated with the auxiliary biasing arrangement of FIG. 27.

The auxiliary biasing arrangement 326*b* includes a pair of coil springs including a first coil spring 404 and a second coil spring 406. The first coil spring 404 and the second coil spring 406 each include a body portion 408 coiled about a spacer 410 positioned about the shaft member 230*b*, and a first end (not shown) operably coupled to the back assembly 20 or a linkage member operably supporting the same. The first coil spring 404 includes a second end 412 while the second spring 406 includes a second end 414. The auxiliary biasing arrangement 326*b* further includes an actuator arrangement 416 that includes a cam wheel 418 having a first radially extending track 420 and a second radially extending track 422 each defined by a plurality of radially extending guide walls 424 between which the ends 412, 414 of the springs 404, 406 guide as described below. The first track 420 includes a laterally extending first cam wall 430 while the second track 422 includes a laterally extending second cam wall 432 radially spaced from the first cam wall 430. As best illustrated in FIG. 28, second end 412 of the first spring 404 tracks within the first track, while the second end 414 of the second spring 206 tracks within the second track 422. In operation, an operator may adjust the auxiliary bias exerted on the back assembly 20 for biasing the back assembly 20 from the reclined position D toward the upright position C by grasping and rotating the input knob 354*b* in the directions 355*b*. The cam wheel 418 is fixed for rotation with the input knob 354*b* via the input shaft 356*b*. Rotation of the cam wheel 418 causes the first cam wall 430 and the second cam wall 432 to contact the ends 412, 414 of the first and second springs 404, 406, causing the springs 404, 406 to deflect increasing the bias force exerted on the back assembly 20 at selected positions of recline of the back assembly 20. It is noted that the radially offset locations of the first cam wall 430 and the second cam wall 432 with respect to one another causes the first cam wall 430 to engage the second end 412 of the first spring 404 prior to engagement of the second end 414 of the second spring 406 by the second cam wall 432 such that the auxiliary force exerted on the back assembly 20 increases as the angle of recline is increased. The present embodiment allows an operator to determine at which point during the recline of the back assembly 20 from the upright position C to the reclined position D the auxiliary biasing force exerted by the auxiliary biasing arrangement 426*b* is exerted on the back assembly 20.

Figure 30:
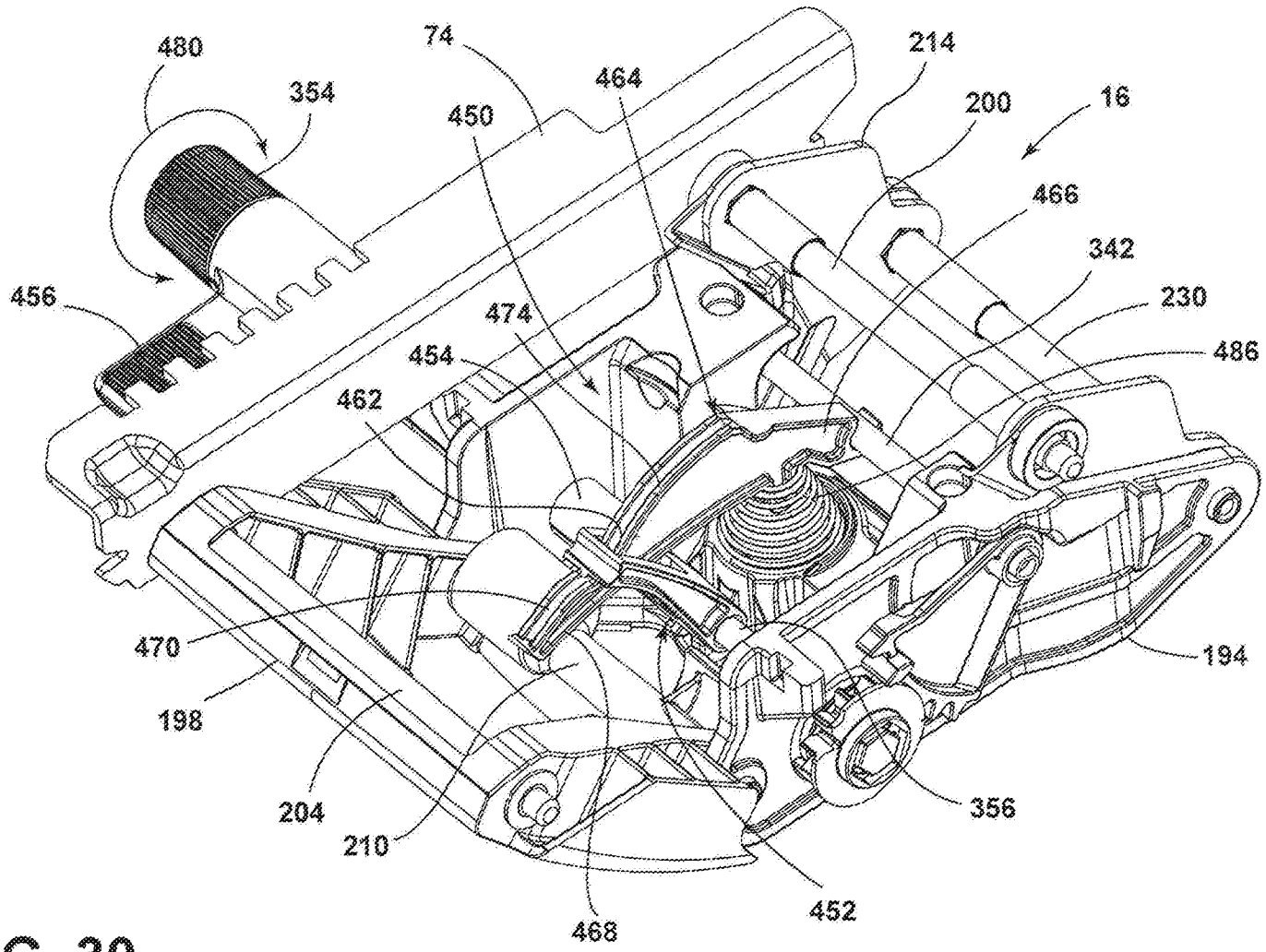
FIG. 30 is a top perspective view of a vertical height control adjustment arrangement.
Figure 31:
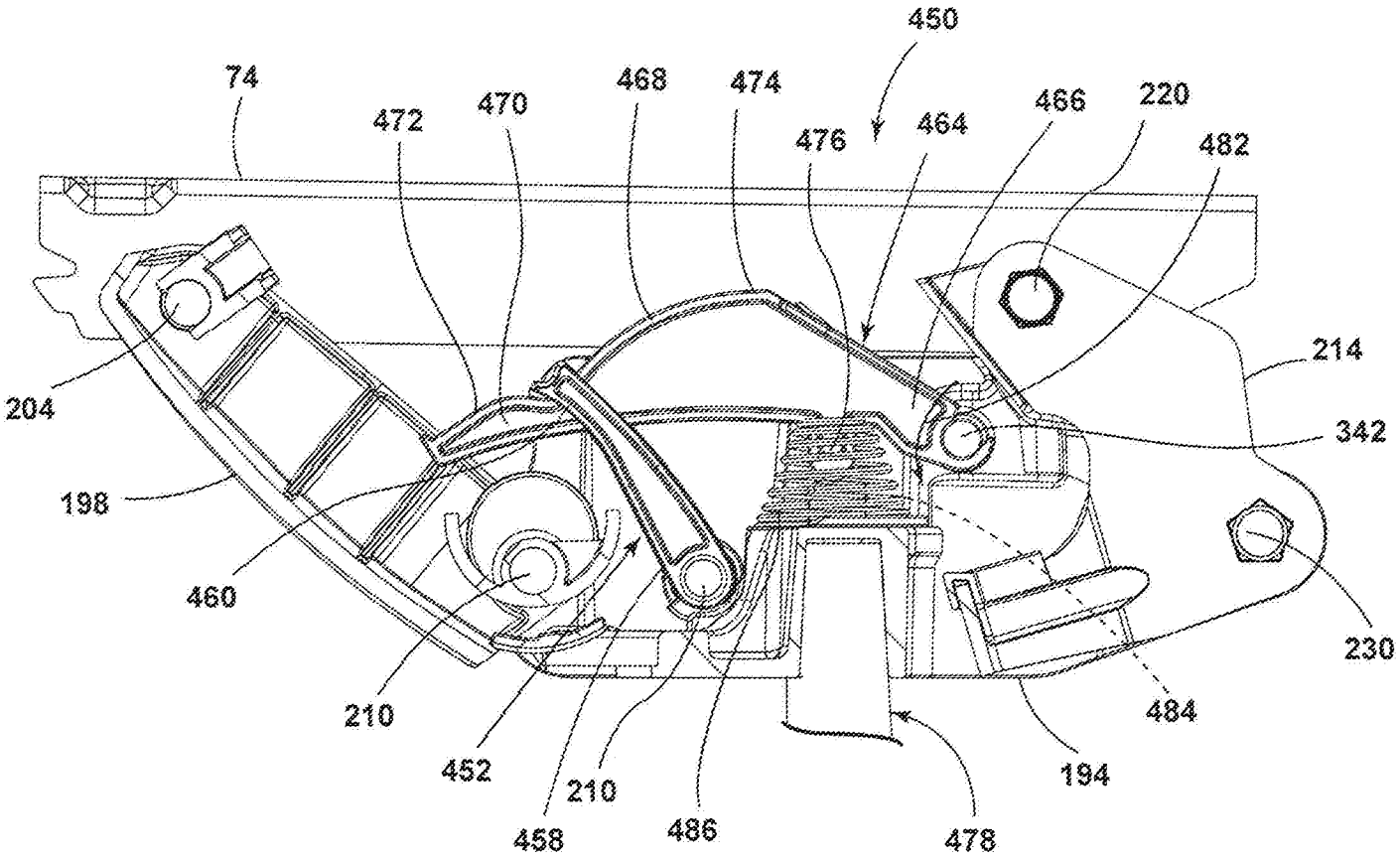
FIG. 31 is a cross-sectional side elevational view of the adjustment arrangement as shown in FIG. 30.

The control assembly 16 (FIGS. 30 and 31) further includes a pneumatic height control adjustment assembly 450 configured to allow the user to adjust the overall height of the seating arrangement 10 between the lowered position G and the raised position H. In the illustrated embodiment, the height control adjustment assembly 450 includes a first link 452 fixed for rotation with a shaft 454 that pivots about the shaft member 210 and is fixed for rotation with an input lever 456. The first arm 452 includes a first end 458 fixedly coupled with the shaft 454, and a U-shaped second end 460 having a downwardly disposed first surface 462. The height control actuator assembly 450 further includes a second link 464 pivotably coupled to the pivot shaft 342 at a first end 466, and an upwardly disposed second surface 468 that extends along a length of a second end 470 of the second link 464. In the illustrated example, the second surface 468 includes an upwardly disposed, convex first arcuate surface 472 positioned proximate a distal end of the second end 470, and an upwardly disposed, convex second arcuate surface 474 positioned between the first arcuate surface 472 and the first end 466 of the second link 464. The second link 464 further includes an actuator tab 476 positioned along the length thereof.

In operation, an operator may adjust the overall height of the seating arrangement 10 between the fully lowered and raised positions G, H, by activating a pneumatic cylinder arrangement 478 via the height control adjustment assembly 450. To affect actuation, the operator grasps the input lever 456 and turns the actuator lever 456 in either of the directions 450, thereby pivoting the actuator lever 456, the shaft 454, and the first link 452. As the first link 452 rotates, the first surface 462 of the first link 452 guides along one of the first arcuate surface 472 or the second arcuate surface 474 depending upon the direction of rotation of the input lever 456. Tracking of the first surface 462 of the first link 452 along either of the arcuate surfaces 472, 474 causes the second link 464 to pivot about the pivot shaft 342 in a direction of 482, thereby causing the actuator tab 476 of the second link 464 to depress an actuator button 484 of the pneumatic cylinder arrangement 478, thereby actuating the cylinder arrangement 478 and allowing the operator to adjust the height of the seating arrangement 10 from a lower position to a higher position by removing a downward force exerted on the seating arrangement 10 thereby allowing the pneumatic cylinder arrangement 478 to raise the height of the seating arrangement 10, or by exerting a downward force on to the seating arrangement 10 thereby overcoming the force exerted on the seating arrangement 10 by the pneumatic cylinder arrangement 478 and lowering the overall height of the seating arrangement 10. Once the desired height of the chair arrangement 10 has been reached, the operator releases the input lever 456, thereby allowing a coil spring 486 to bias the actuator tab 476 away from the button 484 by rotating the second link 464 in a direction opposite to the direction 482. In the illustrated example, the conical coil spring 486 is located proximate an end of the pneumatic cylinder arrangement 478 and is aligned therewith. It is noted that the first arcuate surface 472 and the second arcuate surface 474 are shaped such that the input force required to be exerted on the input lever 456 by the operator to actuate the pneumatic cylinder arrangement 478 are substantially the same regardless of the direction of rotation of the input lever 456.

Each arm assembly 22 (FIGS. 1 and 32) includes a column member 490, a control assembly 492 received within the column member 490, and an arm support assembly 494 supported on an end of the column member 490. Each column 490 includes a first portion 496 telescopingly received within a bushing member 497 positioned within a receiver portion 498 of the back frame member 102, such that the arm assembly 22 is generally vertically adjustable between a raised position and a lowered position with respect to the back frame member. The column member 490 further includes a second portion 500 that extends forwardly from the first portion 496 such that the second portion forms an angle of at least 45° with the first portion, and preferably an angle of at least 75° with the first portion, at a corner 501 located therebetween. The arm support 494 is operably coupled to the second portion 500 of the column member 490 such that the arm support 494 (FIG. 33) is laterally adjustable between an inboard position I and an outboard position J, longitudinally adjustable between an aft position K and a fore position L, and rotatably adjustable between a forwardly facing position M, an outwardly rotated position and an inwardly rotated position O.

Figure 32:
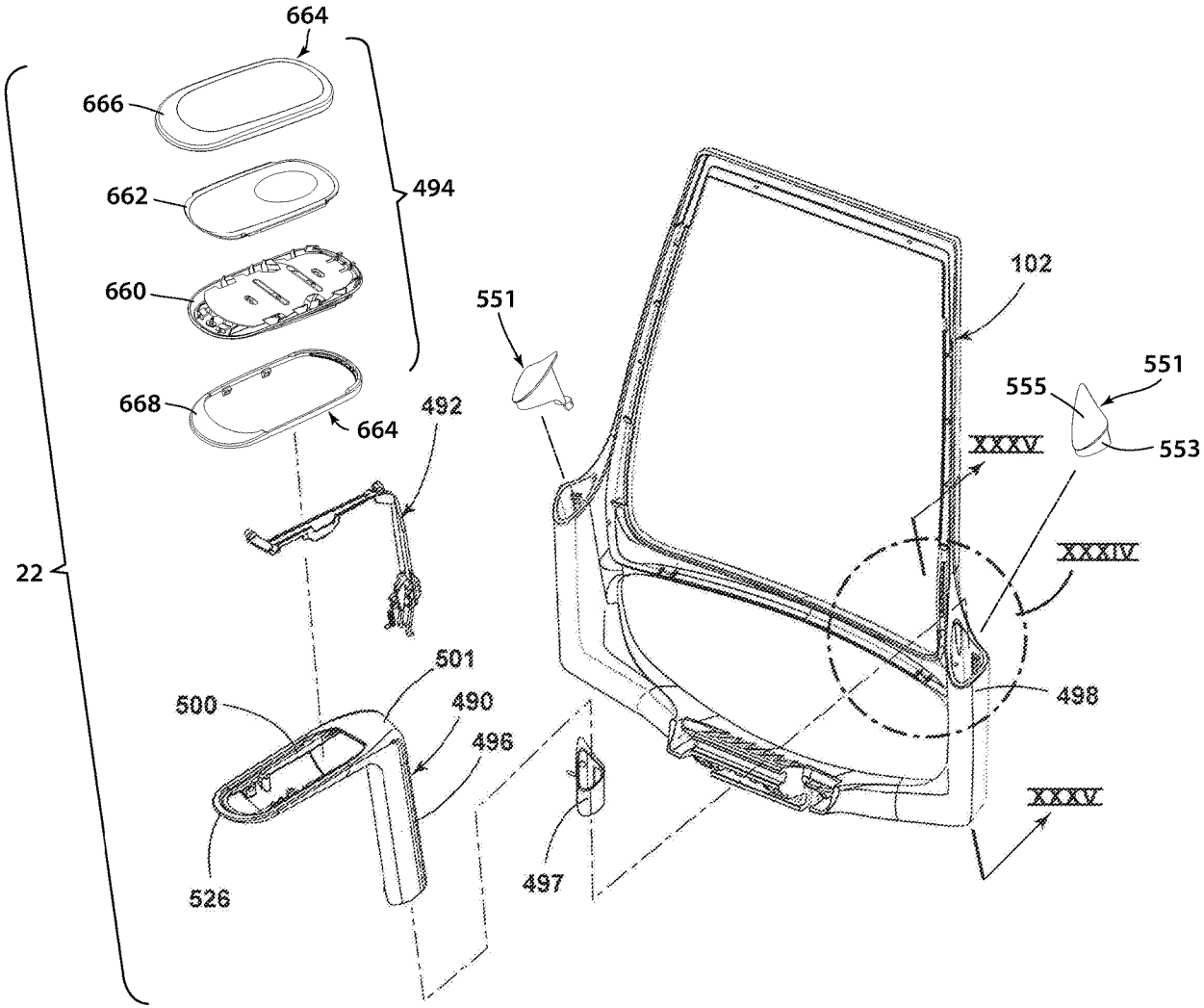
FIG. 32 is an exploded view of an arm assembly.
Figure 33:
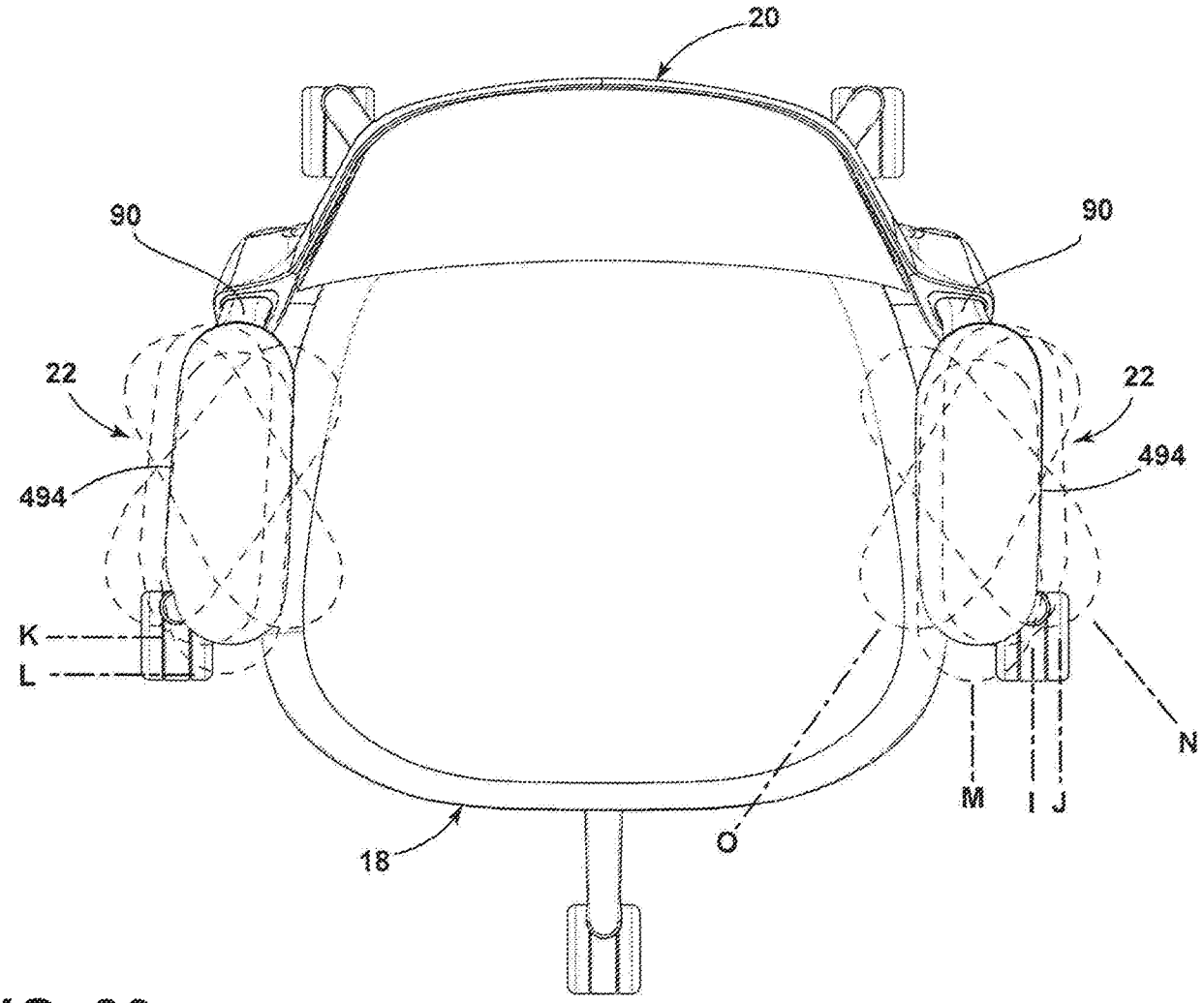
FIG. 33 is a top plan view of the seating arrangement showing the arm caps of the arm assemblies of the seating arrangement in various configurations and positions.

As best illustrated in FIG. 32, the arm assembly 22 may also be provided as a conversion kit along with/or separate from a pair of plug members 551, where the arm assemblies 22 may be replaced with the plug member 551 to convert the seating arrangement 10 from an arm to an armless version, or vice versa. Each plug member 551 includes a column portion 553 similarly configured as the column portion 490 of the armrest 22 and adapted to be received within the receiver portion 498 of the back frame 102, and an end wall 555 that blocks off an end of the column portion 553 thereby providing a finished aesthetic look and preventing access to the interior of the receiver portion 498. In some embodiments, the plug member 551 may be configured to include accessory components or supports, including, but not limited to a bag hook, cup holder, tablet, phone or other device holder, or other personal accessories.

Figure 34:
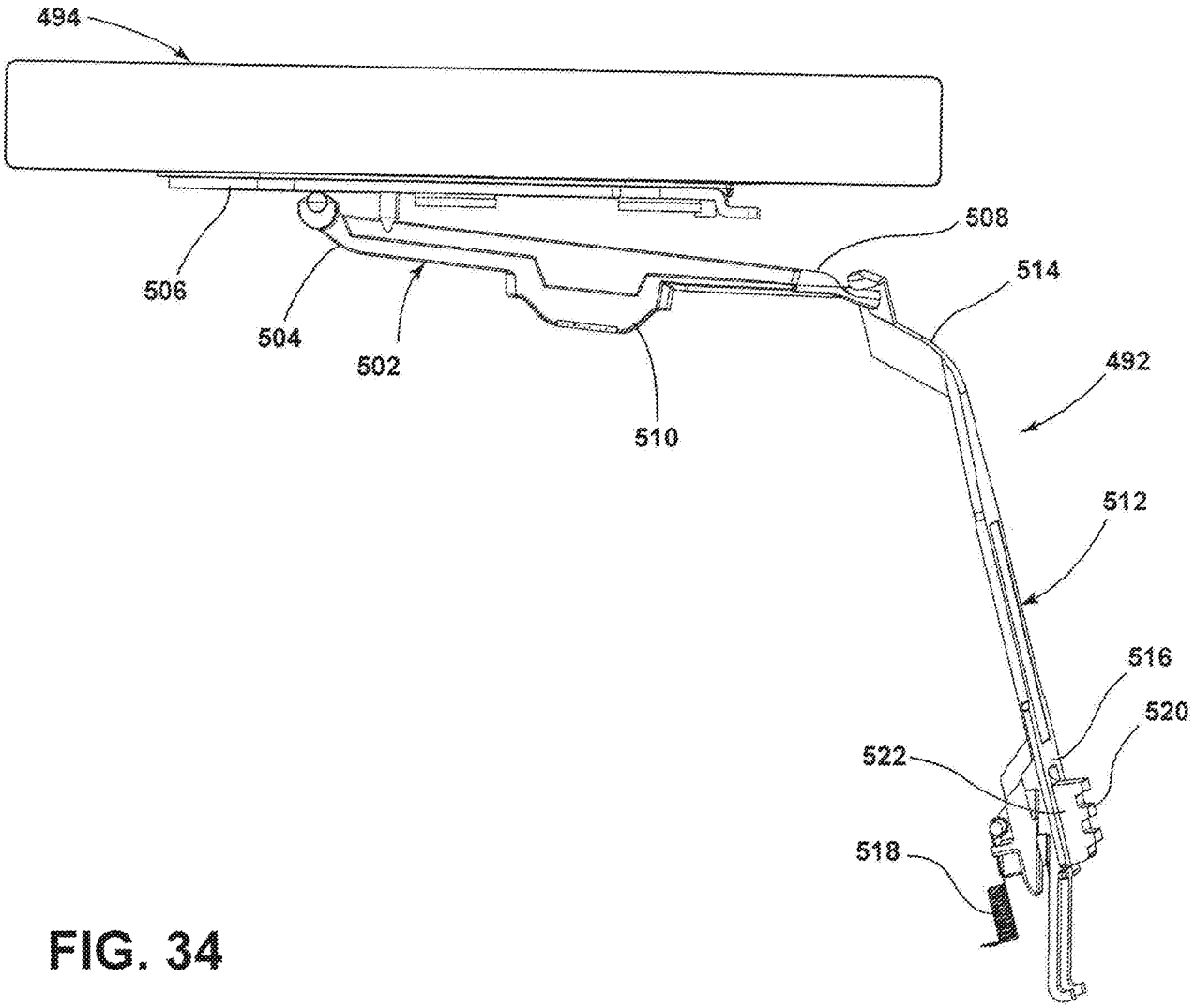
FIG. 34 is a side elevational view of the arm cap and a control assembly of the arm assembly shown in FIG. 32.
Figure 35:
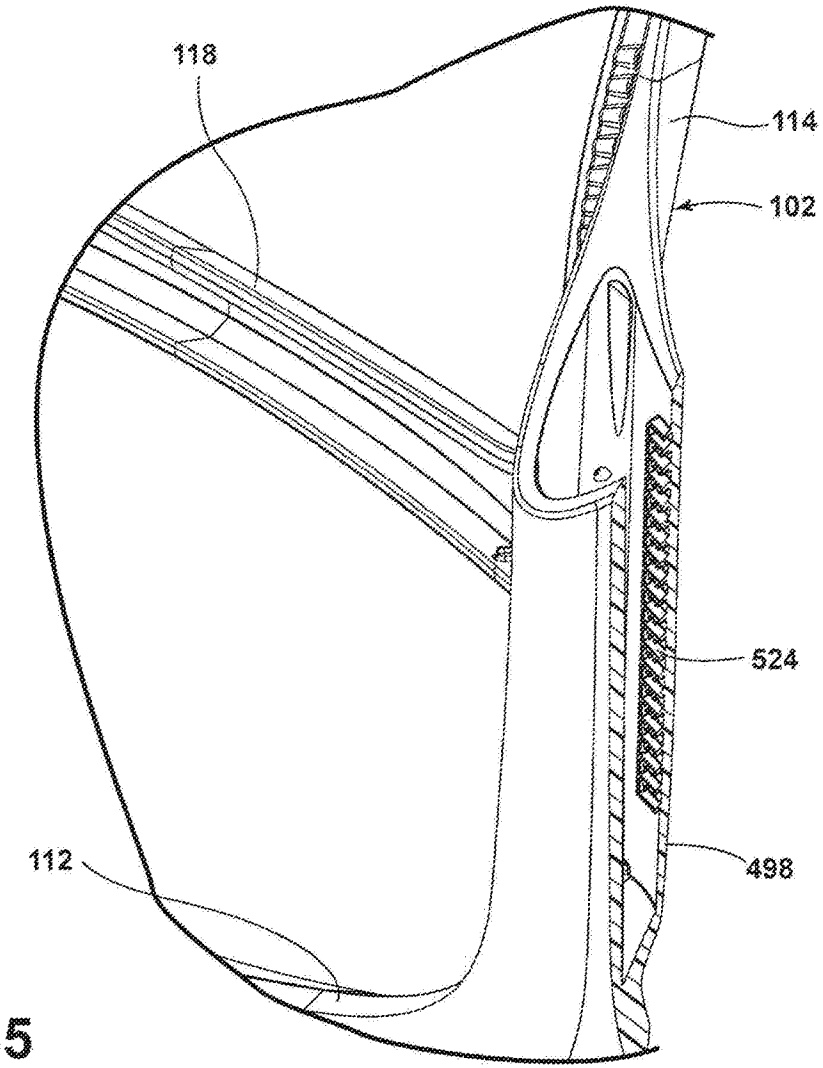
FIG. 35 is a cross-sectional perspective view of a receiver portion of back frame member taken along the line XXXV-XXXV, FIG. 32.
Figure 38:
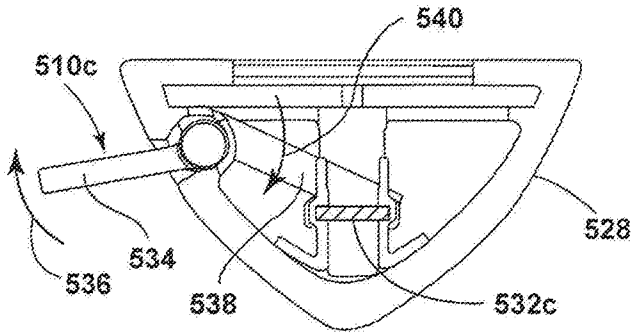
FIG. 38 is an end view of an end cap of the arm assembly of FIG. 36.

The control assembly 492 (FIG. 34) includes a first link 502 having a first end 504 pivotably coupled to a support plate 506 of the arm support 492, and a second end 508. The first link member further includes an actuator portion 510 positioned along a length of the first link 502 between the first end 504 and the second end 508. The control assembly 492 further includes a second link 512 having a first end 514 pivotably coupled to the second end 508 of the first link 502, and a second end 516. The second end 516 includes a biasing spring 518 that biases a plurality of locking teeth 520 of a locking member 522 into a locking engagement with a plurality of receiving teeth (FIG. 35) integrally molded with the back frame member 102 within in interior of the receiver 498. In the present embodiment, the pivot connection between the first link 502 and the second link 512 is preferably located proximate the corner 501 between the first portion 496 and the second portion 500, and that the actuator portion 510 extends through an aperture in the bottom of the second portion 500 of the column member 490, such that the actuator portion 510 is accessible along the length of the second portion 500 between the corner 501 and a distal end 526 of the column member 490.

Figure 37:
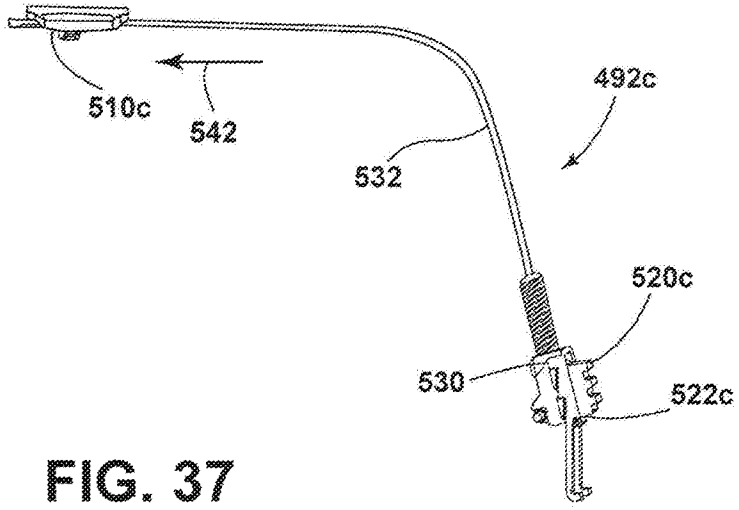
FIG. 37 is a side elevational view of a control arrangement for the arm assembly of FIG. 36.
Figure 36:
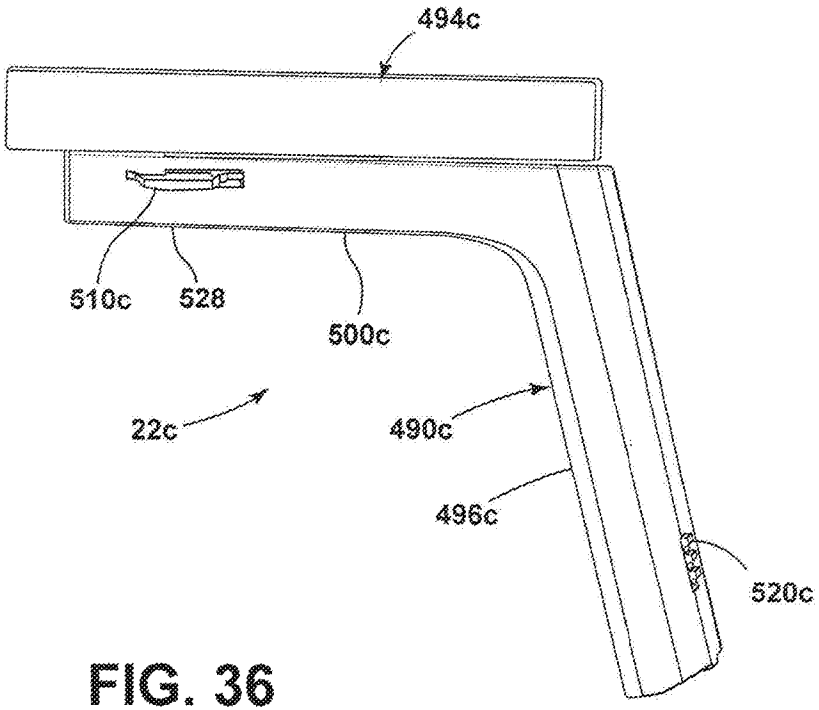
FIG. 36 is a side elevational view of an alternative embodiment of the arm assembly.
Figure 39:
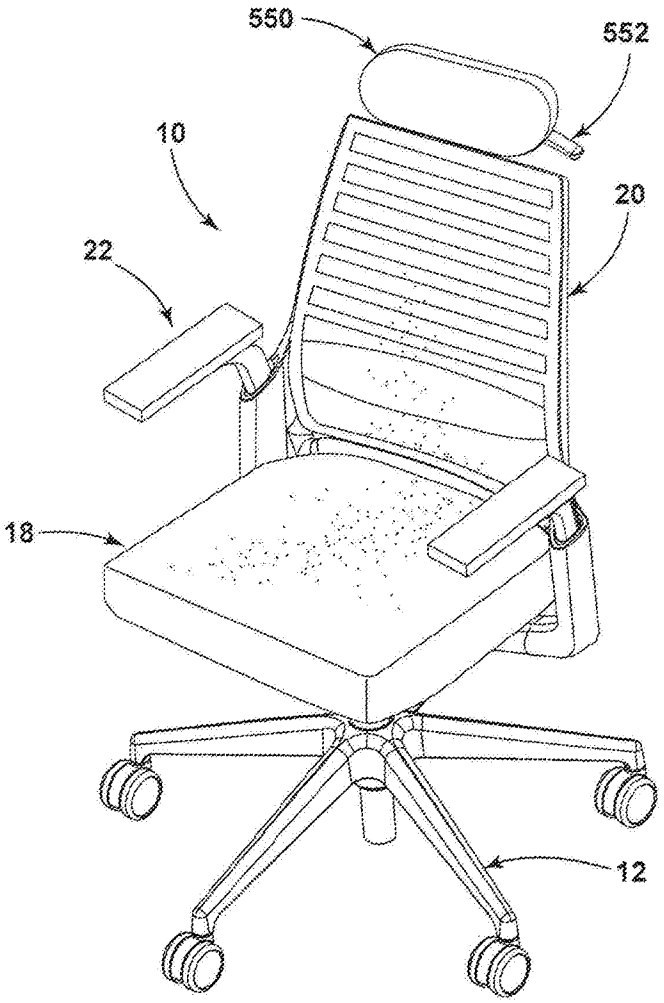
FIG. 39 is a top perspective view of an alternative embodiment of the seating arrangement including a headrest assembly and a garment hanger.

The reference 22*c* (FIG. 36) generally designates an alternative embodiment of the arm assembly. Since the arm assembly 22*c* is similar to the previously described arm assembly 22, similar parts appearing in FIGS. 32-34 and FIGS. 36-38 respectively represented by the same, corresponding reference, except for the suffix "c" in the numerals of the latter. In the illustrated embodiment, the actuator portion 510*c* is pivotably received within an end cap 528. The control assembly 492*c* (FIG. 37) includes the actuator portion 510*c*, a locking portion 530, and a flexible connector portion 532. The actuator portion 510*c*, the locking portion 530 and the connector portion 532 are preferably constructed as an integral, one-piece unit that includes the entire actuator portion 510*c* and the entire locking portion 530, including the plurality of locking teeth 520*c*. In operation, an operator grasps a handle portion 534 of the actuator portion 510*c* moving the handle portion 534 in a direction 536 and an arm portion 538 in a direction 540 thereby bending a distal end of the connector portion 532 downwardly and drawing the connecting portion 532 in a direction 542 and disengaging the plurality of locking teeth 520*c* from the plurality of receiving teeth 524 of the receiver portion 498 of the back frame member 102.

As best illustrated in FIG. 32, the arm support assembly 494 may include a plastic arm cap shell member 660, an arm cap foam member 662, and an arm cap cover arrangement 664 that includes an outer layer 666 comprising a thermoplastic polyolefin (TPO) and/or a thermoplastic elastomer (TPE) that is overmolded onto a connection ring 668. In assembly, the foam member 662 is positioned within the arm cap cover arrangement 664. The shell member 660 is then positioned within the cover arrangement 664 and snap-fit or connected via mechanical fasteners (not shown) to the connection ring 668. The arm support assembly 494 is then connected to the second portion 500 of the column arm 490 via mechanical fasteners that extend through the second portion and into the shell member 660.

Figures 9, 9A:
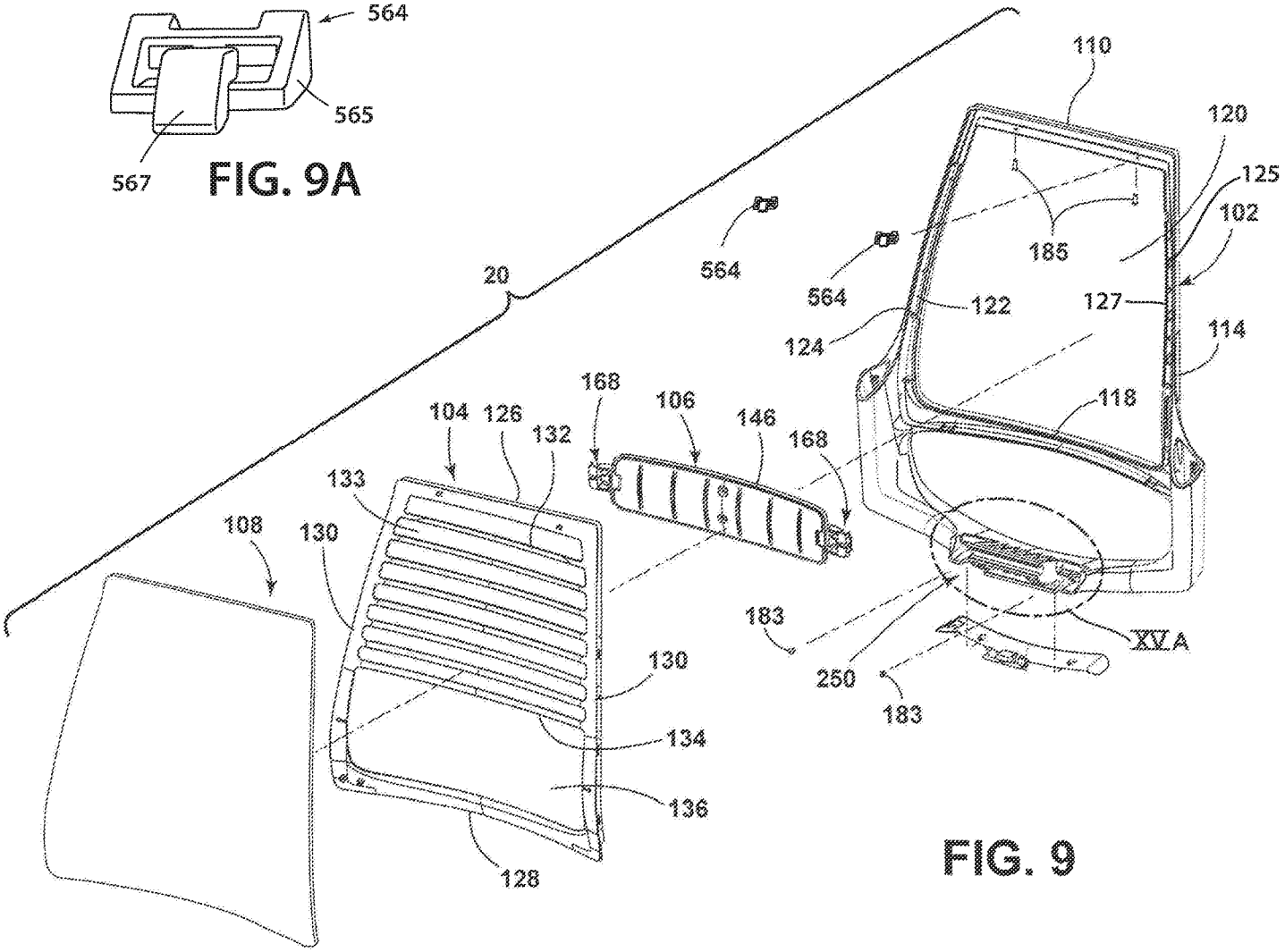
FIG. 9 is an exploded view of a back assembly.
FIG. 9A is a perspective view of a flush-mount fastener.
Figure 10:
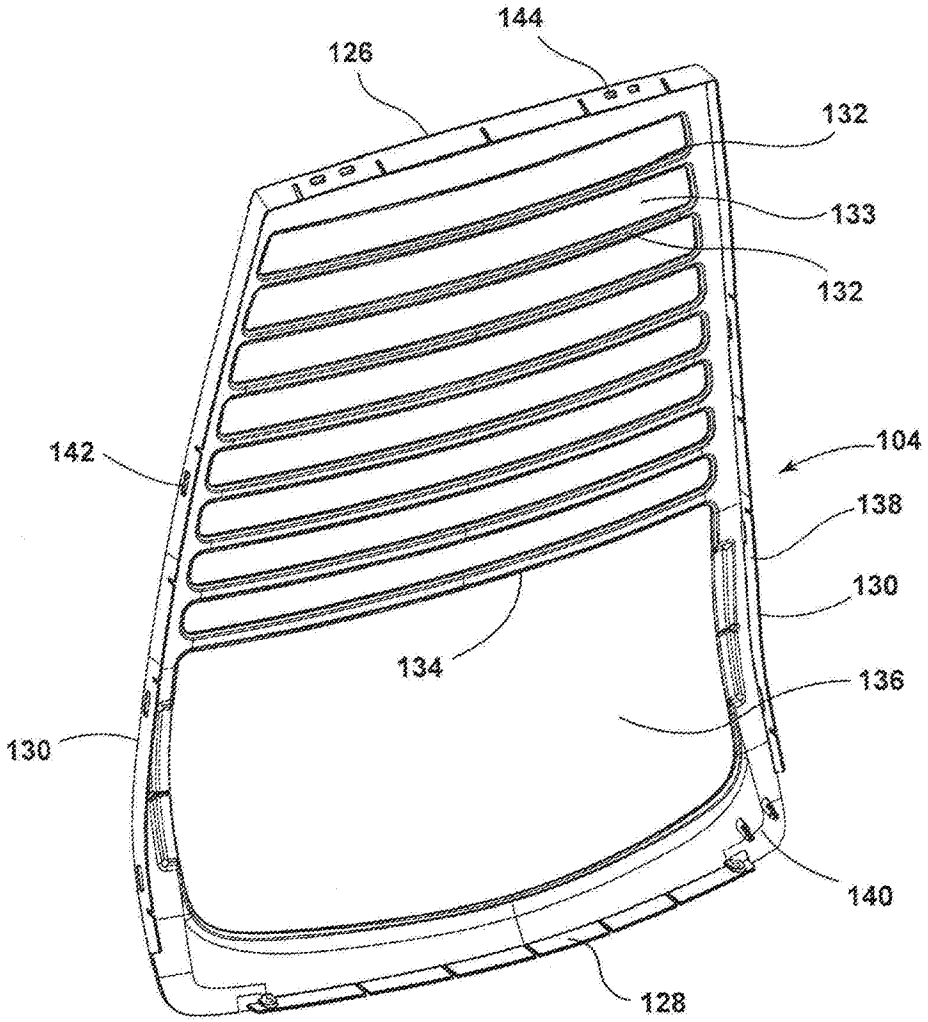
FIG. 10 is a rear perspective view of a back shell member.
Figure 40:
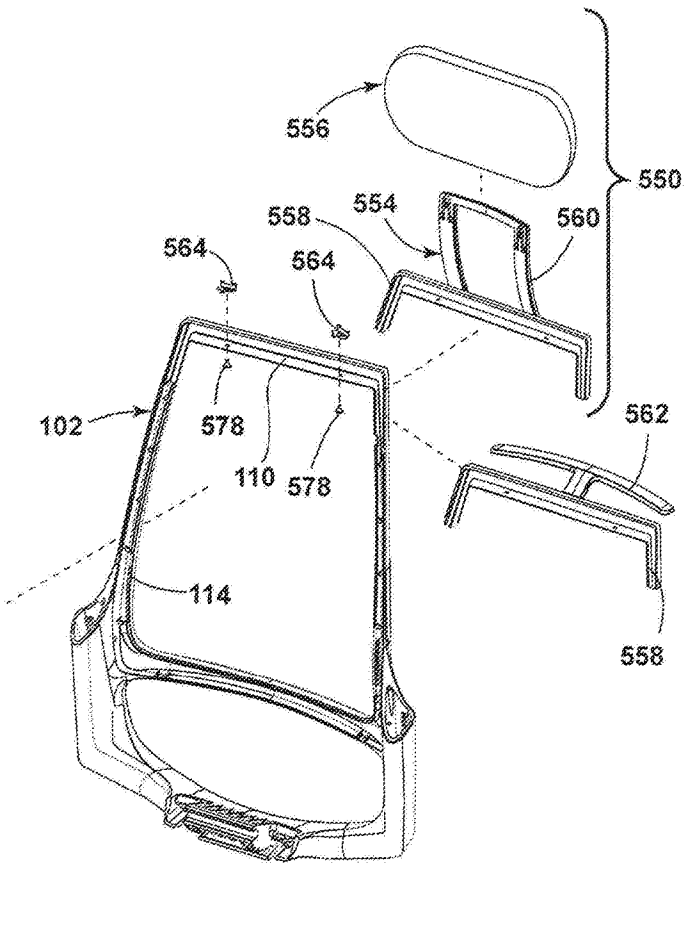
FIG. 40 is an exploded view of the backrest assembly, the headrest assembly and the garment hanger of FIG. 39.
Figure 41:
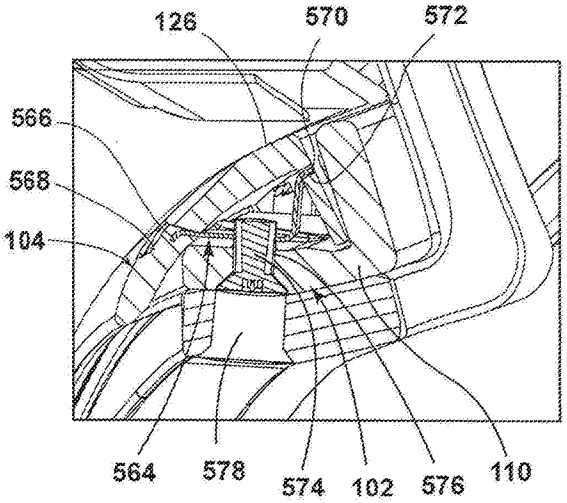
FIG. 41 is a cross-sectional view of a coupling arrangement securing the back shell, the back frame member and the headrest assembly with one another.
Figure 42:
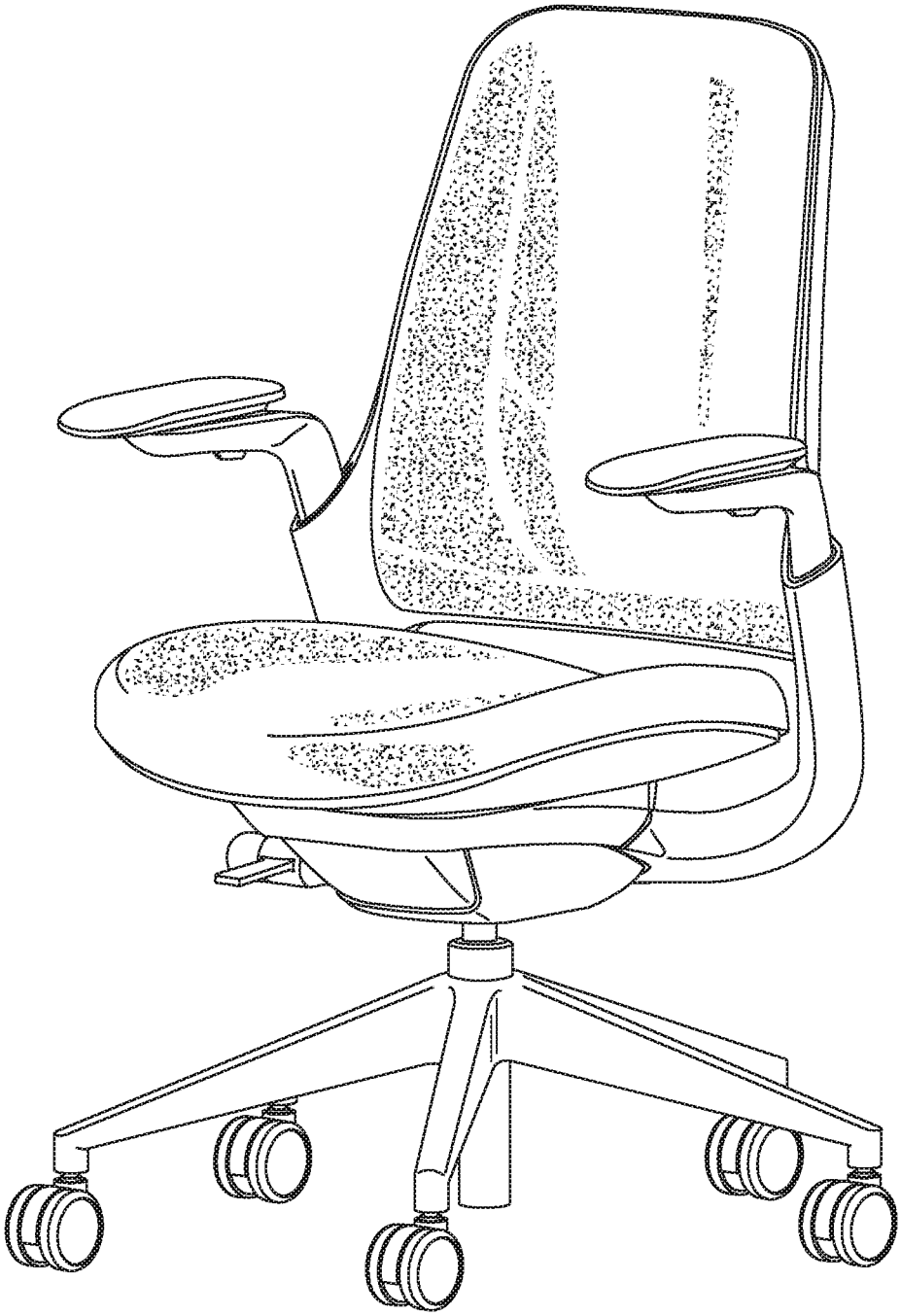
FIG. 42 is a top perspective view of a chair assembly.
Figure 43:
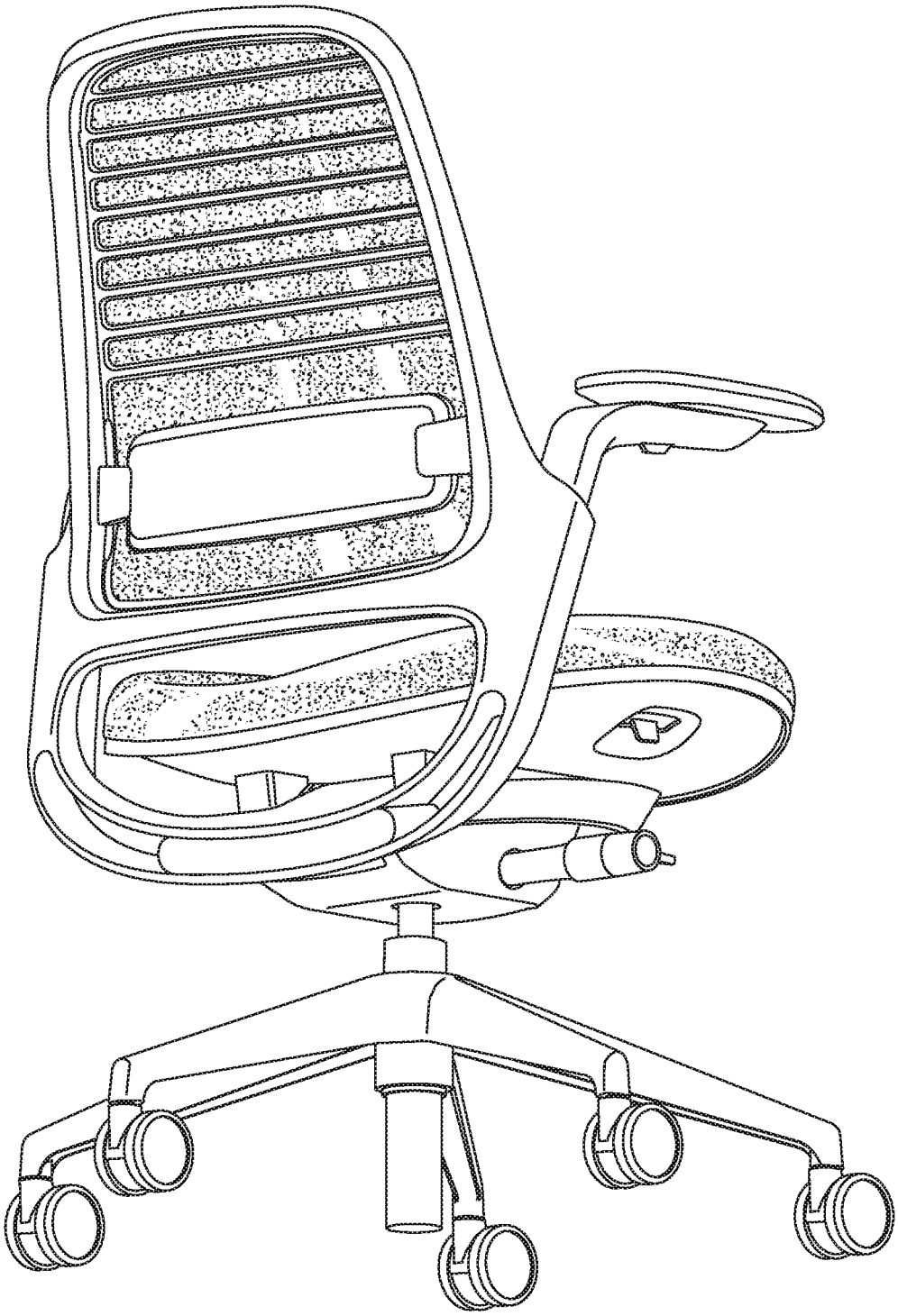
FIG. 43 is a bottom perspective view of the chair assembly.
Figure 44:
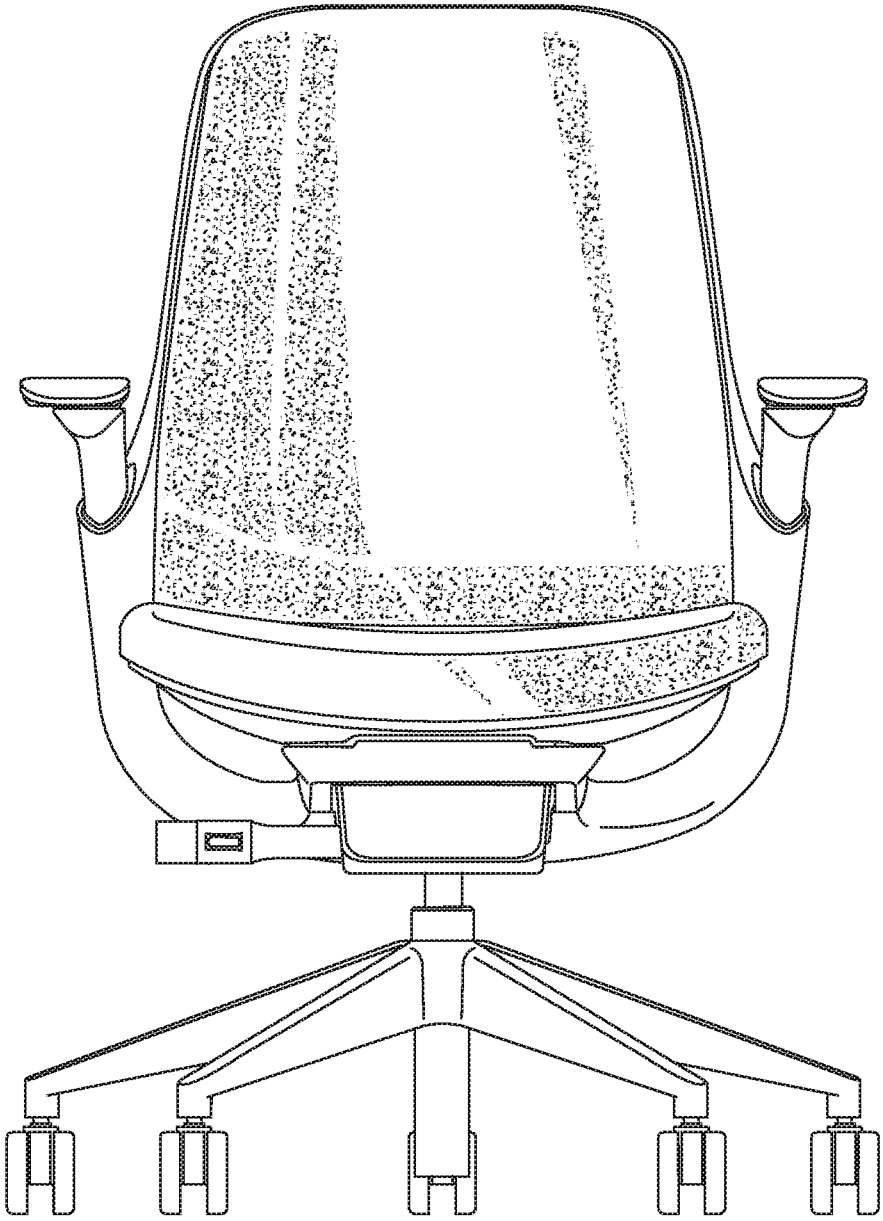
FIG. 44 is a front elevational view of the chair assembly of FIG. 42.
Figure 45:
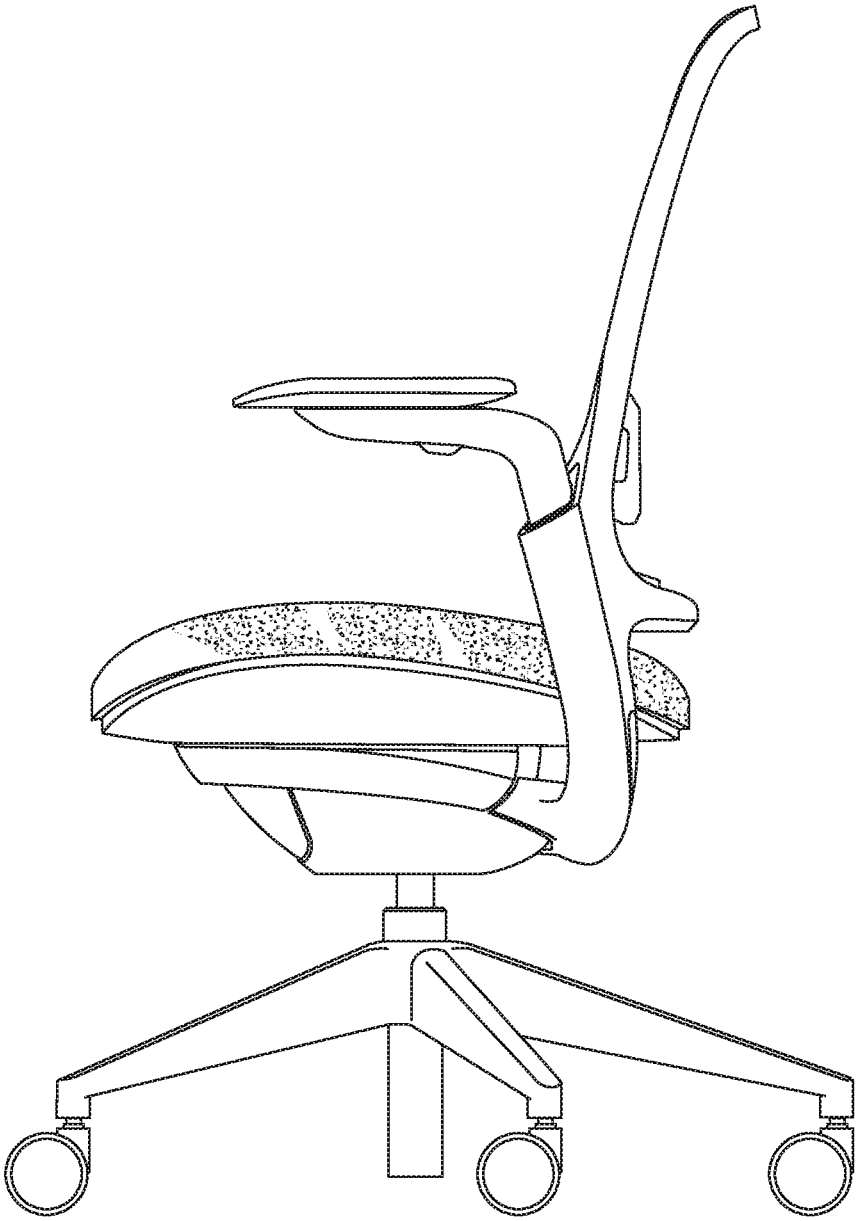
FIG. 45 is a first side elevational view of the chair assembly of FIG. 42.
Figure 46:
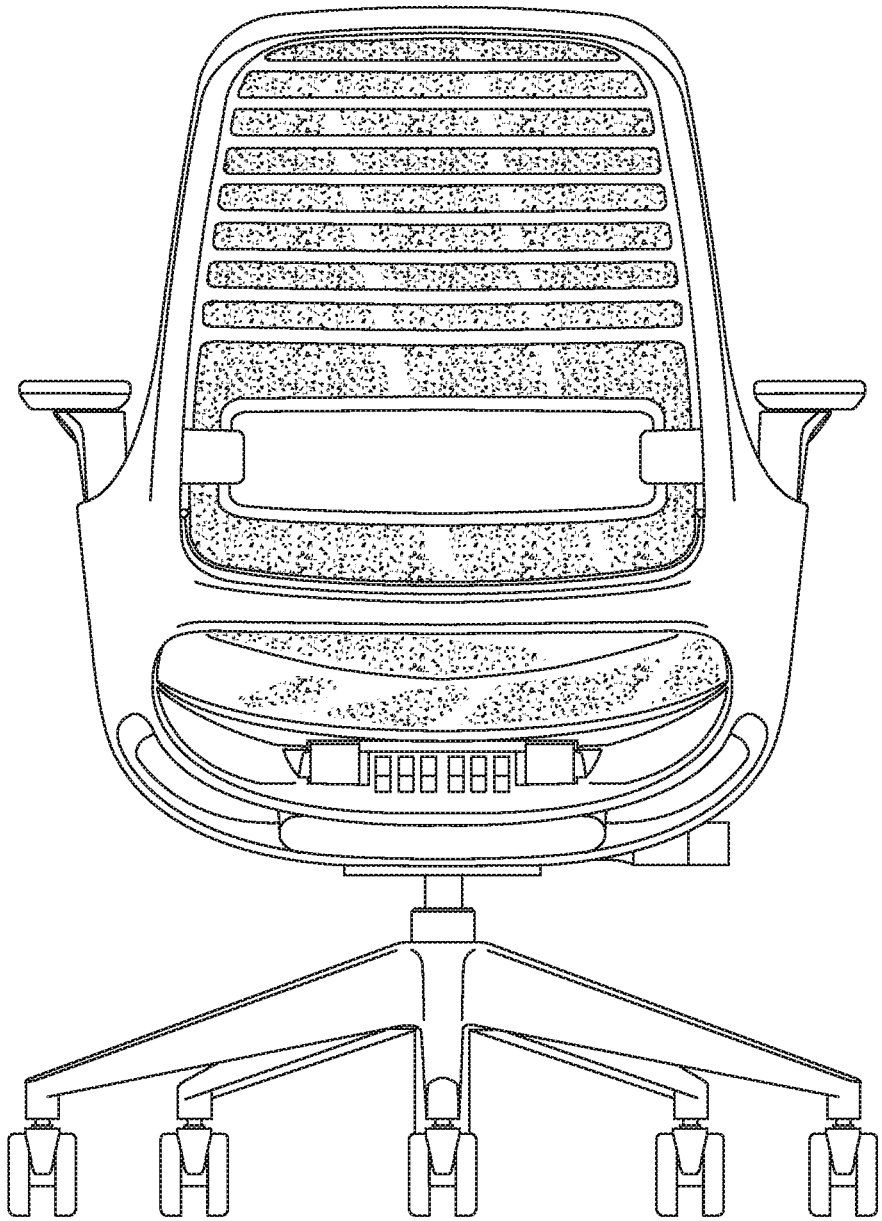
FIG. 46 is a rear elevational view of the chair assembly of FIG. 42.
Figure 47:
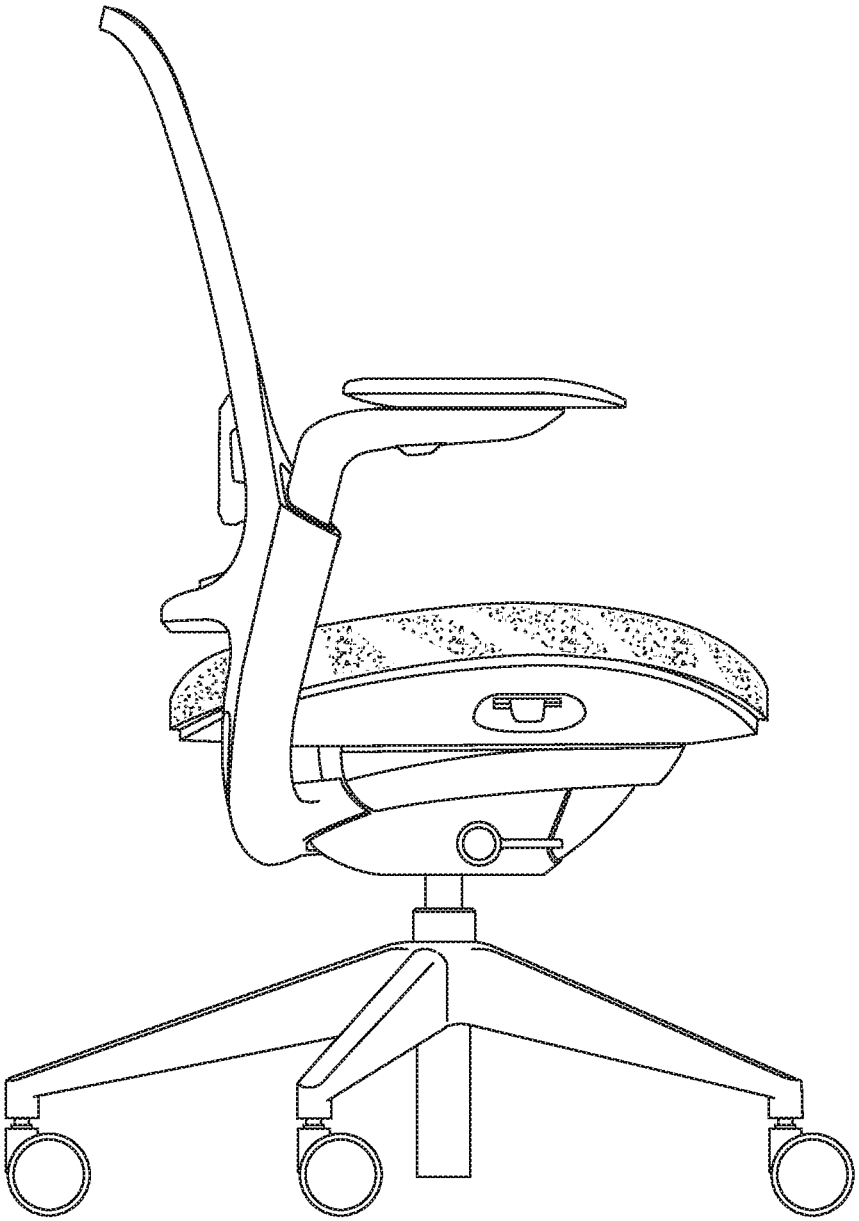
FIG. 47 is a second side elevational view of the chair assembly of FIG. 42.
Figure 48:
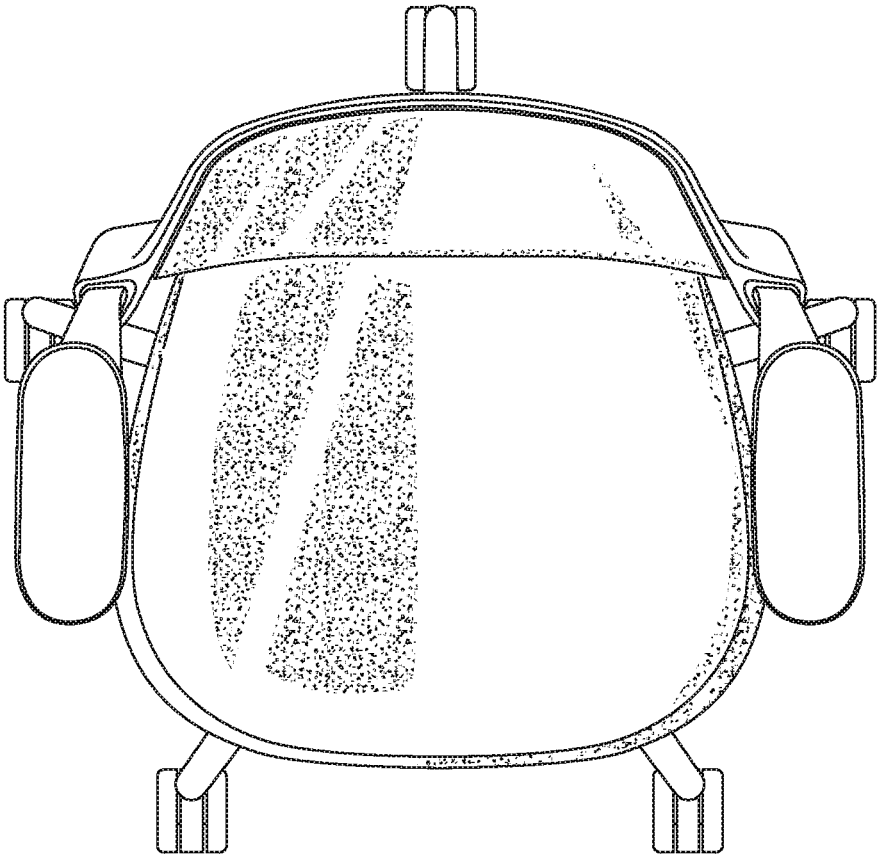
FIG. 48 is a top plan view of the chair assembly of FIG. 42.
Figure 49:
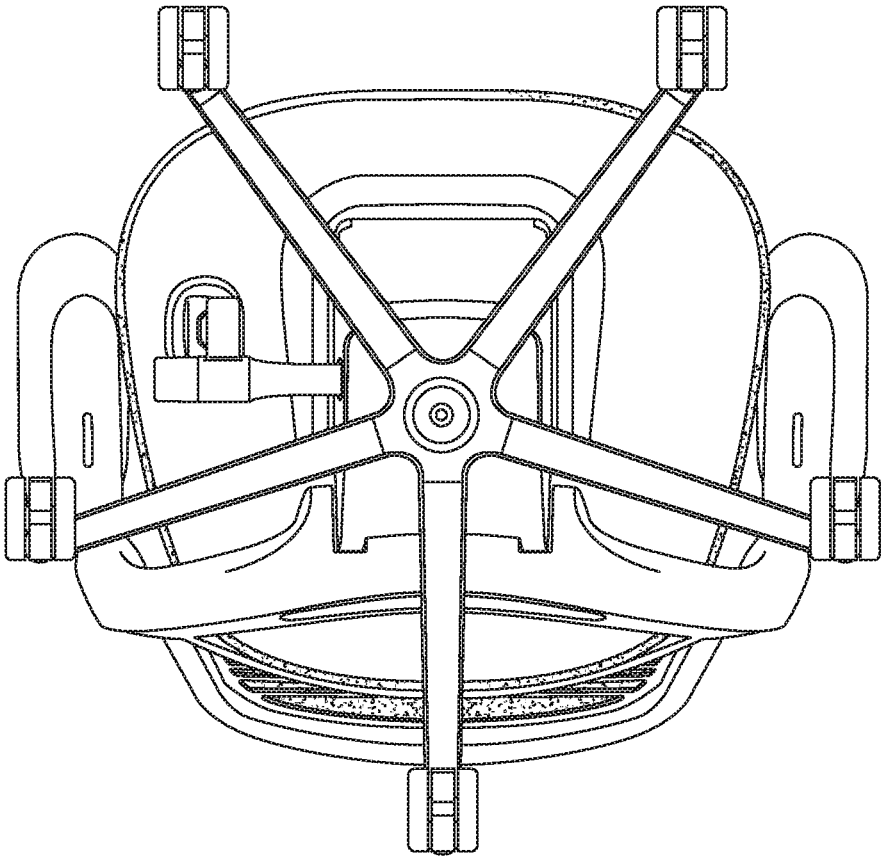
FIG. 49 is a bottom plan view of the chair assembly of FIG. 42.

In another alternative embodiment, the seating arrangement 10 (FIG. 38) may be provided with a headrest assembly 550 and/or a garment hanger 552. In the illustrated example, the headrest assembly 550 (FIG. 40) includes a mounting structure 554 and a headrest member 556. The mounting structure 554 includes a mounting portion 558 having an upwardly-opening, U-shaped cross-section configuration, and an overall configuration similar to the upper portion of the back frame member 102, and an upwardly extending support stand 562 to which the headrest member 556 is vertically adjustably mounted. Alternatively, the mounting structure 554 for the headrest member 556 may be replaced by a garment hanger 552, and/or the mounting structure 554 and the garment hanger 562 may both be combined onto a single mounting portion 558. As best illustrated in FIG. 41, the upper back shell portion 126 of the back shell member 104 is secured to the upper frame portion 110 of the back frame member 102 via a pair of mounting clips 564 positioned between the upper shell portion 126 and the upper frame portion 110, and including a forwardly extending hook 566 that extends into an aperture 568 of the back shell member 104, and a pair of rearwardly extending hooks 570 extending into apertures 572 of the back shell member 104. A plurality of mounting screws 574 extend through apertures 576 of the back frame member 102 and are received by the mounting clips 564, thereby securing the top shell portion 126 of the back shell member 104 to the top frame portion 110 of the back frame member 102. Alternatively, the screws 574 may be replaced by relatively longer screws 578 that can extend through the mounting portion 558 of the headrest assembly 550 and the upper frame portion 110 of the back frame member 102 and into the mounting clips 564, thereby securing the headrest assembly 550 and the back shell member 104 to the back frame member 102. As best illustrated in FIG. 9A, each mounting clip 564 includes a body portion 565 that threadably receives the associated screws 574/578, and a forwardly-extending engagement portion 567 that snappingly engages corresponding apertures 569 (FIG. 9) of the back shell member 104. The mounting clips 564 are each configured such that a front face 571 of the engagement portion 567 are substantially flush with a forwardly-facing surface 573 of the back shell member 104, thereby completely filling the aperture 569 and providing a flush surface in cooperation with the back shell member 104.

The invention claimed is:

1. A seating arrangement, comprising:

a substantially rigid back frame including a horizontally extending top portion, a horizontally extending bottom portion, and a pair of side portions extending vertically between the top portion and the bottom portion, wherein the top portion, the bottom portion and the side portions of the back frame cooperated to define an opening;

a flexibly resilient back shell having a forwardly facing support surface located within at least a portion of the opening and configured to support a seated user, and an attachment portion that extends about a majority of a periphery of the support surface, the attachment portion attaching the back shell to the back frame; and a cover member extending over at least a portion of the support surface, wherein the cover member is directly attached to the attachment portion of the back shell about a majority of the periphery of the support surface.

2. The seating arrangement of claim 1, wherein at least one of the top portion, the bottom portion and the side portions include a longitudinally extending channel, the cover member is directly attached to the attachment portion of the back shell at an attachment location, and wherein the attachment location and the attachment portion of the back shell are located within the channel and concealed from view.

3. The seating arrangement of claim 1, wherein the cover member is directly attached to the attachment portion of the back shell by a sewn connection.

4. The seating arrangement of claim 1, wherein the back shell includes a plurality of horizontally-extending slats that at least in part form the support surface.

5. The seating arrangement of claim 1, wherein the attachment portion of the back shell extends substantially orthogonally rearwardly from the support surface.

6. The seating arrangement of claim 1, wherein the seating arrangement comprises an office chair assembly.

7. The seating arrangement of claim 1, wherein the back shell comprises a plastic.

8. The seating arrangement of claim 1, wherein the back frame comprises a metal.

9. The seating arrangement of claim 1, wherein the cover member comprises a fabric.

10. A seating arrangement, comprising:

a substantially rigid back frame including a horizontally extending top portion, a horizontally extending bottom portion, and a pair of side portions extending vertically between the top portion and the bottom portion, wherein the top portion, the bottom portion and the side portions cooperate to define an opening, and wherein at least one of the top portion, the bottom portion and the side portions include a longitudinally extending channel;

a flexibly resilient back shell having a forwardly facing support surface located within at least a portion of the opening and configured to support a seated user, and an attachment portion that extends about at least a portion of a periphery the support surface; and a cover member extending over at least a portion of the support surface, wherein the cover member is directly attached to the attachment portion of the back shell at an attachment location, and wherein the attachment location and the attachment portion of the back shell are located within the channel and concealed from view.

11. The seating arrangement of claim 10, wherein the cover member is directly attached to the attachment portion of the back shell by a sewn connection.

12. The seating arrangement of claim 10, wherein the attachment portion extends about a majority of the support surface of the back shell.

13. The seating arrangement of claim 10, wherein the cover member is attached to a majority of a length of the attachment portion of the back shell.

14. The seating arrangement of claim 10, wherein the back shell includes a plurality of horizontally-extending slats that include at least a portion of the support surface.

15. The seating arrangement of claim 10, wherein the attachment portion of the back shell extends substantially orthogonally rearwardly from the support surface.

16. The seating arrangement of claim 10, wherein the seating arrangement comprises an office chair assembly.

17. The seating arrangement of claim 10, wherein the back shell comprises a plastic.

18. The seating arrangement of claim 10, wherein the back frame comprises a metal.

19. The seating arrangement of claim 10, wherein the cover member comprises a fabric.

* * * * *